US005816149A

United States Patent [19]

Kagawa et al.

[11] Patent Number: 5,816,149

[45] Date of Patent: Oct. 6, 1998

[54] DEVICE FOR AUTOMATICALLY PEELING OFF THE LEADING EDGE OF A STENCIL FROM A STENCIL ROLL AND MASTER MAKING DEVICE HAVING THE SAME

[75] Inventors: Hideyuki Kagawa, Sendai; Terunobu Ohnuma, Kawasaki-machi; Kazuhisa Takahashi, Murata-machi; Yoshiharu Kanno, Sendai; Takayuki Takahashi, Shibata-machi, all of Japan

[73] Assignee: Tohoku Ricoh Co., Ltd., Miyagi-ken, Japan

[21] Appl. No.: 698,265

[22] Filed: Aug. 14, 1996

[30] Foreign Application Priority Data

Nov. 21, 1995 [JP] Japan ..... 7-303077
Jul. 12, 1996 [JP] Japan ..... 8-183788

[51] Int. Cl.[6] ..... B41C 1/14; B65H 16/00

[52] U.S. Cl. ..... 101/128.4; 101/477; 242/332.5; 242/562; 242/562.1

[58] Field of Search ..... 101/116, 117, 101/118, 121, 122, 128.21, 128.4, 477, 228, 288; 242/562, 562.1, 332.5, 332.6; 400/613, 613.1

[56] References Cited

U.S. PATENT DOCUMENTS

| | | | |
|---|---|---|---|
| 823,318 | 6/1906 | Brown | 242/562 |
| 3,488,016 | 1/1970 | Mouissie | 242/332.5 |
| 3,489,361 | 1/1970 | Marion et al. | 242/562 |
| 3,834,204 | 9/1974 | Ihle | 242/562 |
| 4,285,475 | 8/1981 | Rogers | 242/562.1 |
| 4,957,378 | 9/1990 | Shima | 101/128.4 |
| 5,375,516 | 12/1994 | Hasegawa | 101/128.4 |
| 5,388,923 | 2/1995 | Dubois et al. | 400/613.1 |
| 5,558,019 | 9/1996 | Kawai et al. | 101/116 |
| 5,613,437 | 3/1997 | Motoe et al. | 101/128.4 |
| 5,640,904 | 6/1997 | Sato et al. | 101/128.4 |

FOREIGN PATENT DOCUMENTS

| | | | |
|---|---|---|---|
| 349350 | 1/1990 | European Pat. Off. | 242/562 |
| 16787 | 1/1984 | Japan | 101/128.4 |
| 174218 | 10/1984 | Japan | 242/562 |
| 63-178134 | 11/1988 | Japan . | |
| 6-32041 | 2/1994 | Japan . | |
| 198335 | 7/1994 | Japan | 242/562 |
| 6-227110 | 8/1994 | Japan . | |
| 7-17013 | 1/1995 | Japan . | |
| 7-101135 | 4/1995 | Japan . | |
| 7-125400 | 5/1995 | Japan . | |

*Primary Examiner*—Stephen R. Funk
*Attorney, Agent, or Firm*—Oblon, Spivak, McClelland, Maier & Neustadt, P.C.

[57] ABSTRACT

A master making device for a stencil printer and a device included in the master making device for automatically peeling the leading edge of a stencil from a stencil roll are disclosed. Even when the leading edge of the stencil has a noticeable curl, it can be surely peeled off from the roll and paid out automatically. A peeler has its peeling end prevented from being curled.

45 Claims, 33 Drawing Sheets

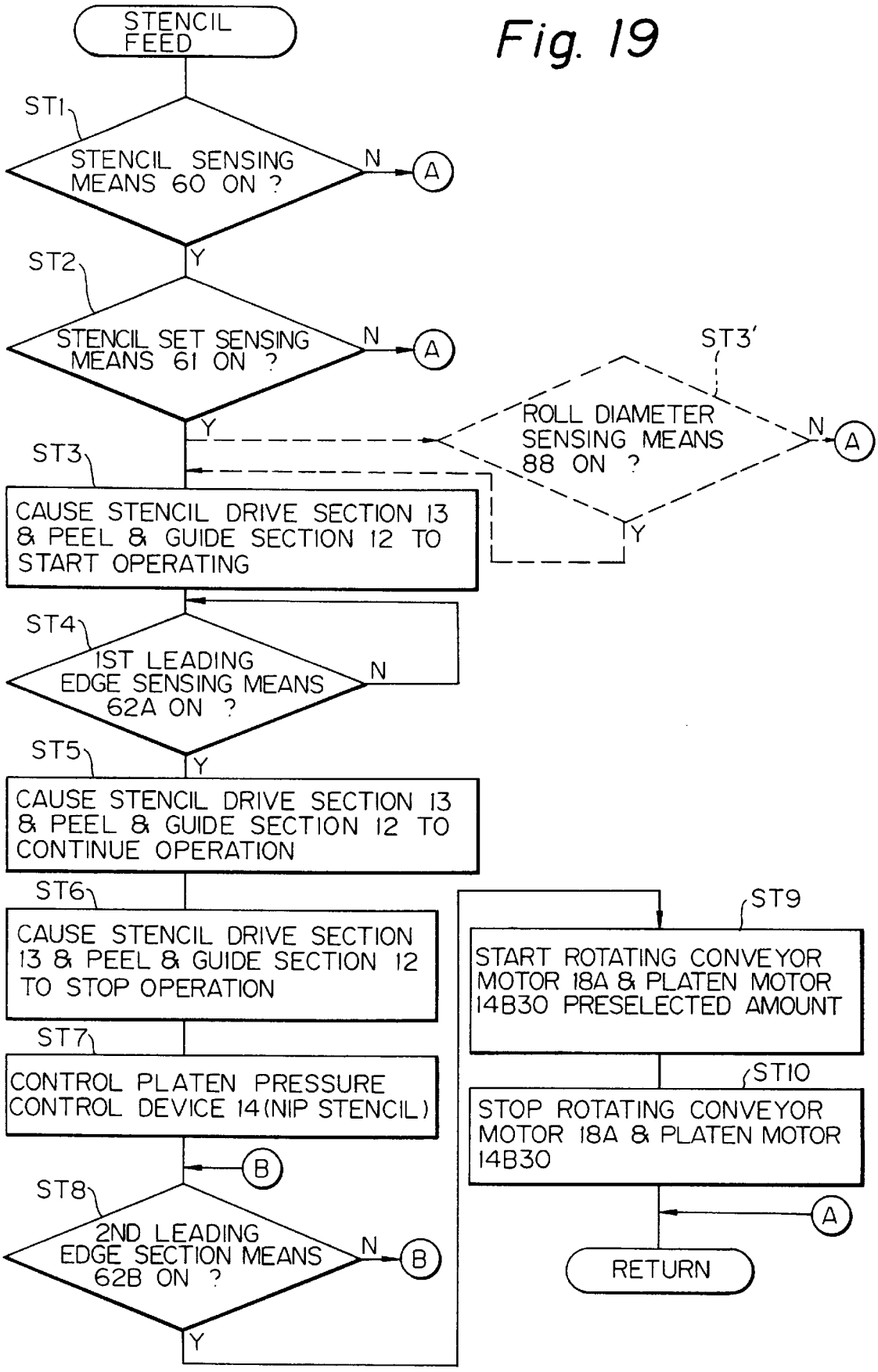
Fig. 19
STENCIL FEED
ST1
STENCIL SENSING MEANS 60 ON ?
N
A
Y
ST2
STENCIL SET SENSING MEANS 61 ON ?
N
A
Y
ST3'
ROLL DIAMETER SENSING MEANS 88 ON ?
N
A
Y
ST3
CAUSE STENCIL DRIVE SECTION 13 & PEEL & GUIDE SECTION 12 TO START OPERATING
ST4
1ST LEADING EDGE SENSING MEANS 62A ON ?
N
Y
ST5
CAUSE STENCIL DRIVE SECTION 13 & PEEL & GUIDE SECTION 12 TO CONTINUE OPERATION
ST6
CAUSE STENCIL DRIVE SECTION 13 & PEEL & GUIDE SECTION 12 TO STOP OPERATION
ST7
CONTROL PLATEN PRESSURE CONTROL DEVICE 14(NIP STENCIL)
B
ST8
2ND LEADING EDGE SECTION MEANS 62B ON ?
N
B
Y
ST9
START ROTATING CONVEYOR MOTOR 18A & PLATEN MOTOR 14B30 PRESELECTED AMOUNT
ST10
STOP ROTATING CONVEYOR MOTOR 18A & PLATEN MOTOR 14B30
A
RETURN

DEVICE FOR AUTOMATICALLY PEELING OFF THE LEADING EDGE OF A STENCIL FROM A STENCIL ROLL AND MASTER MAKING DEVICE HAVING THE SAME

BACKGROUND OF THE INVENTION

The present invention relates to a device for automatically peeling off the leading edge of a stencil from a stencil roll advantageously applicable to a stencil printer or similar printer, and a master making device having the same.

A stencil printer with a thermosensitive digital master making capability is extensively used as a simple printer. The stencil printer is operable with a thermosensitive stencil having a thermoplastic resin film. In the stencil printer, a thermal head selectively cuts or perforates the stencil in accordance with image data. After the cut stencil or master has been wrapped around a print drum, ink is fed from the inside of the drum. The ink oozes out to the master via the porous wall of the drum. A sheet is pressed against the surface of the drum by a press roller or similar pressing means with the intermediary of the master. As a result, the ink is transferred from the drum to the sheet via perforations formed in the master, thereby forming an image on the sheet. The thermal head has a number of heating elements arranged in the main scanning direction corresponding to the axial direction of the drum. The heating elements selectively generate heat under selective current supply control, thereby cutting the corresponding portions of the stencil.

Japanese Utility Model Laid-Open Publication No. 6-35 178134, for example, teaches a stencil printer having a master making section and a document reading section for reading image data from a document. The document reading section is arranged above the master making section. With this arrangement, the printer is capable of performing image reading and master making consistently therein. When the printer runs out of the stencil, a new stencil is replenished into the printer by hand, as follows.

First, the document reading section positioned on the top of the printer is slid away from its operative or regular position, so that the entire master making section is visible from above the printer. Usually, a stencil is wound round a core in the form of a roll in order to save limited space available in the printer. The stencil roll is loaded in a roll support section included in the master making section from above the printer. Subsequently, the leading edge of the roll is pulled out from the roll and then cut at a preselected length or in a preselected shape. After the piece cut away from the stencil has been removed from the printer, the leading edge of the stencil is paid out to a preselected position. Thereafter, the document reading section is restored to its operative position.

The conventional stencil printer having the above configuration has various problems left unsolved, as follows. The roll replacing procedure described above is complicated and troublesome and needs expertness, i.e., a full-time operator. Because the stencil is often implemented by a relatively thin thermosensitive resin film, it is likely that the leading edge of the stencil is broken or bent when paid out from the roll.

To pay out the stencil from the roll, it is a common practice to rotate a core or shaft positioned at the center of the roll. Therefore, when the roll is new and has the maximum outside diameter, a great torque is required in order to rotate the core. The great torque not only increases the size of a drive mechanism but also often results in defective torque transmission.

In light of the above, particularly problems with the master making device conventionally installed in a printer, a new master making device capable of insuring the pay-out of a stencil from a stencil roll and facilitating the attachment of a master is disclosed in pending U.S. patent application Ser. No. 08/690,547, filed Jul. 31, 1996 based on Japanese Patent Application No. 8-170040. However, a problem with this master making device is that when the diameter of the roll decreases due to the consumption of the stencil, the leading edge of the stencil peeled off from the roll by a peeler is noticeably curled and slackened. This results in a jam or similar trouble and prevents the stencil from being surely conveyed. Further, the peeler is implemented as an elastic thin member formed of metal or resin and has a projection almost as thin as the stencil. Such a projection cannot maintain its configuration, e.g., it tends to curl after a long time of use. As a result, the peeler fails to surely peel off the leading edge of the stencil from the roll in due course of time.

SUMMARY OF THE INVENTION

It is therefore an object of the present invention to provide a device capable of automatically and surely peeling off the leading edge of a stencil from a roll and conveying it even when the leading edge is noticeably curled, and a master making device having the same.

It is another object of the present invention to provide an automatic stencil peeling device capable of preventing peeling means, including a peeler, from being deteriorated in durability and practically disabled, and a master making device having the same.

It is a further object of the present invention to provide a device capable of automatically and surely peeling off the leading edge of a sheet from a sheet roll and conveying it.

In accordance with the present invention, a device for automatically peeling off the leading edge of a sheet from a sheet roll and conveying it has a peeling member for contacting or adjoining the circumference of the sheet roll in accordance with the varying diameter of the sheet roll, thereby peeling off the leading edge of the sheet. A conveying member is located in close proximity to the peeling member and contacts the circumference of the sheet roll in accordance with the varying diameter of the roll, thereby conveying the leading edge peeled off by the peeling member.

Also, in accordance with the present invention, a device for automatically peeling off the leading edge of a sheet from a sheet roll and conveying it has a drive roller positioned at a preselected center angle with respect to the axis of rotation of the sheet roll. The drive roller causes the sheet roll to rotate in contact with the circumference of the roll at the upstream side in the intended sheet pay-out direction. An adhesive roller is positioned at a preselected center angle with respect to the axis of rotation of the sheet roll. The adhesive roller peels off the leading edge of the sheet from the roll in contact with the circumference of the roll at the downstream side in the intended sheet pay-out direction, while conveying the leading edge of the sheet. A peeling and guiding section peels off the leading edge of the sheet from said adhesive roller while guiding the leading edge to the downstream side in the intended sheet pay-out direction. A roller drive source causes at least one of the drive roller and adhesive roller to rotate.

Also, in accordance with the present invention, a device for making a master out of a stencil paid out from a stencil roll has a body. A stencil storing section stores the stencil such that the stencil can be paid out from the roll. A master making section selectively perforates the stencil paid out from the roll, thereby making a master. A cutting section cuts off the master from the stencil. A roll holding section is movable into and out of the body and holds the stencil roll. An automatic peeling device automatically peels off the leading edge of the stencil from the roll while conveying it. The automatic peeling device has a peeling member for contacting or adjoining the circumference of the stencil roll in accordance with the varying diameter of the stencil roll, thereby peeling off the leading edge of the stencil. A conveying member is located in close proximity to the peeling member and contacts the circumference of the stencil roll in accordance with the varying diameter of the roll, thereby conveying the leading edge of the stencil peeled off by said peeling means. A rotary drive source rotates the stencil roll. The rotary drive source is rotated in such a direction that the leading edge of the stencil is paid out from the roll toward the master making section.

Further, in accordance with the present invention, a device for a stencil printer and for making a master out of a stencil paid out from a stencil roll has a stencil storing section for storing the stencil such that the stencil can be paid out from the roll. A master making section selectively perforates the stencil paid out from the roll, thereby making a master. A cutting section cuts off the master from the stencil. A roll holding section holds the stencil roll. An automatic peeling device automatically peels off the leading edge of the stencil from the roll while conveying it. The automatic peeling device has a peeling member for contacting or adjoining the circumference of the roll in accordance with the varying diameter of the stencil roll, thereby peeling off the leading edge of the stencil. A conveying member is located in close proximity to the peeling member and contacts the circumference of the stencil roll in accordance with the varying diameter of the roll, thereby conveying the leading edge of the stencil peeled off by said peeling member. A rotary drive source rotates the stencil roll. The rotary drive source is rotated in such a direction that the leading edge of the stencil is paid out from the roll toward the master making section. The roll holding section and master making section are constructed into a master making unit movable into and out of the body of the stencil printer.

Furthermore, in accordance with the present invention, a device for making a master out of a stencil paid out from a stencil roll has a stencil storing section for storing the stencil such that the stencil can be paid out from the roll. A master making section selectively perforates the stencil paid out from the roll, thereby making a master. A cutting section cuts off the master from the stencil. An automatic peeling device automatically peels off the leading edge of the stencil from the roll while conveying it. The automatic peeling device has a drive roller positioned at a preselected center angle with respect to the axis of rotation of the stencil roll, causes the stencil roll to rotate in contact with the circumference of the roll at the upstream side in an intended stencil pay-out direction. An adhesive roller is positioned at a preselected center angle with respect to the axis of rotation of the roll, and peels off the leading edge of the stencil from the roll in contact with the circumference of the roll at the downstream side in the intended stencil pay-out direction, while conveying it. A peeling and guiding section peels the leading edge of the stencil from the adhesive roller while guiding it to the downstream side in the intended stencil pay-out direction. A roller drive source causes at least one of the drive roller and adhesive roller to rotate.

Moreover, in accordance with the present invention, a device for making a master out of a stencil paid out from a stencil roll has a body. A stencil storing section stores the stencil such that the stencil can be paid out from the roll. A master making device selectively perforates the stencil paid out from the roll, thereby making a master. A cutting section cuts off the master from the stencil. A roll holding section is movable into and out of the body and holds the roll. An automatic peeling device automatically peels off the leading edge of the stencil from the roll while conveying it. The automatic peeling device has a drive roller positioned at a preselected center angle with respect to the axis of rotation of the roll for causing the roll to rotate in contact with the circumference of the roll at the upstream side in the intended stencil pay-out direction. An adhesive roller is positioned at a preselected center angle with respect to the axis of rotation of the roll, and peels off the leading edge of the stencil from the roll in contact with the circumference of the roll at the downstream side in the intended stencil pay-out direction, while conveying it. A peeling and guiding section peels off the leading edge of the stencil from the adhesive roller while guiding the leading edge to the downstream side in the intended stencil pay-out direction. A roller drive source causes at least one of the drive roller and adhesive roller to rotate. The roller drive source rotates at least one of the drive roller and adhesive roller such that the leading edge of the stencil is paid out from the roll toward the master making section.

In addition, in accordance with the present invention, a device for a stencil printer and for making a master out of a stencil paid out from a stencil roll has a stencil storing section for storing the stencil such that the stencil can be paid out from the roll. A master making section selectively perforates the stencil paid out from the roll, thereby making a master. A cutting section cuts off the master from the stencil. A roll holding section holds the stencil roll. An automatic peeling device automatically peels off the leading edge of the stencil from the roll while conveying it. The automatic peeling device has a drive roller positioned at a preselected center angle with respect to the axis of rotation of the roll, and causes the roll to rotate in contact with the circumference of the roll at the upstream side in an intended stencil pay-out direction. An adhesive roller is positioned at a preselected center angle with respect to the axis of rotation of the roll, and peels off the leading edge of the stencil from the roll in contact with the circumference of the roll at the downstream side in the intended stencil pay-out direction, while conveying it. A peeling and guiding section peels off the leading edge of the stencil from the adhesive roller while guiding the leading edge to the downstream side in the intended stencil pay-out direction. A roller drive source causes at least one of the drive roller and adhesive roller to rotate. The roller drive source rotates at least one of the drive roller and adhesive roller such that the leading edge of the stencil is paid out from the roll toward the master making means. The roll holding section and master making section are constructed into a master making unit movable into and out of the body of the stencil printer.

BRIEF DESCRIPTION OF THE DRAWINGS

The above and other objects, features and advantages of the present invention will become apparent from the following detailed description taken with the accompanying drawings in which:

FIGS. 19 and 20 are flowcharts each demonstrating a specific operation of the embodiment;

In the figures, identical reference numerals designate identical structural elements.

DESCRIPTION OF THE PREFERRED EMBODIMENTS

Figure 37:
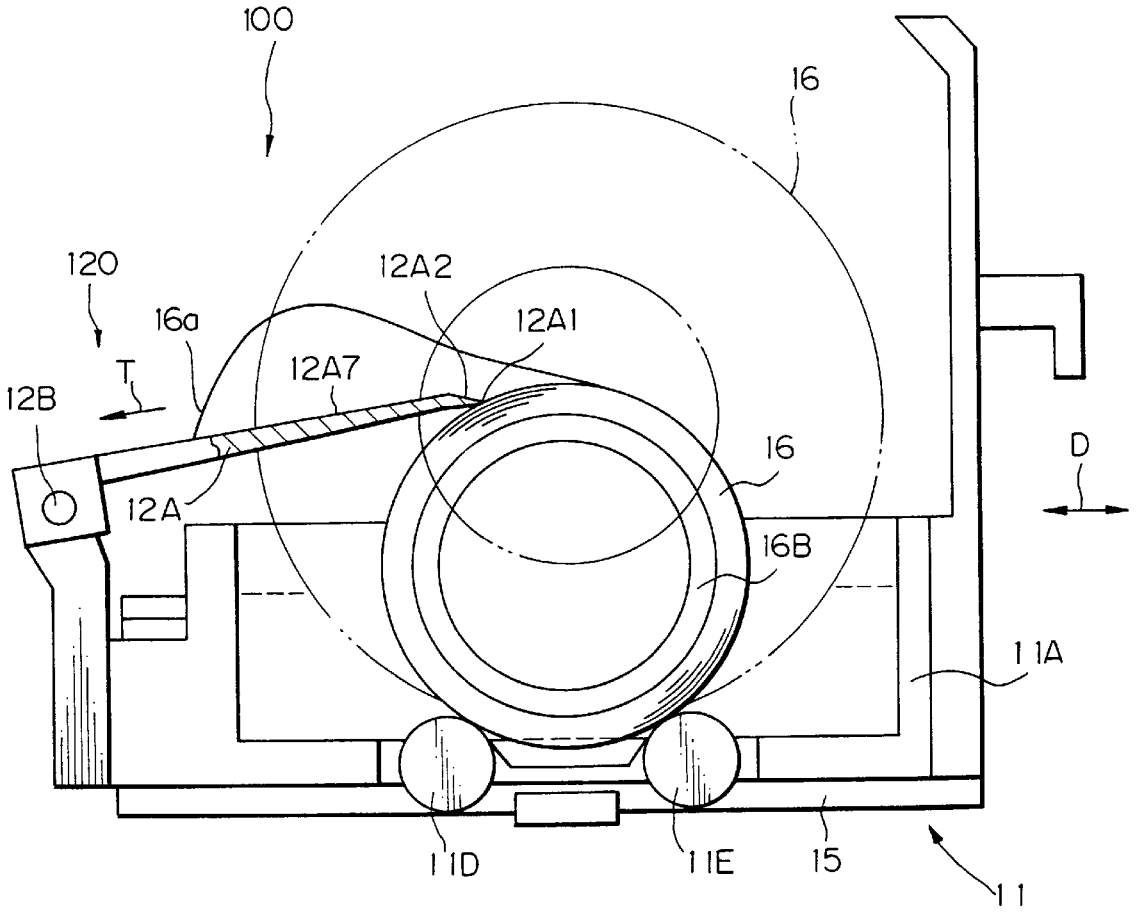
FIG. 37 is a fragmentary front view of a master making device and useful for understanding a problem to be solved by the invention.
Figure 38:
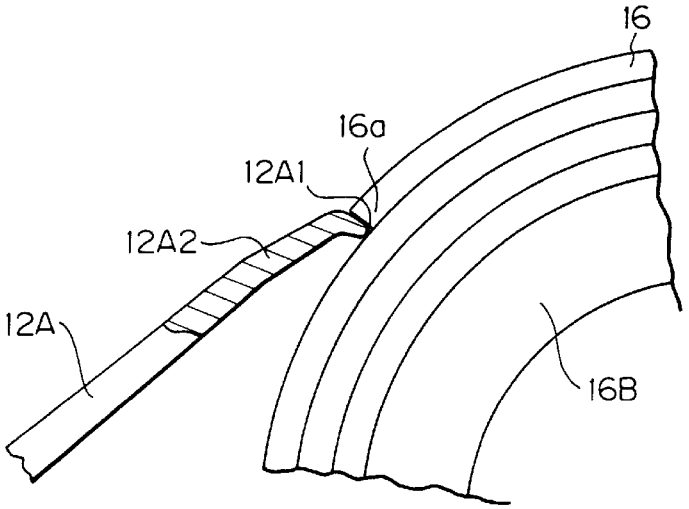
FIG. 38 is a fragmentary front view of the master making device of FIG. 37 and useful for understanding another problem to be solved by the invention.

To better understand the present invention, a brief reference will be made to a conventional master making device, shown in FIGS. 37 and 38 and taught in previously mentioned pending U.S. patent application Ser. No. 08/690,547. In FIG. 37, a thermal head and a platen roller included in the master making device are not shown although they are located at the left-hand side. As shown, the master making device, generally 100, has a roll holding section 11 including a roll holder 11A. The roll holder 11A is slidable along guide members 15 (only one is visible) in directions indicated by a double-headed arrow D in FIG. 37. A stencil 16*a* is implemented as a roll 16 having a core 16B. Stencil peeling means 120 includes a peeler 12A. When the roll holder 11A is inserted into the device 100, the peeler 12A is rotated about a shaft 12B due to its own weight until the free end of the peeler 12A abuts against the circumferential surface of the roll 16. The roll 16 is positioned on a pair of roll drive rollers 11D and 11E. When the drive rollers 11D and 11E are rotated by a motor, not shown, they rotate the roll 16 in the direction opposite to their direction of rotation. In this condition, the end of the peeler 12A contacts the leading edge of the stencil 16*a* and sequentially peels it off. The peeled edge of the stencil 16*a* is conveyed along the top 12A7 of the peeler 12A toward the downstream side with respect to a stencil pay-out direction T.

However, after the leading edge of the stencil 16*a* has been peeled off from the roll 16 by the peeler 12A, the stencil 16*a* is conveyed based only on its elasticity or bending rigidity. Therefore, particularly when the outside diameter of the roll 16 is reduced due to the consumption of the stencil 16*a*, the leading edge of the stencil 16*a* peeled off from the roll 16 has a noticeable curl and slackens. This brings about a jam or similar trouble and prevents the stencil 16*a* from being surely conveyed. Further, the peeler 12A is implemented as an elastic thin member formed of metal or resin and has a projection 12A1 almost as thin as the stencil. Such a projection 12A1 cannot maintain its configuration, e.g., it tends to curl after a long time of use. As a result, the peeler 12A fails to surely peel off the leading edge of the stencil 16*a* from the roll 16 in due course of time.

Preferred embodiments of the present invention will b e described with reference to the accompanying drawings. In the drawings, various component parts are selectively omitted for the sake of illustration. As for each pair of parts which do not need distinction, only one of them will be described, as the case may be. Regarding the description of the individual part and its position, the terms "front" and "rear" respectively refer to the downstream side and upstream side in a stencil transport direction or master pay-out direction. The right-hand side and left-hand side in the widthwise direction of a stencil, as seen in the stencil transport direction, will sometimes be respectively referred to as "right (rear in a direction perpendicular to the sheets surfaces of the drawings)" and "left (front as seen in the same direction)". In the embodiments and their modifications, identical parts and elements are designated by identical reference numerals and will not be repeatedly described in order to avoid redundancy.

First, a printer to which the present invention is applied will be described with reference to FIG. 1. The printer to be described is a stencil printer using a cut stencil or master and including a master making device implemented with an automatic stencil peeling device of the present invention. As shown, the stencil printer, generally 1, has a printing section including a print drum 2, a sheet feeding device 5, a master making device 10, a master discharging device 20, and a sheet discharging device. Among them, the master making device 10 is unique to the present invention. The other devices including the sheet feeding device 5 and master discharging device 20 are conventional.

The print drum 2 is reversibly rotatable about a shaft 2A. Specifically, the drum 2 is rotated clockwise in the event of printing, but counterclockwise in the event of the discharge of a used master. The drum 2 has a conventional structure and function for wrapping a cut or perforated stencil therearound. A number of pores are formed in the drum 2 except for a part thereof. A thin mesh screen, not shown, is provided on the outer periphery of the drum 2. The mesh screen may be implemented by synthetic fibers or metal, as desired.

A clamper 2D for clamping the leading edge of a master is mounted on the part of the drum 2 where the pores are not formed. The clamper 2D has a stage 2E and a clamp member 2F. The stage 2E has a master laying surface extending along one line parallel to the axis of the drum 2. The clamp member 2F is rotatable about a pivot shaft 2G toward and away from the stage 2E. The stage 2E is formed of a magnetic material while the clamp member 2F is implemented by a rubber magnet. After the leading edge of a master has been positioned on the stage 2E, the clamp member 2F is moved toward the stage 2E in order to clamp the master. The portion of the master following the leading edge adheres to the surface of the drum 2 due to the viscosity of ink fed to the surface of the drum 2 from an ink supply mechanism 3.

The ink supply mechanism 3 is disposed in the drum 2 and positioned substantially immediately below the shaft 2A. An ink roller 3A and a doctor roller 3B are the major components of the mechanism 3. The ink roller 3A is formed of metal and located to face a rotatable press roller 4, which will be described, with the intermediary of the drum 2. The ink roller 3A rotates in contact with the inner periphery of the drum 2 at a peripheral speed synchronous to the peripheral speed of the drum 2. Ink is deposited on the ink roller 3A in an amount regulated by the doctor roller 3B and fed to the pores of the drum 2 and mesh screen by the roller 3A. Specifically, ink is dropped from an opening 2C formed in the shaft 2A to a wedge-shaped space or ink well 3C formed by the rollers 3A and 3B. The ink roller 3A plays the role of a backup roller at the same time. When the press roller 4 is pressed against the drum 2, the backup roller 3A protects the drum 2 from deformation.

The press roller 4 is located below the ink roller 3A and faces it with the intermediary of the drum 2. The press roller 4 is rotatably supported by each of opposite free ends of a rotatable arm 4A and movable toward and away from the drum 2. The other free end of the arm 4A is held in pressing contact with the contour of a sector cam 4B. A drive section, not shown, causes the sector cam 4B to rotate in synchronism with the feed of a sheet S from the sheet feeding device 5. While the sheet S is not fed from the device 5, the drive section causes the cam 4B to face the end of the arm 4A at its larger diameter portion.

Figure 1:
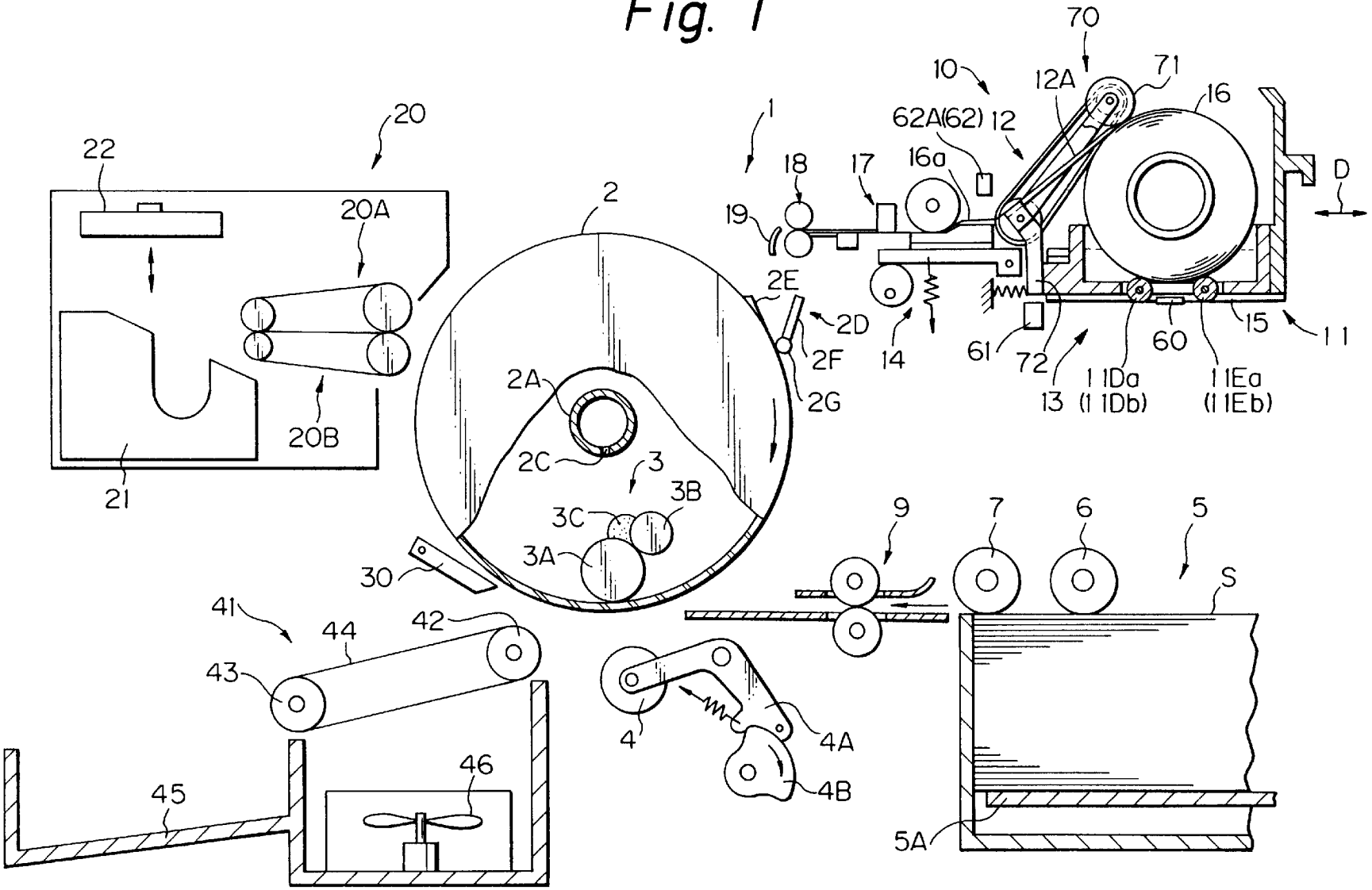
FIG. 1 shows the general construction of a stencil printer to which a first embodiment of the master making device in accordance with the present invention is applied.

Specifically, when the sheet S is fed from the sheet feeding device 5, the cam 4B rotates until its smaller diameter portion faces the end of the arm 4A, thereby causing the arm 4A to rotate clockwise, as viewed in FIG. 1. As a result, when the sheet S arrives at the gap between the drum 2 and the press roller 4, the roller 4 is raised and pressed against the outer periphery of the drum 2. As the sheet S is pressed against the drum 2 via the master, the ink is transferred to the sheet S via the perforations of the master. In this sense, the position where the press roller 4 is pressed against the drum 2 defines an image transfer position.

The sheet feeding device 5 is located at the right of the press roller 4, as viewed in FIG. 1. The device 5 has a pick-up roller 6, a separator roller 7 and a pair of registration rollers 9 sequentially arranged in an intended direction of sheet feed. Sheets S are stacked on a tray 5A. The pick-up roller 6 is movable into contact with the top sheet S of the stack relative to the sheet S. On contacting the top sheet S, the roller 6 drives it in the direction of paper feed indicated by an arrow in FIG. 1. The tray SA is elevatable to cause the sheet S t o contact the roller 6. When the tray 5A is to be replenished with sheets, it is lowered to form a replenishing space above it. The separator roller 7 is also rotatable in contact with the top sheet S. To allow only the top sheet S to be fed, the coefficient of friction between the separator roller 7 and the top sheet S is selected to be greater than the coefficient of friction between the sheets S. The registration rollers 9 face each other with the intermediary of a sheet feed path. These rollers 9 drive the sheet S toward the previously mentioned image transfer position at a predetermined timing.

Assume that the tray 5A is raised until the top sheet S contacts the pick-up roller 6. Then, the pick-up roller 6 is rotated in response to a signal output from a sensor, not shown. While the pick-up roller 6 feeds the sheet S toward the registration roller pair 9, the separator roller 7 separates the top sheet S from the underlying sheets. The sheet S is brought to a stop when its leading edge abuts against the roller pair 9. At the time when press roller 4 is pressed against the drum 2, the roller pair 9 again drives the sheet S toward the image transfer position, i.e., to between the drum 2 and the press roller 4 such that its print start position meets an image formed in the master. Then, a conventional printing operation is effected to form an image on the sheet S.

Figure 2:
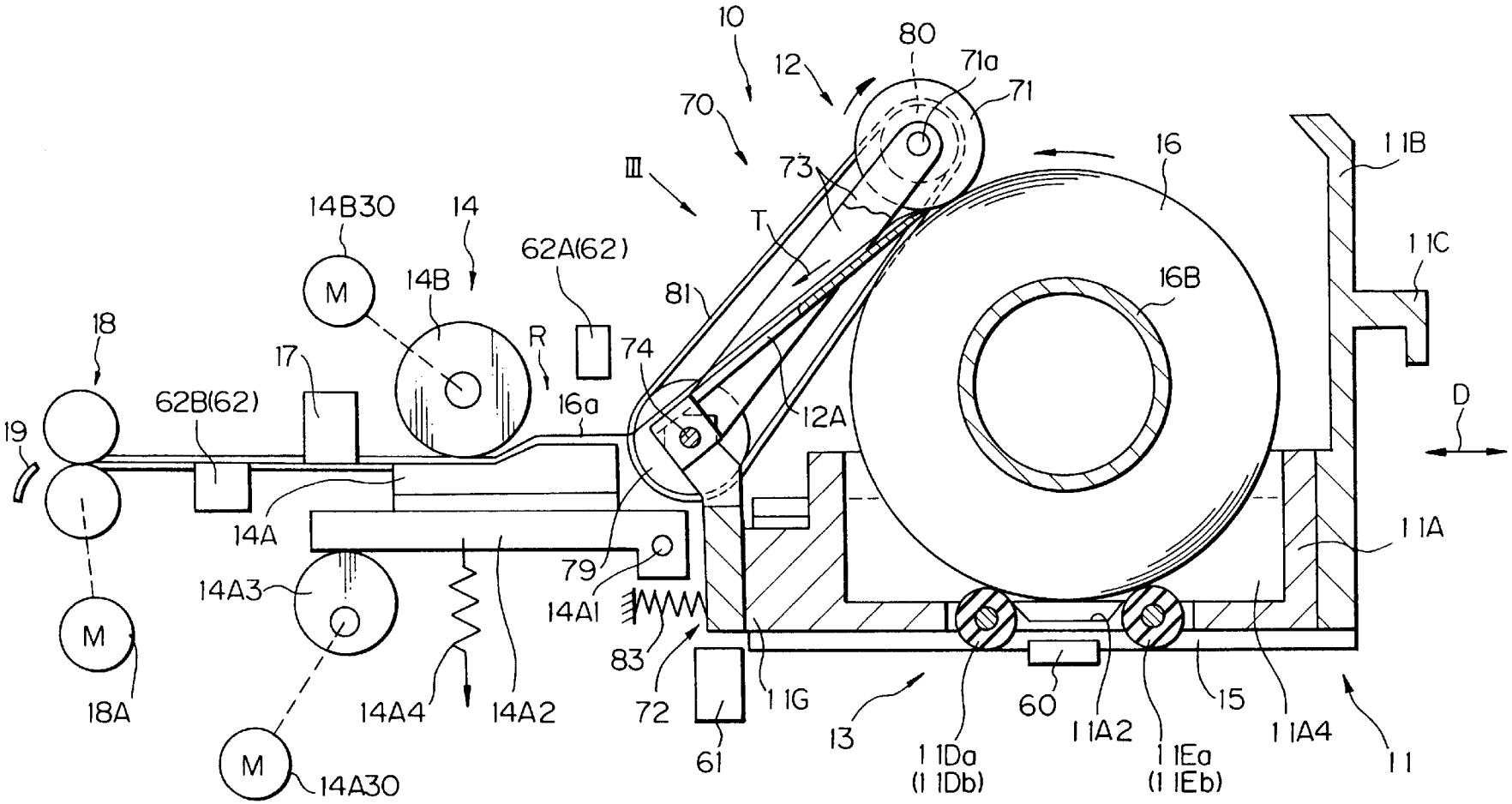
FIG. 2 is an enlarged front view of a part of the master making device shown in FIG. 1.

The master making device 10 embodying the present invention is located at the right of and above the drum 2. Let this embodiment be referred to as a first embodiment. The master making device 10 includes an automatic stencil peeling device in accordance with the present invention. As shown in FIG. 2, the master making device 10 has an automatic stencil peeling device 70, a platen pressure control device 14, and a cutting device 17. The peeling device 70 automatically peels off the leading edge of a stencil 16*a* from a stencil roll 16 and conveys it. The peeling device 70 has a roll holding section 11, a stencil peeling and guiding section 12, and a stencil roll driving section 13.

The roll holding section 11 has a stencil storing means movable into and out of the body of the device 10, as will b e described in detail later. The stencil storing means stores the roll 16 such that the stencil 16*a* can be paid out from the roll 16.

The stencil 16*a* has a laminate structure comprising a thermoplastic resin film permeable to light and as thin as 1 micron to 2 microns, and a porous substrate adhered to the resin film. The substrate is implemented by Japanese paper fibers or synthetic fibers or a combination thereof. The stencil 16*a* is cut or perforated by heat generated by a thermal head or similar heating device. Advantageously, the stencil 16*a* has a thickness between 3 microns and 60 microns.

Figure 4:
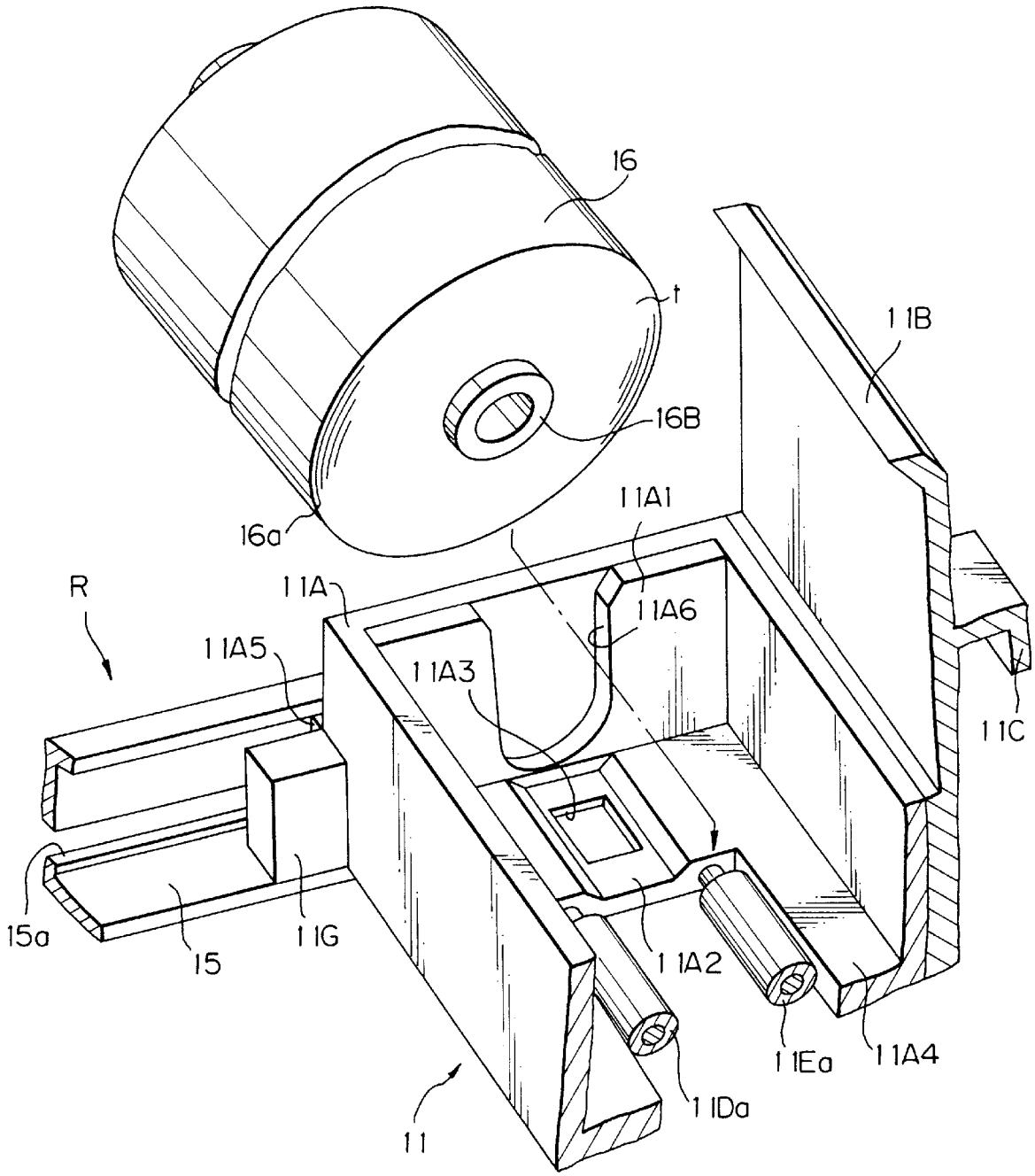
FIG. 4 is a fragmentary perspective view of a stencil roll holding section shown in FIG. 2 and its neighborhood.

As shown in FIG. 4, the stencil 16*a* is wound round a tubular core 16B. The core 16B has a length greater than the width of the stencil 16*a* and protrudes from the axially opposite end t of the roll 16. In this sense, the roll 16 has a conventional structure.

Figure 11:
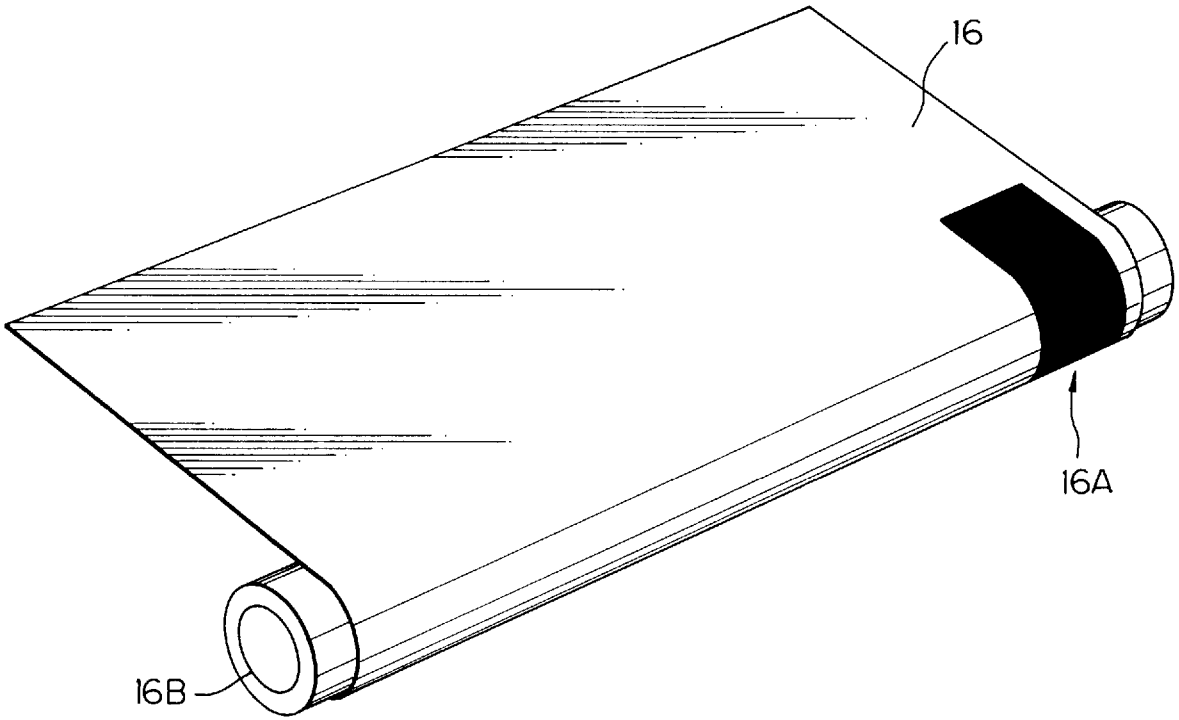
FIG. 11 is a perspective view showing a specific configuration of a stencil roll applicable to the embodiment.

As shown in FIG. 11, the roll 16 includes a low reflectance portion 16A extending from its preselected limit diameter position which is the end of the usable length to the end in the direction of winding. To form such a portion 16A, the roll 16 may be painted black by way of example. The roll 16 is put in a cavity 11A4 formed in a roll holder 11A such that the leading edge of the stencil 16*a* can be paid out toward the drum 2.

A pair of guide members 15 are positioned in the device 10, and each is channel-shaped as viewed in a section, as best shown in FIG. 4. The guide members or channels 15 extend over a preselected length in an intended direction of stencil transport at both sides of a stencil transport path R with their open ends facing each other. The guide members 15 are respectively affixed to a right and a left side wall, not shown, included in the device 10. The right guide member, or rear guide member in the direction perpendicular to the sheet surface of FIG. 1, is formed with an elongate slot 15*a* in its lower portion. The slot 15*a* extends over the range in which the roll holding section 11 is movable. Drive rollers 11Da, 11Db, 11Ea and 11Eb which will be described have shafts protruding to the right-hand side of the device 10 through the slot 15*a*.

The roll holding section 11 has a pair of friction members 11A1, a closure member 11B, a handle 11C, presser portions 11G and projections 11A5 in addition to the roll holder 11A, cavity 11A4, and drive rollers 11Da, 11Db, 11Ea and 11Eb. The stencil storing means having the previously stated structure and function is implemented by the friction members 11A1 and drive rollers 11Da, 11Db, 11Ea and 11Eb. The roll holder 11A, closure member 11B, handle 11C, presser portions 11G and projections 11A5 are formed of, e.g., synthetic resin integrally with each other and suitably reinforced by the insertion of sheet metal. The roll holder 11A is a box having openings at its top and bottom and allows the roll 16 to be loaded therein. The cavity 11A4 of the roll holder 11A is capable of receiving a part of the lower half of the roll 16.

Figure 5:
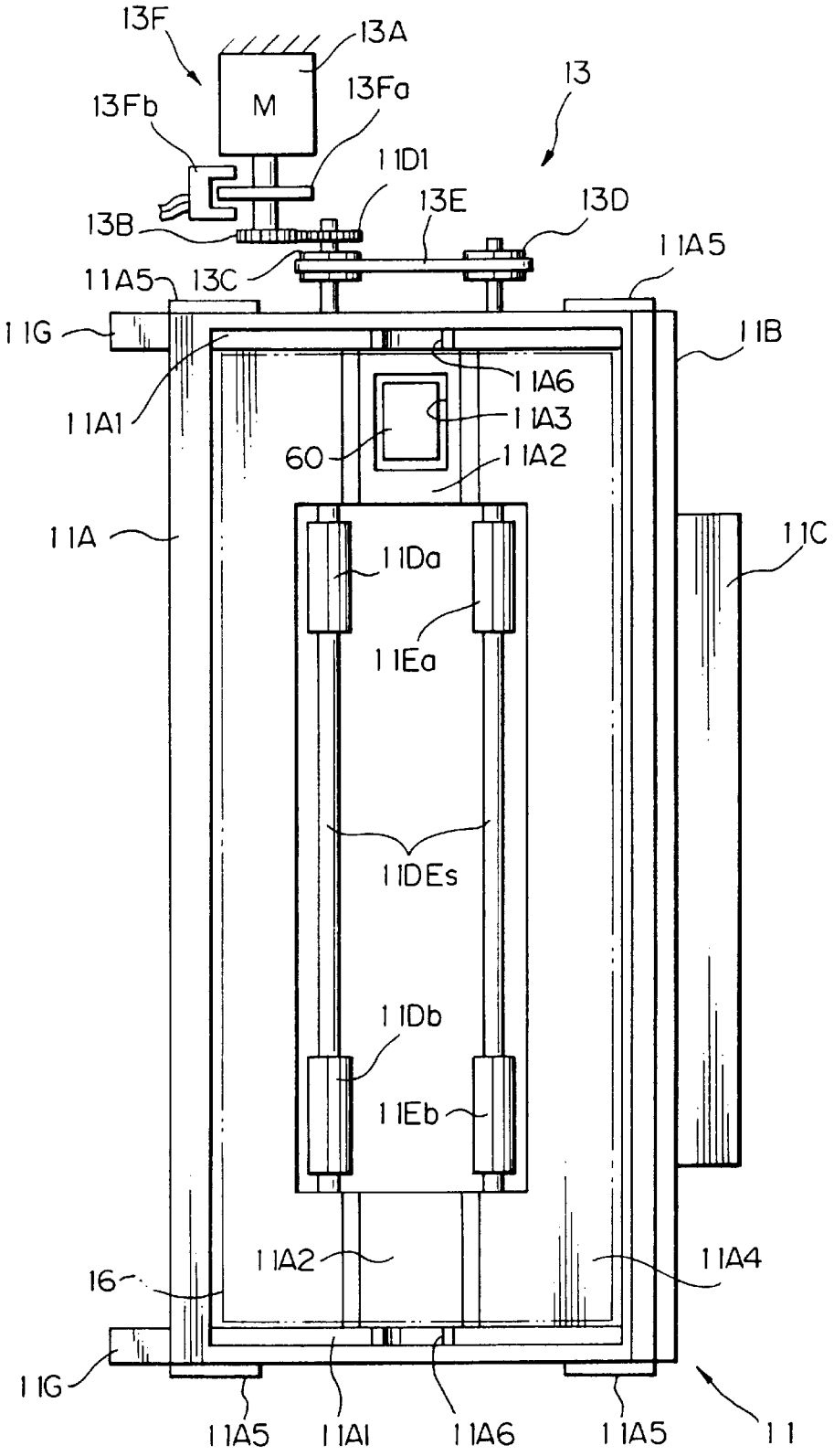
FIG. 5 is a fragmentary plan view of the stencil roll holding section and a roll drive section also shown in FIG. 2.

As shown in FIGS. 4 and 5, the right and left side walls of the roll holder 11A are each formed with the projections 11A5 having a rectangular section and received in the open end of the respective guide member or channel 15. Specifically, two projections 11A5 are formed on each side wall of the roll holder 11A. The two projections 11A5 of each side wall are received in the respective guide member 15 and smoothly slidable therein, so that the roll holder 11A is movable over a predetermined range between the upstream side and the downstream side of the master transport path R. Stated another way, the roll holding section 11 is slidable between an operative position for allowing the stencil 16*a* to be paid out from the roll 16 and an inoperative position for allowing the roll 16 to be loaded in the holding section 11 by hand. The inoperative position includes a position where the holding section 11 is pulled out of the device 10.

The friction members 11A1 are respectively provided on the inner surfaces of the roll holder 11A facing each other in the direction perpendicular to a stencil pay-out direction T identical with the direction of stencil transport. When the roll 16 is loaded in the roll holder 11A, the friction members 11A1 face and contact the opposite ends t of the roll 16. The friction members 11A1 may be formed of rubber or sponge rubber by way of example.

As shown in FIGS. 4 and 5, the friction members 11A1 are each formed with a generally U-shaped notch 11A6 at its center in the front-and-rear direction. The protruding ends of the core 16B are respectively received in the notches 11A6 of the friction members 11A1. The notches 11A6 are each open at the top of the respective friction member 11A1 and sequentially reduced in width toward the bottom. The bottom of each notch 11A6 has a width substantially identical with the outside diameter of the core 16B. The bottoms of the notches 11A6 are positioned such that the drive rollers 11Da, 11Db, 11Ea and 11Eb contact the circumference of the roll 16 at even positions with respect to the axis of the roll 16.

Figure 6:
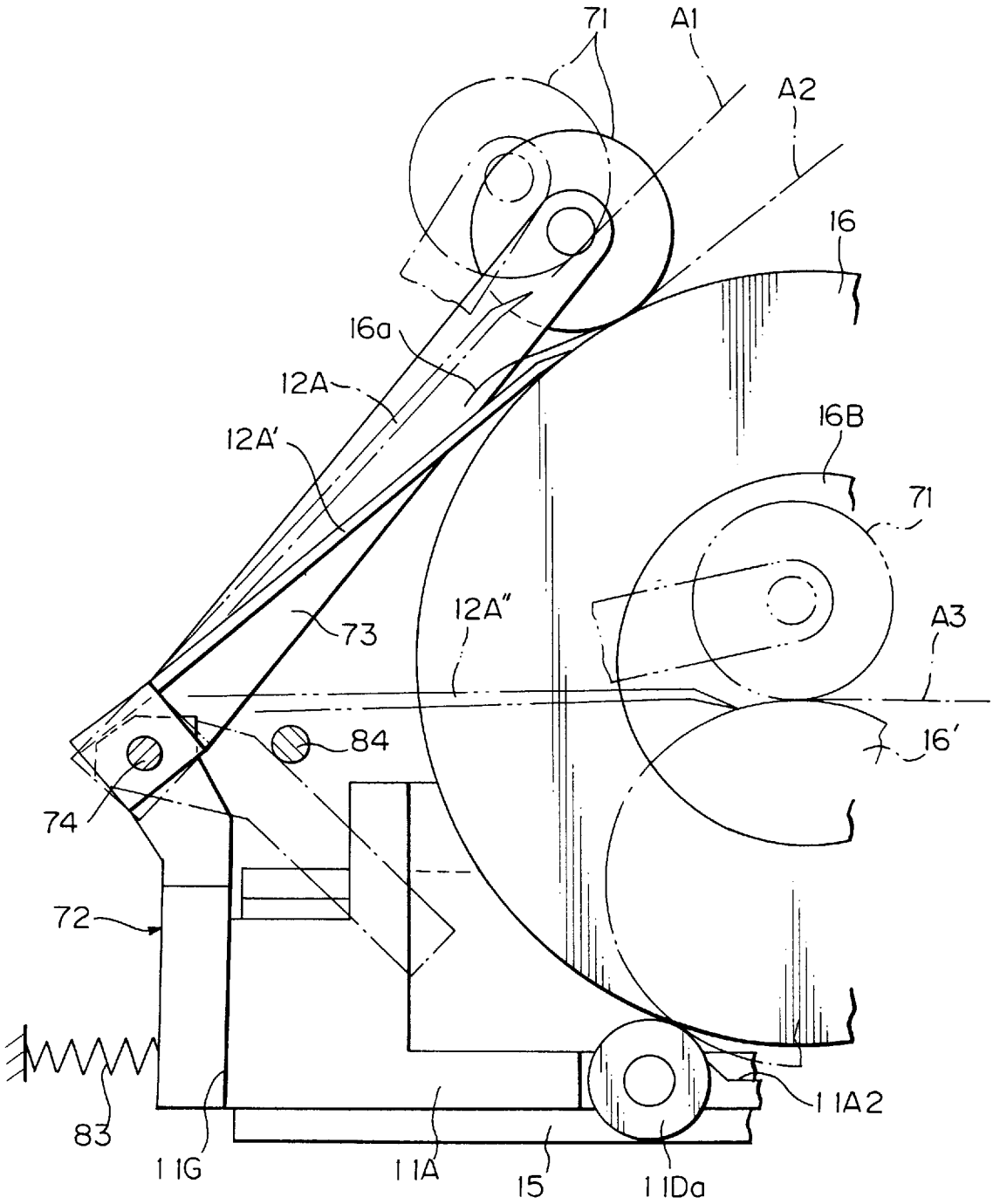
FIG. 6 demonstrates the operation of a stencil peeling and guiding section also shown in FIG. 2.

The bottom wall of the roll holder 11A is formed with a window 11A3 in the vicinity of the right guide member 15. When the roll holder 11A is pushed into the device 10 as far as the previously mentioned operative position, stencil sensing means 60 which will be described faces the window 11A3. Recesses 11A2 are formed in the bottom wall of the roll holder 11A around the window 11A3 and around a portion opposite to the window 11A3. As the stencil 16*a* is sequentially paid out from the roll 16, the diameter of the roll 16 sequentially decreases. As shown in FIG. 6, when the roll 16 changes into a roll 16' with a diameter substantially equal to the outside diameter of the core 16B, the recesses 11A2 serve to prevent the bottom wall from interfering with the roll 16'.

The closure member 11B is positioned at the rear portion of the roll holder 11A and forms a part of an end wall. The handle 11C is positioned on the rear or outer surface of the closure member 11B. By holding the handle 11C, the operator may move the roll holder 11A in opposite directions, as indicated by an arrow D. Specifically, the operator may pull the roll holder 11A to the right, as viewed in FIG. 2, out of the device 10 in order to load it with the roll 16, and then push the holder 11A into the device 10 in the opposite direction. The presser portions 11G are positioned at the right and left edges of the end wall of the roll holder 11A opposite to the closure member 11B. The presser portions 11G are selectively engageable with a peeler support member 72 which will be described.

The detailed configurations of the roll holder 11A, friction members 11A1 and so forth are not shown in the figures. Of course, the portions of such members which are likely to contact the stencil 16*a* when the roll 16 is loaded in the cavity 11A4 are rounded, tapered or otherwise machined so as not to damage the stencil 16*a*.

As shown in FIGS. 4 and 5, the drive rollers 11Da, 11Db, 11Ea and 11Eb are so positioned as to contact the circumference of the roll 16 when the roll 16 is loaded in the cavity 11A4. The drive rollers 11Da–11Eb constitute the stencil storing means, as stated earlier. At the same time, the rollers 11Da–11Eb play the role of rotary drive means for causing the roll 16 to rotate in the direction for paying out the leading edge of the stencil 16*a* toward a master making means.

The drive rollers or roller elements 11Da and 11Db are mounted on a single shaft 11DEs and spaced from each other in the axial direction of the shaft 11DEs. This is also true with the drive rollers or roller elements 11Ea and 11Eb. The shaft 11DEs of the drive rollers 11Da and 11Db and that of the drive rollers 11Ea and 11Eb are journalled to the bottom wall portion of the roll holder 11A. A motor 13A, FIG. 5, constituting the stencil drive section 13 rotates the drive rollers 11Da–11Eb in the direction for paying out the leading edge of the stencil 16*a*.

The drive rollers 11Da–11Eb are each formed of rubber, sponge or similar elastic material having a coefficient of friction lying in an adequate range which allows them to rotate the roll 16. In this condition, the leading edge of the stencil 16*a* paid out from the roll 16 does not contact the entire drive rollers in the axial direction of the drive rollers, but contacts them only locally. Particularly, in this embodiment, the drive rollers 11Da–11Eb are not arranged in the axially intermediate portion, but arranged in the opposite end portions. In addition, the drive rollers 11Da–11Eb have their axial length reduced as far as possible.

The drive rollers 11Da and 11Db and the drive rollers 11Ea and 11Eb are arranged at a preselected center angle with respect to the axis of rotation of the roll 16. Specifically, the drive rollers 11Da and 11Db and the drive rollers 11Ea and 11Eb are positioned such that when the core 16B of the roll 16 falls to its lowermost position due to the full consumption of the stencil 16*a*, the circumference of the roll 16 contacts the two groups of drive rollers at even positions with respect to the axis of the roll 16. When only the core 16B of the roll 16 is left, the drive rollers 11Da–11Eb held in the above relationship support the core 16B while allowing it to rotate.

The circumference of the roll 16 contacts the drive rollers 11Da–11Eb in the vicinity of the opposite ends t thereof in the axial direction of the shafts 11DEs. Therefore, the displacement of the roll 16 from the drive rollers 11Da–11Eb in the axial direction can be easily corrected. Further, assume that the leading edge of the stencil 16*a* is not peeled off from the roll 16 by the peeler 12A and is caused to rotate together with the roll 16. Then, if the roll 16 contacts the drive rollers over the entire axial dimension, then it is likely that the leading edge of the stencil 16*a* is turned over and bent. In the first embodiment, because the roller elements 11Da and 11Db and the roller elements 11Ea and 11Eb are individually spaced from each other in the axial direction, the leading edge of the stencil 16*a* can enter the clearance between them. Hence, even if the leading edge of the stencil 16*a* is bent, it can again rise in the above clearance. This successfully straightens the leading edge of the stencil 16*a* and thereby obviates jams ascribable to the stencil 16*a*. In addition, the inertia of the drive rollers 11Da–11Eb and therefore the resistance to the rotation is reduced.

In the illustrative embodiment, the roll holder 11A has the opening in its bottom. The drive rollers 11Da–11Eb and their shafts 11DEs are exposed in the above opening. Such a configuration does not increase the cost because the roller holder 11 A can be simply implemented by punching or as a single molding of resin. However, it is likely that dust enters the roll holder 11A via the opening in the vicinity of the operative position of the holder 11A and contaminates the surface of the roll 16. In light of this, a cover may be provided on the roll holder 11A to close the opening, while allowing only the drive rollers 11Da–11Eb to be exposed.

In the above construction, the roll 16 is put in the cavity 11A4 of the roll holder 11A with the opposite protruding ends of the core 16B received in the notches 11A6. In this condition, the leading edge of the stencil 16*a* can be paid out from the roll 16 toward and from above the drum 2. At this instant, the protruding ends of the core 16B are guided downward by the notches 11A6 while the opposite ends t of the roll 16 are positioned by the friction members 11A1. At the same time, the drive rollers 11Da and 11Db and the drive rollers 11Ea and 11Eb evenly contact the circumference of the roll 16. As the diameter of the roll 16 sequentially decreases due to the consumption of the stencil 16*a*, the protruding ends of the core 16B are surely guided from the top to the bottom of each notch 11A6 without any jitter, due to the weight of the roll 16 as well as the weight of a pay-out roller or conveying means 71 which will be described. The roll 16 contacting the drive rollers 11Da–11Eb abuts against the friction members 11A1 at its opposite ends t. Therefore, when the drive rollers 11Da–11Eb are rotated to pay out the stencil 16*a*, friction occurs between the ends t of the roll 16 and the friction members 11A1. As a result, tension is generated in the stencil 16*a* being paid out from the roll 16.

The operator can easily load the roll holder 11A with a new stencil roll. Only if the operator puts a new stencil roll in the roll holder 11A, the circumference of the roll is automatically positioned on the drive rollers 11Da–11Eb. This frees the operator from a special setting operation. The friction members 11A1 are omissible if the inner walls of the roller holder 11A are formed with the notches 11A6 and if they are capable of contacting the ends t of the roll 16. This will also successfully apply tension to the stencil 16*a* being paid out from the roll 16.

When the friction members 11A1 are omitted, it may be necessary to extend the core 16B in the axial direction or to increase the thickness of the walls of the roll holder 11A. This kind of structural limitation should preferably be eliminated. For example, assume that a clearance exists between each end t of the roll 16 and the adjoining inner surface of the roll holder 11A. Then, a leaf spring, compression spring, sponge rubber or similar thin resilient or elastic member capable of contacting the end t of the roll 16 without regard to the outside diameter of the roll 16 may be positioned in the vicinity of the inner surface of the roll holder 11A. The resilient or elastic member also exerts friction on the roll 16.

Figure 36:
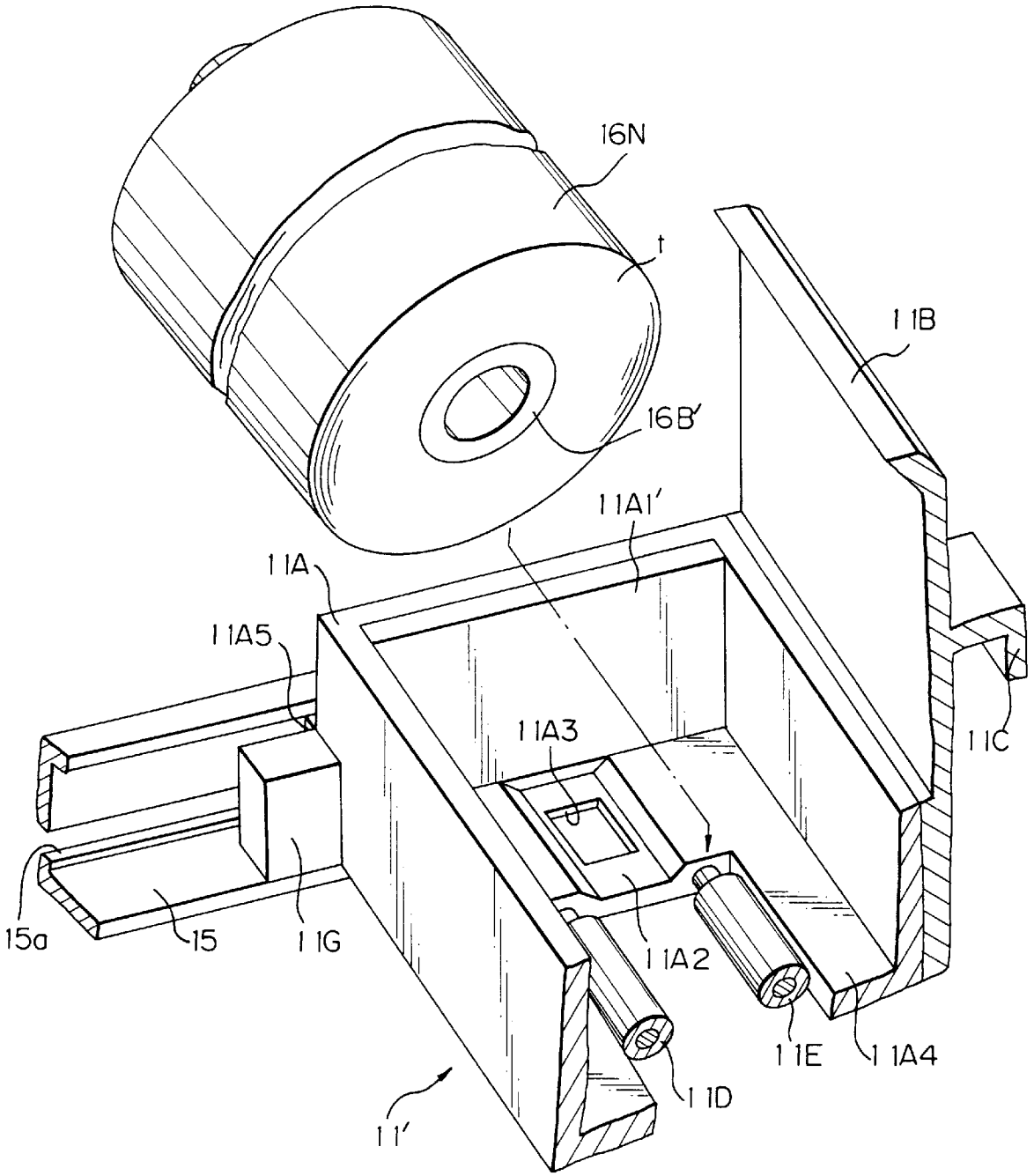
FIG. 36 is a fragmentary perspective view showing a modified form of the roll holding section included in the first embodiment.

As shown in FIG. 36, a stencil roll 16N may be substituted for the stencil roll 16. As shown, the stencil roll or sheet roll 16N has a core 16B' whose opposite ends do not protrude from the axially opposite ends t of the roll 16N. That is, each end of the core 16B' is flush with the corresponding end of the roll 16N. For the stencil roll 16N, use may be made of a roll holding section 11' shown in FIG. 36. As shown, in the roll holding section 11', the roll holder 11A is void of the notches 11A6. The roll holding section 11' is different from the roll holding section 11 in that frictional members 11A1' are substituted for the friction members 11A1, and in that drive rollers 11D and 11E are substituted for the drive rollers 11Da–11Eb.

When the stencil 16*a* is paid out from the roll 16N, the friction members 11A1' contacting the roll 16N position it in the widthwise direction of the stencil 16*a*. At the same time, the friction members 11A1' generate resistance due to friction opposite in direction to the pay-out of the stencil 16*a*. As a result, back-tension acts on the stencil 16*a* being paid out from the roll 16N and thereby prevents the stencil 16*a* from slackening.

The drive rollers 11D and 11E are simply elongate in their axial direction. As shown in FIG. 36, when the roll 16N and roll holding section 11' are used in combination, the roll 16N introduced in the cavity 11A4 of the roll holder 11A has its axially opposite ends t positioned by the friction members 11A1' void of the notches 11A6. This eliminates the need for positioning using a core and thereby saves the material for forming the core. Consequently, the material cost of the roll 16N is reduced.

Further, use is made of a stencil roll having a protruding core 16B at one end, as in the above embodiment, and a core 16B' shown in FIG. 36 at the other end. In such a case, use is made of a roll holding section implemented by the friction member 11A1 at one end and by the friction member 11A1', FIG. 36, at the other end.

The stencil drive section 13 causes the roll 16 to rotate via the drive rollers 11Da–11Eb. The drive section 13 has a drive gear 13B, a driven gear 11D1, pulleys 13C and 13D, a belt 13E and a roll rotation sensing means 13F in addition to the drive rollers 11Da–11Eb and motor 13A. As shown in FIG. 5, the motor 13A is mounted on the right side wall of the device 10 adjoining the operative position of the roll holding section 11. The gear 13B is mounted on the output shaft of the motor 13A. When the stencil 16*a* is to be paid out from the roll 16 set in the roll holder 11A, the motor 13A is rotated in the direction opposite to the stencil pay-out direction T for a moment and then rotated in the direction T, as will be described specifically later.

The roll rotation sensing means 13F is implemented as a rotary encoder consisting of a slit disk 13Fa mounted on the output shaft of the motor 13A, and a photointerrupter 13Fb made up of a light emitting element and a light-sensitive element, not shown. The light emitting element and light-sensitive element face each other with the intermediary of the disk 13Fa. The sensing means 13F senses the amount of rotation of the roll 16 caused by the motor 13A in the stencil pay-out direction T.

The motor 13A is so controlled as to rotate the roll 16 substantially within a preselected range of peripheral speeds via the drive rollers 11Da–11Eb. The pulleys 13C and 13D are respectively affixed to the shafts 11DEs of the drive rollers 11Da–11Eb while the belt 13E is passed over the pulleys 13C and 13D. The driven gear 11D1 is mounted on the shaft 11DEs of the rollers 11Da and 11Db and brought into mesh with the drive gear 13B when the roll holder 11A is inserted into the device 10 as far as the operative position. The output torque of the motor 13A is transmitted to the pulley 13D via the drive gear 13B, driven gear 11D1, pulley 13C, and belt 13E. As a result, the drive rollers 11Da and 11Db and the drive rollers 11Ea and 11Eb are caused to rotate in the same direction.

As shown in FIG. 2, the stencil peeling and guiding section 12 is located at a position corresponding to the operative position of the roll holder 11A. This section 12 mainly consists of the previously mentioned peeler 12A having a pallet-like configuration and pay-out roller 71 and pay-out roller drive means 75. The peeler 12A peels the leading edge of the stencil 16*a* from the roll 16. The pay-out roller or conveying means 71 is located in the vicinity of the peeler 12A and contacts the circumference of the roll 16 in accordance with the varying diameter of the roll 16. The pay-out roller 71 has a coefficient of friction necessary for conveying the leading edge of the stencil 16*a*. The pay-out roller or conveyor roller drive means 75 causes the pay-out roller 71 to rotate.

As shown in FIG. 6, the peeler 12A is angularly movable between a contact position (solid line and dash-and-dots line) where its free end contacts the roll 16 and a non-contact position (dash-and-dot line) where the free end is spaced from the roll 16. The peeler 12A is movably supported by the peeler support member 72, a compression spring 83 and the presser portions 11G via a shaft 74, as will be described.

Figure 7:
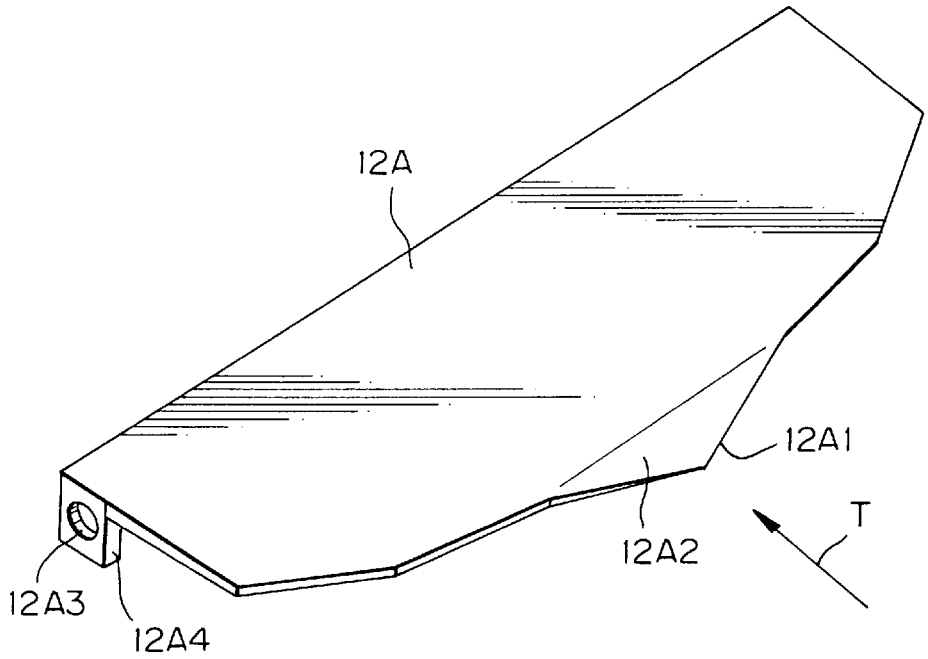
FIG. 7 is a perspective view showing a specific configuration of a peeler included in the embodiment.
Figure 8:
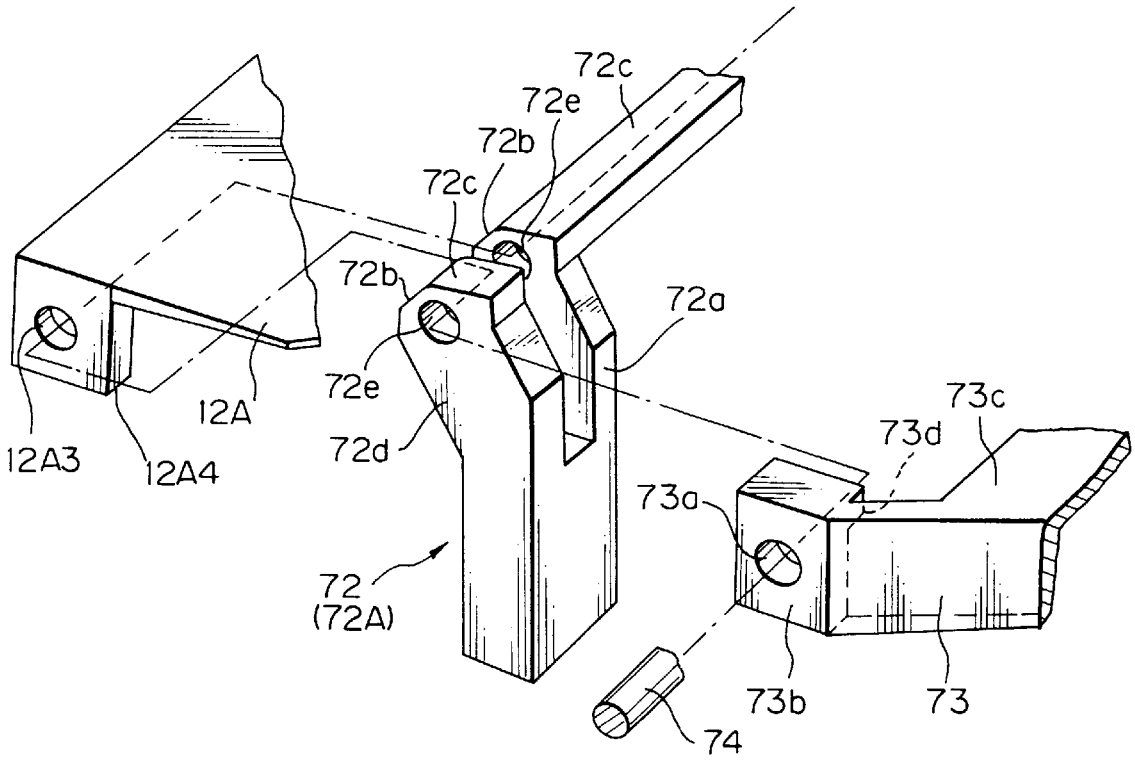
FIG. 8 is a fragmentary exploded perspective view of the peeling and guiding section shown in FIG. 6.
Figure 9:
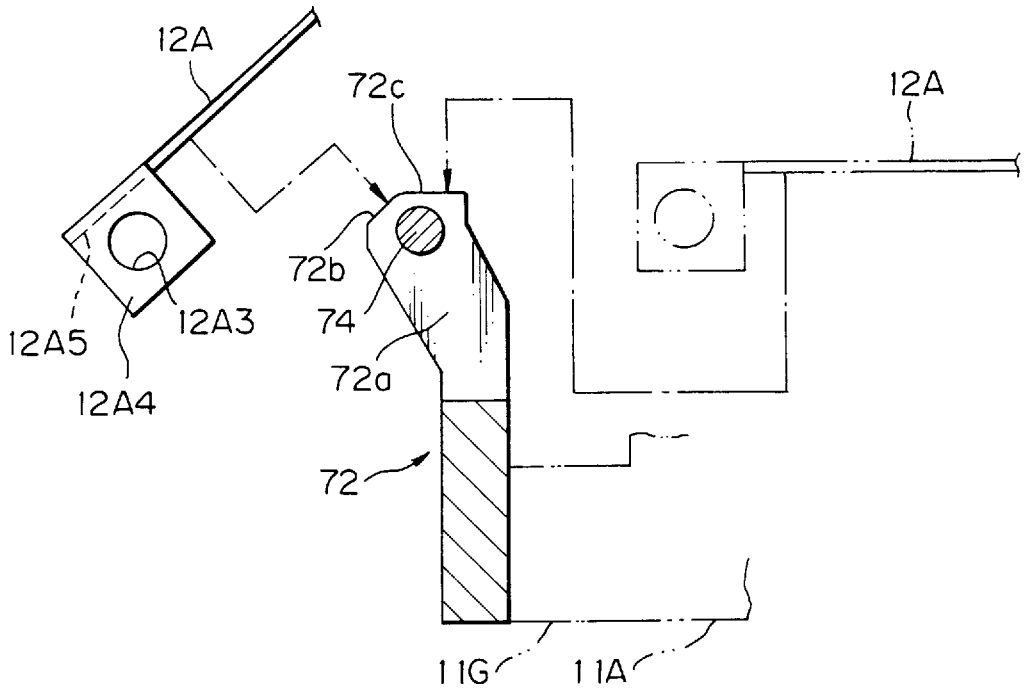
FIG. 9 is a front view showing how the peeler of FIG. 7 and the peeling and guiding section are assembled.

As shown in FIGS. 7–9, the peeler 12A is formed with bearing portions 12A4 at its right and left ends. The bearing portions 12A4 each has a hole 12A3. The shaft 74 is passed through the holes 12A3 for allowing the peeler 12A to angularly move in the above-mentioned manner. As shown in FIG. 9, the bearing portion 12A4 has on its rear a receiving surface 12A5 contacting the support surfaces of a peeler support portion 72*a* included in the support member 72. The opposite base ends of the support member 72 are each formed with a hole 72*e* for rotatably supporting the support member 72 via the shaft 74. The support member 72 is bifurcated in order to form the peeler support portion 72*a* and an arm support portion 72*d* at its inner ends and outer ends, respectively.

Figure 3:
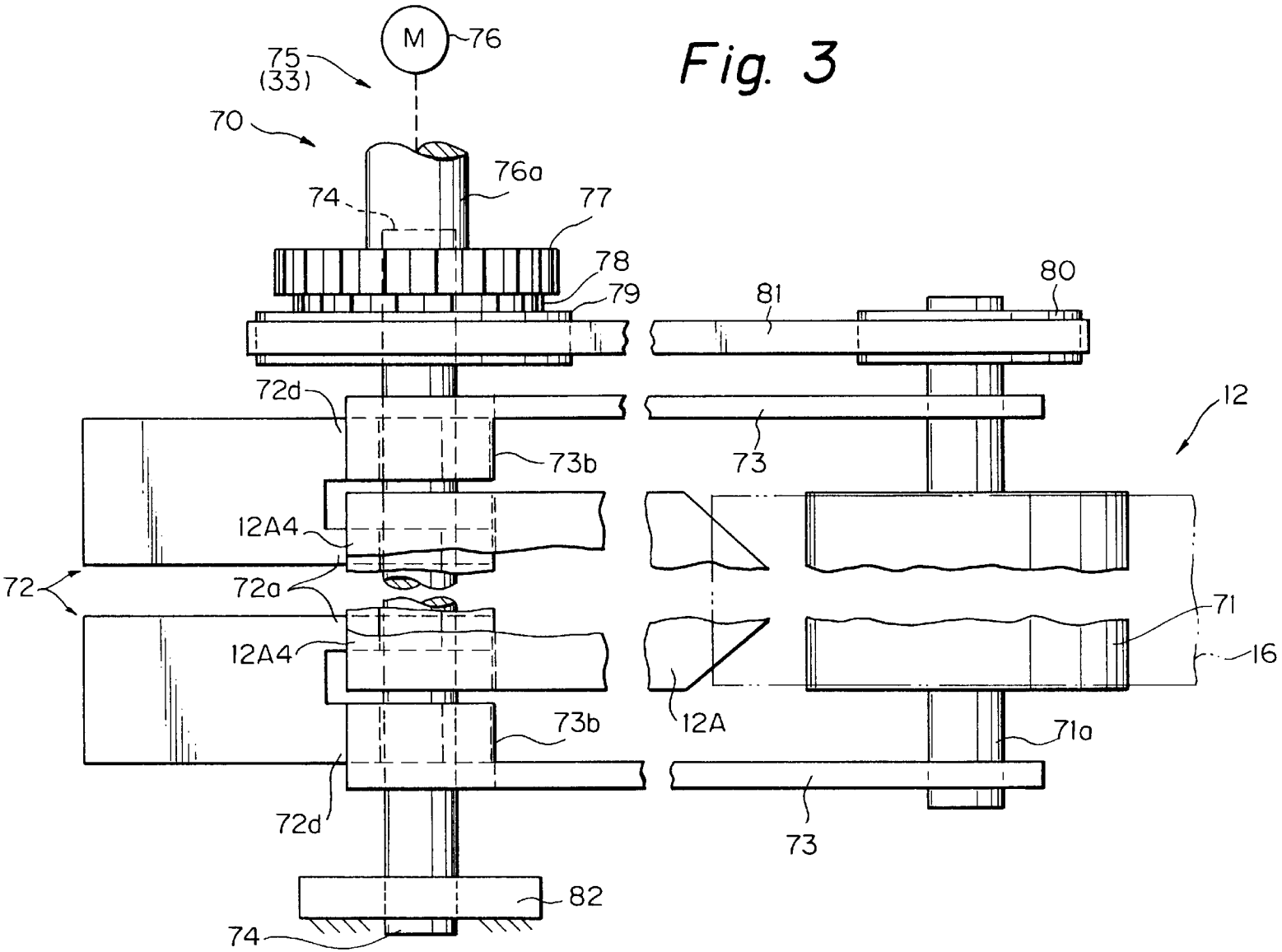
FIG. 3 is a fragmentary plan view of an automatic stencil peeling device included in the embodiment and as viewed in a direction III of FIG. 2.

As shown in FIGS. 2, 3, 6 and 8–10, the peeler 12A and peeler support members 72 have their base ends supported by the common shaft 74. The shaft 74 is fixedly supported by bearing members 82 (only one is shown in FIG. 3) respectively affixed to the right and left side walls of the device 10.

The peeler 12A is implemented as a thin elastic member except for the base end including the bearing portions 12A4.

The peeler 12A is formed of metal, resin or similar elastic material. The elasticity of the peeler 12A is preselected such that when the free end of the peeler 12A contacts the circumference of the roll 16, it does not damage the stencil 16*a*. That is, when the free end of the peeler 12A contacts the roll 16, it elastically deforms so as not to exert an unusual load on the stencil 16*a*.

As shown in FIG. 7, the peeler 12A has a projection 12A1 at its intermediate portion in the widthwise direction of the roll 16. The projection 12A1 extends from the opposite sides of the peeler 12A in the widthwise direction of the roll 16 to the upstream side in the stencil pay-out direction T. As shown in FIGS. 6 and 7, the projection 12A1 forms an inclined portion 12A2 inclined toward the circumference of the roll 16. The inclined portion 12A2 is capable of contacting or adjoining the circumference of the roll 16 due to the weight of the peeler 12A. Specifically, as seen in a plan view, the peeler 12A is sequentially flared from the upstream side to the downstream side in the stencil pay-out direction T. With this configuration, the peeler 12A first peels off the intermediate portion of the leading edge of the stencil 16*a* in the widthwise direction of the stencil 16*a*, and then sequentially peels off the other portion of the leading edge up to the opposite side edges while guiding the peeled portion.

The projection 12A1 is formed as thin as possible in relation to the stencil 16*a*, preferably 3 microns to 50 microns. In the above condition, when the free end of the peeler 12A contacts or adjoins the circumference of the roll 16, it sequentially peels off the stencil 16*a* from the center toward the opposite side edges in the widthwise direction of the roll 16. This successfully reduces the resistance acting on the stencil 16*a* and thereby surely separates the stencil 16*a* from the roll 16. In addition, because the free end of the peeler 12A is inclined toward the roll 16, only the inclined portion 12A2 faces the roll 16 and faces the inner surface of the leading edge of the stencil 16*a* separated from the roll 16. This reduces the area over which the peeler 12A contacts the roll 16 and thereby reduces the resistance acting on the stencil 16*a*, while easily turning up the leading edge of the stencil 16*a* away from the roll 16.

The compression spring 83 is anchored at one end to the free end of the support member 72 and at the other end to a stationary member included in the device body. The peeler 12A is therefore usually biased away from the circumference of the roll 16. A stop 84 shown only in FIG. 6 is affixed to the right side wall above the guide member 15. When the peeler support member 72 is rotated toward the roll 16 due to the bias of the spring 83, the stop 84 stops the peeler support member 72 at such a position that the support member 72 can be pressed by the presser portions 11G of the roll holder 11A brought to its operative position.

The stencil peeling and guiding section 12 having the above configuration is operated as follows. When the roll holder 11A is inserted into the device 10 as far as its operative position, the presser portions 11G press the lower ends of the support member 72. As a result, the support member 72 moves the peeler 12A toward the circumference of the roll 16 against the action of the spring 83. At this instant, if the free end of the peeler 12A contacts the circumference of the roll 16, then it is apt to damage the surface of the stencil 16*a*. In light of this, if the stencil 16*a* is of the kind elastic enough for its leading edge to rise by itself, then the peeler 12A may adjoin the circumference of the roll 16 at a distance which allows it to turn up the leading edge of the stencil 16*a*.

Assume that the free end of the peeler 12A adjoins the circumference of the roll 16 at a certain distance, as stated above. Then, it is possible to maintain such a distance by, e.g., sensing the varying outside diameter of the roll 16 with sensing means, which will be described, and shifting the free end of the peeler 12A in response to the output of the sensing means. On the other hand, assume that the stencil 16*a* is of the kind not elastic enough for its leading edge to rise by itself. Then, the free end of the peeler 12A should preferably contact the surface of the stencil 16*a* under low pressure. This is why the free end of the peeler 12A is so configured as to contact the roll 16 due to the weight of the peeler 12A.

The peeler 12A serves not only as the peeling means but also as stencil guide means. When the leading edge of the stencil 16*a* is paid out from the roll 16, it slides on the upper surface of the peeler 12A toward the position where a thermal head 14A and a platen roller 14B face each other at a platen pressure control section 14.

When the roll holder 11A is pulled out of the device 10, the support member 72 is rotated counterclockwise by the spring 83 to move the peeler 12A to the position labeled A1 in FIG. 6.

Figure 10:
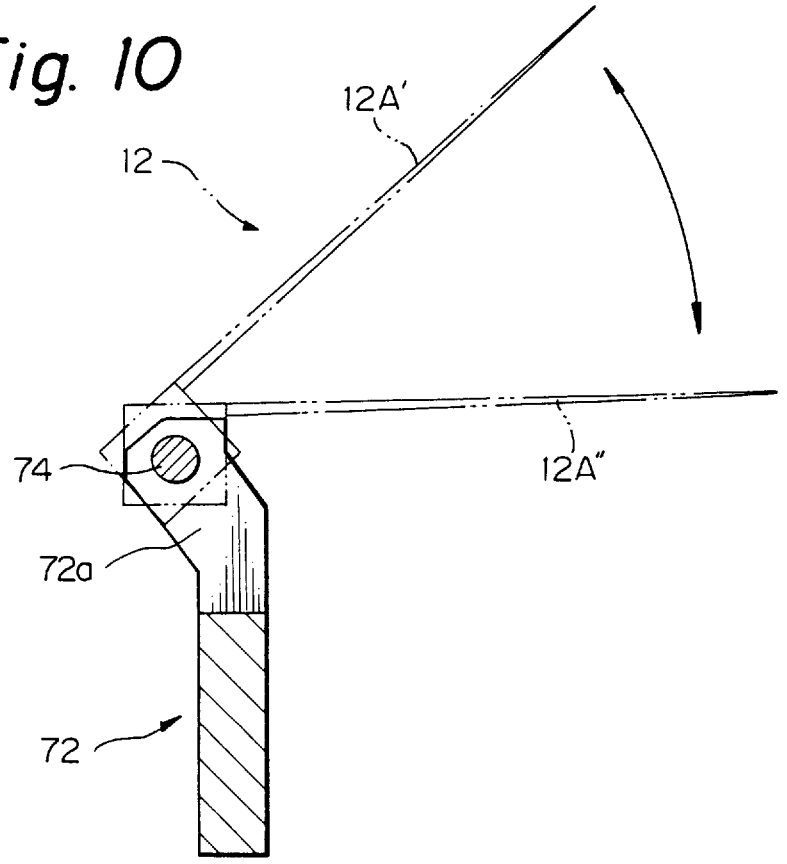
FIG. 10 is a front view showing the operation range of the peeler of FIG. 9.

When the roll holder 11A is set at its in operative position in the device 10, the presser portions 11G of the roll holder 11A cause the ends of the support member 72 to rotate clockwise against the action of the spring 83. As a result, the peeler 12A can move to a position where it contacts the circumference of the roll 16 due to its own weight, without regard to the varying outside diameter of the roll 16. As shown in FIG. 6, when the roll 16 has the maximum outside diameter, the peeler 12A (labeled 12A' for convenience) takes a position A2; when the former has the minimum outside diameter or limit diameter, the latter (labeled 12A" for convenience) takes a position A3. For this purpose, the support member 72 has a support configuration shown in FIGS. 8 and 9. FIGS. 9 and 10 show how the ends of the support member 72 are pushed by the presser portions 11G of the roll holder 11A against the action of the spring 83 when the roll holder 11A is inserted into the device 10.

As shown in FIGS. 8 and 9, the peeler support portion 72*a* of the support member 72 has an inclined surface 72*b* and a horizontal surface 72*c* at its upper end for supporting the receiving surface 12A5 included in the peeler 12A. The two surfaces 72*b* and 72*c* are contiguous with each other about the axis of the shaft 74. The surfaces 72*b* and 72*c* are connected to each other by a rounded surface having a radius of rotation whose center is the axis of the shaft 74, so that the free end of the peeler 12A is rotatable. The surface 72*b* allows the free end of the peeler 12A to contact the roll 16 having the maximum outside diameter. The surface 72*c* allows the free end of the peeler 12A to contact the roll 16' (see FIG. 6) having the minimum outside diameter.

The support member 72 has a generally gate-like configuration, as seen in the stencil transport direction. Specifically, the inclined surface 72*b* and horizontal surface 72*c* extend in the widthwise direction of the stencil 16*a* below the stencil transport path R. Posts extend downward from the right and left ends of the contiguous surfaces 72*b* and 72*c*.

When the posts of the support member 72 are pushed by the presser portions 11G of the roll holder 11A, the support member 72 is brought to a substantially upright position, as indicated by a solid line in FIG. 6. In this condition, the peeler 12A is freely rotatable in accordance with the varying outside diameter of the roll 16 (between A2 and A3 shown in FIG. 6) independently of the support member 72. When the presser portions 11G are released from the support member 72, the support member 72 is rotated about the shaft 74 to an inclined position indicated by a dash-and-dot line in FIG. 6. At this instant, the peeler 12A is inclined to the position A1 shown in FIG. 6, while the surface 12A5 is moved on the surface 72*c* of the support member 72.

Such a configuration of the surface of the support member 72 allows the peeler 12A to angularly move in accordance with the diameter of the roll 16 varying from the maximum diameter to the minimum diameter.

As shown in FIG. 6, the pay-out roller 71, like the peeler 12A, is angularly movable between a contact position (solid line and dash-and-dots line) where it contacts the circumference of the roll 16 and a non-contact position (dash-and-dat line) where it is spaced from the roll 16. For this purpose, the roller 71 is supported by the support member 72, spring 83 and presser portions 11G via the shaft 74. The pay-out roller 71 is formed of rubber, sponge or similar material having a coefficient of friction lying in a preselected range.

As shown in FIGS. 2 and 3, the pay-out roller 71 is supported by the free ends of a pair of arms 73 via a shaft 71*a* formed integrally with the roller 71. A one-way clutch, not shown, intervenes between one of the arms 73 and the shaft 71*a*. The one-way clutch transfers the rotation of the pay-out roller drive means 75 to the shaft 71*a*, i.e., roller 71 only in the direction in which the stencil 16*a* is paid out from the roll 16. In this configuration, the roller 71 is rotatable only in the direction for paying out the stencil 16*a*.

As shown in FIG. 8, the arms 73 each includes a bearing portion 73*b* formed with a hole 73*a*. The shaft 74 is passed through the holes 73*a* of the arms 73. The portion of the arms 73 adjoining the bearing portions 73*b* are slightly inclined upward away from the portions 73*b*. The bearing portions 73*b*, like the bearing portions 12A4 of the peeler 12A, each has its upper portion bent inward to form a receiving surface 73*d*. Further, each arm 73 has a connecting portion 73*c* in its upper portion adjoining the bearing portion 73*b*. The connecting portion 73*c* guides the stencil 16*a* peeled off from the roll 16 in cooperation with the upper surface of the peeler 12A, while reinforcing the arm 73. As shown in FIGS. 2, 3, 6 and 8, the arms 73 and support member 72 have their base ends rotatably supported by the common shaft 74.

As shown in FIG. 8, the support member 72 has arm support portions 72*d* for supporting the bearing portions 73*b* of the two arms 73. Each arm support portion 72*d*, like the peeler support portion 72*a*, has an inclined surface 72*b* and a horizontal surface 72*c* contiguous with each other around the shaft 74. The inclined surface 72*b* allows the pay-out roller 71 to contact the roll 16 having the maximum outside diameter. The horizontal surface 72*c* allows the roller 71 to contact the roll 16' (see FIG. 6) having the minimum outside diameter.

The support member 72 is moved by the presser portions 11G of the roll holder 11A to a substantially upright position indicated by a solid line in FIG. 6. In this condition, the pay-out roller 71 is freely movable about the shaft 74 via the arms 73 and independently of the support member 72 in accordance with the varying diameter of the roll 16 (between the positions A2 and A3 shown in FIG. 6). When the presser portions 11G are released from the support member 72, the member 72 tilts about the shaft 74 to an inclined position indicated by a dash-and-dot line in FIG. 6. At this instant, the surfaces 73*d* of the arms 73 are inclined to a position indicated by a dash-and-dot line in FIG. 6, while resting on the associated horizontal surface 72*c* of the support member 72.

The support member 72 is constantly biased by the spring 83 such that the pay-out roller 71 moves away from the circumference of the roll 16. The stop 84 shown in FIG. 6 restricts the movement of the support member 72 in the above direction. In this position, the support member 72 is ready to be moved by the presser portions 11G of the roll holder 11A.

In the above construction, when the roll holder 11A is inserted into the device 10 as far as its operative position, the presser portions 11G press the end of the support member 72. As a result, the support member 72 is rotated clockwise against the action of the spring 83 such that the pay-out roller 71 approaches the circumference of the roll 16. When the roll holder 11A is pulled out of the device 10, the support member 72 is rotated counterclockwise about the shaft 74 due to the action of the spring 83, moving the roller 71 toward its non-contact position.

When the support member 72 is rotated clockwise by the presser portions 11G, as stated above, the pay-out roller 71 is movable into contact with the roll 16 due to its own weight without regard to the varying diameter of the roll 16. Therefore, the roller 71 is constantly located at the contact position adjoining the contact position of the free end of the peeler 12A, but upstream of the same with respect to the direction in which the roll 16 is rotated counterclockwise to pay out the stencil 16*a*.

The arm support portions 72*d* included in the support member 72 each has the previously stated configuration for supporting the associated surface 73*d* of the arm 73. This allows the pay-out roller 71 to angularly move in accordance with the diameter of the roll 16 varying from the maximum diameter to the minimum diameter, as shown in FIG. 6.

As shown in FIGS. 1–3, the pay-out roller drive means 75 has a drive motor 76, a drive gear 77, a gear 78, a gear pulley 79, a driven pulley 80, and a belt 81. As shown only in FIG. 3, the motor 76 is mounted on the previously stated right side wall. The output shaft 76*a* of the motor 76 is rotatably supported by the right side wall. The drive gear 77 is mounted on the output shaft 76*a* of the motor 76. The rotation of the motor 76 is controlled such that the pay-out roller 71 rotates at a slightly higher peripheral speed than the roll 16 driven by the drive rollers 11Da–11Eb.

The gear pulley 79 is mounted on one end of the shaft 74 in such a manner as to be freely movable relative to the shaft 74. However, the gear pulley 79 is prevented from moving in the axial direction of the shaft 74 by a stop ring, not shown. The gear 78 is mounted on the outer surface of the gear pulley 79 such that when the roll holder 11A is inserted into the device 10, the gear 78 meshes with the drive gear 77 disposed above the gear 78. The driven pulley 80 is affixed to one end of the shaft 71*a*. The belt 81 is passed over the pulleys 79 and 80.

In the above configuration, the rotation of the motor 76 is transferred to the driven pulley 80 via the drive gear 77, gear 78, gear pulley 79, and belt 81. As a result, the pay-out roller 71 is rotated in the direction opposite to the direction of rotation of the roll 16, i.e., clockwise as viewed in FIG. 2.

As shown in FIG. 2, the platen pressure control device 14 is located downstream of the stencil peeling and guiding section 12 in the stencil pay-out direction T. The control device 14 has the master making means consisting of the thermal head 14A and platen roller 14B. The thermal head 14A has a conventional function of selectively cutting or perforating the stencil 16*a* sequentially paid out from the roll 16 by heat. The head 14A is selectively moved into or out of contact with the platen roller 14B by a mechanism which will be described. The platen roller 14B is rotatable to convey the stencil 16*a* paid out from the roll 16 or the master 16*a* cut by the head 14A to the downstream side of the stencil transport path R, while urging it against the head 14A. This function of the platen roller 14B is also conventional.

The platen roller 14B facing the thermal head 14A is rotated by a platen motor 14B30 via a drive transmission mechanism, not shown, as has been customary with a master making device. The platen motor 14B30 implemented by, e.g., a stepping motor is so controlled as to rotate the platen roller 14B at a slightly higher peripheral speed than the roll 16 and pay-out roller 71. Specifically, the platen roller 14B is higher in peripheral speed than the pay-out roller 71 which is higher in peripheral speed than the roll 16. This causes tension lying in a preselected range to act on the stencil 16*a* between the above parts. The head 14A and roller 14B are selectively moved into or out of contact with each other in order to exert a pressure on the stencil 16*a* or cancel it.

A head support arm 14A2 is rotatable about a shaft 14A1 supported by the previously mentioned opposite side walls. The thermal head 14A is affixed to one surface of the free end of the head support arm 14A2. The other surface or rear of the free end of arm 14A2 rests on an eccentric cam 14A3. A cam motor 14A30 is affixed to the right side wall and causes the eccentric cam 14A3 to rotate. Tension springs 14A4 are each anchored at one end to the free end portion of the arm 14A2 and at the other end to the respective side wall, so that the arm 14A2 is constantly biased counterclockwise, as viewed in FIG. 2. The cam 14A3 therefore constantly contacts the rear of the arm 14A2.

The cam or pressure cancelling member 14A3 has a smaller diameter portion contacting the rear of the head support arm 14A2 when the master making device 10 is not operated. In this condition, the head 14A on the arm 14A2 is spaced from the stencil transport path R, cancelling the pressure to act on the stencil 16*a*. When the head 14A is brought into contact with the platen roller 14B, the roller 14B is rotated by the platen motor 14B30 in the direction in which the stencil 16*a* paid out from the roll 16 by the peeler 12A and pay-out roller 71 is conveyed to the downstream side of the transport path R.

The platen pressure control device 14 having the above construction is operated as follows. To perforate the master 16*a* paid out from the roll 16, the eccentric cam 14A3 is rotated to bring its larger diameter portion into contact with the rear of the head support arm 14A2. The larger diameter portion urges the arm 14A2 and therefore the head 14A rotates clockwise, as viewed in FIG. 2. As a result, the head 14A contacts the platen roller 14B. In this condition, the platen roller 14B conveys the stencil 16*a* while pressing it against the head 14A. The head 14A perforates the stencil 16*a* in the main scanning and subscanning directions by selectively heating it. It is to be noted that the main scanning and subscanning directions respectively correspond to the lengthwise direction of the platen roller 14B and the stencil pay-out direction T perpendicular thereto.

While the embodiment moves the head 14A toward the platen roller 14B, the roller 14B may, of course, be moved toward the head 14A, if desired.

At the time when the leading edge of the stencil 16*a* is paid out from the roll 16 to the head 14A, the cam 14A3 may be continuously rotated for a short period of time. This allows the head 14A to repeatedly move into and out of contact with the platen roller 14B with the intermediary of the stencil 16*a*. If the roller 14B is rotated in the stencil pay-out direction T in interlocked relation to the above repeated movement of the head 14A, then the stencil 16*a* located at the platen pressure control device 14 is pulled toward the downstream side intermittently. As a result, creases and other deformation of the stencil 16*a* can be removed on the basis of the friction acting on the opposite ends of the roll 16 in the cavity 11A4 of the roll holder 11A.

When the master making device 10 is not operated, the smaller diameter portion of the cam 14A3 is held in contact with the rear of the head support arm 14A2. In this condition, the head 14A is spaced from the platen roller 14B so as to cancel the pressure acting on the stencil 16*a*.

As shown in FIGS. 1 and 2, the cutting device 17 is located on the stencil transport path R downstream of the platen pressure control device 14. The cutting device 17 cuts the perforated stencil or master 16*a* and the leading edge and trailing edge of the stencil 16*a*. The cutting device 17 cuts the stencil 16*a* at a predetermined length. For the cutting device 17, use may be made of a guillotine cutter or a rotary cutter.

A pair of rollers 18 and a guide 19 are positioned on the stencil transport path R downstream of the cutting device 17. The guide 19 guides the master 16*a* or the stencil 16*a* toward the clamper 2D of the drum 2. The rollers 18 and guide 19 convey the cut stencil or master 16*a* until its leading edge arrives at the stage 2E from which the clamp member 2F has been spaced. Then, the clamp member 2F is closed to hold the leading edge of the master 16*a* in cooperation with the stage 2E. One of the rollers 18 is connected to a conveyor motor 18A affixed to the right side wall and driven thereby. Alternatively, a gear may be mounted on the end of the shaft of the roller 18 and held in mesh with a drive gear mounted on the output shaft of the platen motor 14B30, in which case an electromagnetic clutch will be provided between the shaft of the roller 18 and the gear.

A document reading section, not shown, is disposed in the upper portion of the stencil printer 1 shown in FIG. 1. The document reading section has a scanning portion including a glass platen. Light issuing from a light source also included in the scanning portion is incident to a document laid on the glass platen. The resulting reflection from the document is routed through optics including mirrors and a lens to a CCD (Charge Coupled Device) or similar image sensor. In response, the image sensor generates image data and sends them to a control section which will be described. The master making device 10 perforates the stencil 16*a* in accordance with the above image data.

In FIG. 1, the master discharging device 20 is located above and at the left of the drum 2. The master discharging device 20 has an upper and a lower discharge member 20A and 20B and a box 21. The discharge members 20A and 20B adjoin the drum 2 and have belts contacting each other. The belts are each passed over a roller adjoining the drum 2 and a roller adjoining the box 21. The used master 16*a* is removed from the drum 2 by the belts and conveyed to the box 21 thereby. The lower discharge member 20B is capable of moving toward the circumference of the drum 2 when the drum 2 is rotated counterclockwise for discharging the used master 16*a*. In this condition, the discharge member 20B is capable of receiving the trailing edge of the master 16*a* and conveying it toward the box 21.

A compressing member 22 is positioned above the box 21 and movable up and down. After the used master 16*a* has been discharged into the box 21, the compressing member 22 compresses it in order to prepare a space for accommodating the next used master 16*a*. When the box 21 is filled with such waste masters 16*a*, it is pulled out of the stencil printer 1 in order to discard them.

As shown in FIG. 1, a sheet separator 30 is positioned below and downstream of the drum 2 with respect to the clockwise rotation of the same (indicated by an arrow). The free end of the sheet separator 30 is movable toward and away from the circumference of the drum 2. The sheet separator 30 separates the sheet S from the drum 2 and causes it to reach a conveyor 41. The conveyor 41 has an endless belt 44 passed over a pair of rollers 42 and 43 and constitutes the sheet discharging device. The sheets separated from the drum 2 are conveyed by the belt 44 to a tray 45. A fan 46 is positioned below the surface of the belt 44 on which the sheet S is carried. The fan 46 serves to hold the sheet S on the belt 44 by suction. The tray 45 may be configured to be rotatable about a shaft between an upright position and a flat position relative to the wall of the printer 1.

Figure 12:
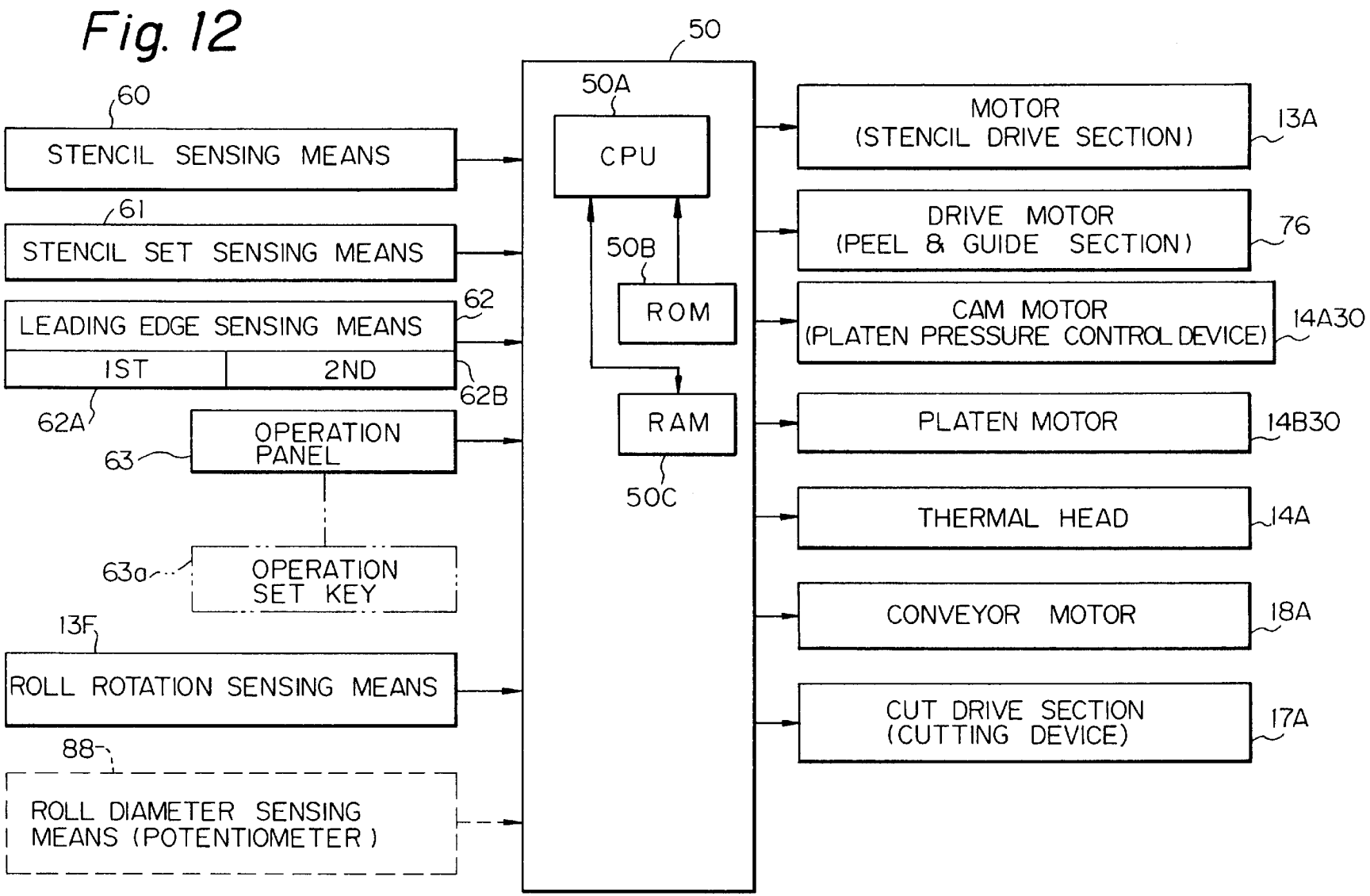
FIG. 12 is a block diagram schematically showing a control system included in the embodiment.

Referring to FIG. 12, a controller 50 is shown which executes various kinds of control including the control over the master making device 10 based on the previously mentioned image data. As shown, the control section 50 has a CPU (Central Processing Unit) 50A, a ROM (Read Only Memory) 50B, and a RAM (Random Access Memory) 50C. The ROM 50B stores a basic program for controlling the sequence beginning with the reading of a document image and ending with the discharge of the sheet S. The RAM 50C is used to register data.

The part of the controller 50 relevant to the crux of the illustrative embodiment will be described hereinafter. The document reading section, stencil sensing means 60, stencil set sensing means 61, leading edge sensing means 62, an operation panel 63 and the roll rotation sensing means 13F are each connected to the input side of the control section 50 via an I/O (Input/Output) interface, not shown. Connected to the output side of the control section 50 are the motor 13A of the stencil drive section 13, motor 76 of the stencil peeling and guiding section 12, cam motor 14A30 of the platen pressure control device 14, platen motor 14B30 for driving the platen roller 14B, thermal head 14A, conveyor motor 18A for driving the roller 18, and a drive section 17A for driving the cutting device 17. It is to be noted that an operation set key 63*a* enclosed by a dash-and-dots line and roll diameter sensing means 88 enclosed by a dashed line are control elements which are not used in this embodiment.

As shown in FIGS. 1 and 2, the stencil sensing means 60 is implemented by a reflection type photosensor mounted on the bottom of the guide member 15 and having a light emitting element and a light-sensitive element. When the roll 16 is loaded in the cavity 11A4 of the roll holder 11A, the sensing means 60 senses the roll 16 on the basis of a reflection from the roll 16. Also, the sensing means 60 is responsive to the limit diameter of the roll 16. The roll 16 includes the black or low reflectance portion 16A, as described with reference to FIG. 11. When the roll 16 reaches the limit diameter due to the consumption of the stencil 16*a*, the sensing means 60 senses the low reflectance portion 16A and outputs a signal representative of the fall of reflectance. On receiving this signal, the controller 50 determines that the pay-out of the stencil 16*a* from the roll 16 must be stopped.

Assume that the roll holder 11A is inserted into the device 10 while pushing the support member 72 of the peeling and guiding section 12 with its presser portions 11G. Then, the stencil set sensing means 61 senses the movement of the support member 72. The free end of the support member 72 is provided with a reflection surface, not shown, for reflecting incident light. In the illustrative embodiment, the sensing means 61 is implemented by a reflection type photosensor capable of determining whether or not the above reflection surface is present. In addition, the sensing means 61 serves as operation sensing means for determining the time when the motor 13A of the stencil drive section 13 and the motor 76 of the peeling and guiding section 12 should start operating on the basis of the above movement of the support member 72, and feeding its output signal to the controller 50.

As shown in FIGS. 1 and 2, the leading edge sensing means 62 has first and second leading edge sensing means 62A and 62B. The first sensing means 62A is positioned on the stencil transport path R upstream of the platen roller 14B while the second sensing means 62B is positioned downstream of the cutting device 17. The first and second sensing means 62A and 62B are both implemented by reflection type photosensors each having a light emitting element and a light-sensitive element. On detecting the leading edge of the stencil 16*a*, the sensing means 62A outputs a reference signal for driving the platen pressure control section 14. On detecting the leading edge of the stencil 16*a*, the sensing means 62B outputs a reference signal for causing the stencil 16*a* to be continuously paid out for a preselected period of time. The amount in which the stencil 16*a* is paid out in response to the output signal of the sensing means 62B is such that the leading edge of the perforated stencil or master 16*a* faces the clamper 2D.

A cut start switch, numeral keys for entering a desired number of printings and so forth are arranged on the operation panel 63, although not shown in the figures. The cut start switch is pressed when a new perforated stencil or master 16*a* should be wrapped around the print drum 2. When this switch is pressed, the stencil 16*a* is automatically paid out from the roll 16 toward the platen pressure control section 14 and perforated. After the master 16*a* has been wrapped around the drum 2, a single sheet S is fed to the drum 2 while the ink is transferred to the sheet S via the perforations of the master 16*a*. As a result, a single trial printing is produced. To start a sequence of printing operations, a print start switch, not shown, also provided o n the operation panel 63 is pressed.

When the output signals of the stencil set sensing means 60 and stencil set sensing means 61 are absent, the controller 50 does not energize the motor 13A of the stencil drive section 13 or the motor 76 of the peeling and guiding section 12. At the same time, the control section 50 causes the cam motor 14A30 of the platen pressure control section 14 to rotate the eccentric cam 14A3 until its smaller diameter portion contacts the head support arm 14A2, and deenergizes the platen motor 14B30 associated with the platen roller 14B. In this condition, the thermal head 14A and platen roller 14B are spaced from each other and unable to convey or perforate the stencil 16*a*.

On receiving the output signals of the sensing means 60 and 61, the controller 50 energizes the motor 13A of the stencil drive section 13 and the motor 76 of the peeling and guiding section 12 substantially at the same time. As a result, the stencil 16*a* is allowed to be paid out from the roll 16 and conveyed. At this instant, the motor 13A is once rotated in the direction opposite to the direction for paying out the leading edge of the stencil 16*a*, and then rotated in the direction for paying it out, as mentioned earlier. With this scheme, it is possible to surely position the leading edge of the stencil 16*a* relative to the peeler 12A, and therefore to surely peel off the leading edge of the stencil 16*a* from the roll 16. For example, assume that the leading edge of the stencil 16*a* is positioned in the vicinity of, but downstream of, the peeler 12A. Then, the above reverse rotation of the motor 13A returns the leading edge of the stencil 16*a* to the position where it faces the peeler 12A. As a result, when the roll 16 is rotated in the stencil pay-out direction T, it is possible to reduce the interval up to the time when the leading edge of the stencil 16*a* is peeled off and separated from the roll 16.

When the first leading edge sensing means 62A senses the leading edge of the stencil 16*a* paid out from the roll 16, the controller 50 causes the stencil drive section 13 to continuously rotate the roll 16 for a preselected period of time and then stop the rotation. During the continuous rotation of the roll 16, the leading edge of the stencil 16*a* is moved to between the thermal head 14A and the platen roller 14B. At the same time, the controller 50 drives the cam motor 14A30 in order to move the head support arm 14A2 (FIG. 2) toward the platen roller 14B. As a result, the head 14A and platen roller 14B exert a pressure on the stencil 16*a*, i.e., nip it therebetween. Then, the platen roller 14B is rotated by the platen motor 14B30 in order to convey the stencil 16*a* in cooperation with the head 14A.

On receiving the output signal of the second leading edge sensing means 62B, the controller 50 causes the platen motor 144B30 and the motor 18A associated with the roller 18 to rotate a predetermined amount. This causes the leading edge of the stencil 16*a* to face the clamper 2D.

A reference will be made to FIGS. 13–18 demonstrating the pay-out of the stencil 16*a* from the roll 16 and FIGS. 19 and 20 demonstrating the operation of the controller 50. FIGS. 13–18 are slightly schematic, compared to FIGS. 1, 2 and other figures, to facilitate the understanding of the operation. The constituents of the pay-out roller drive means 75, drive rollers 11Db and 11Eb and motors including the motors 14A30 and 14B30 are omitted, as needed. In FIG. 19, a step ST3' enclosed by a dashed line is not used in this embodiment.

Figure 13:
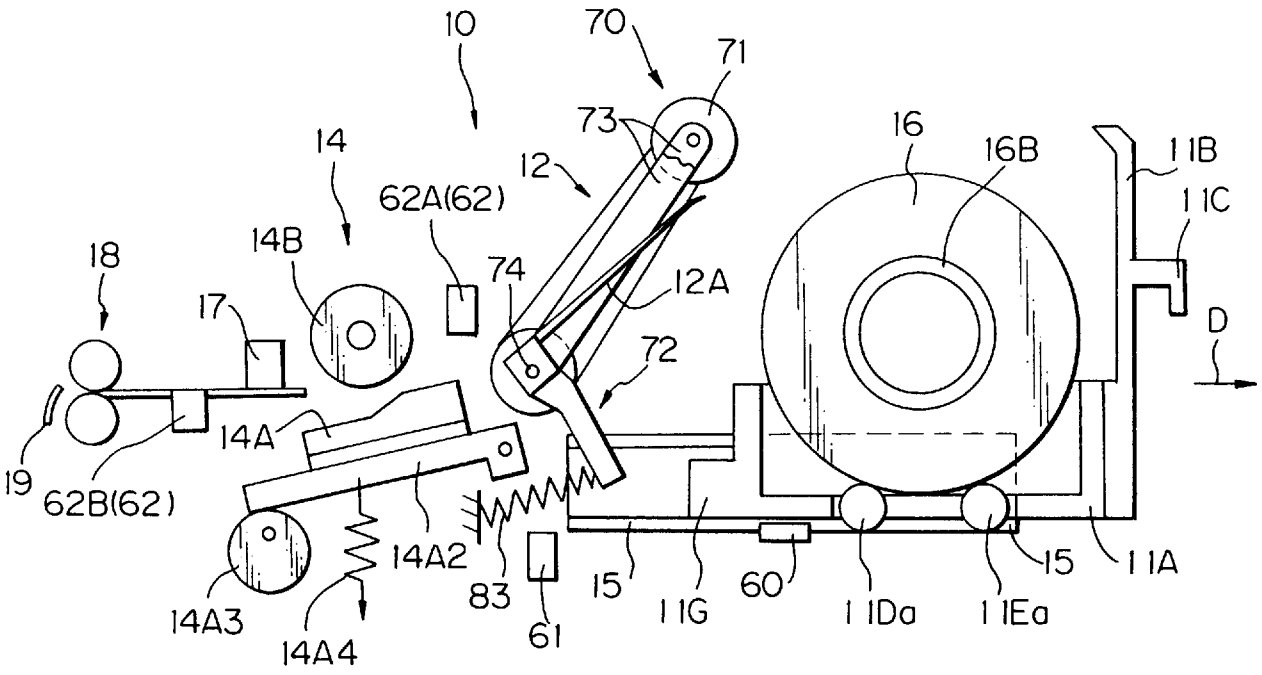
FIG. 13 shows the initial condition of the roll holding section loaded with a fresh stencil roll.

FIG. 13 shows a condition in which a new stencil roll 16 is to be loaded in the roll holder 11A. First, the operator pulls the roll holder 11A out of the device 10 by holding the handle 11C. Whether or not the roll 16 existing in the roll holder 11A must be replaced is indicated by the output signal of the stencil sensing means 60 which is responsive to the low reflectance portion 16A of the stencil 16*a*, as stated earlier. On receiving the output signal of the sensing means 60 representative of the fall of reflection from the stencil 16*a*, the controller 50 sets up a condition for allowing the roll holder 11A to be pulled out.

In the platen pressure control section 14, the cam motor 14A30 rotates the eccentric cam 14A3 until its smaller diameter portion contacts the head support arm 14A2. As a result, the head 14A is released from the platen roller 14B and cancels the pressure acting on the stencil 16*a*. At the same time, the platen motor 14B30 and therefore the platen roller 14B is caused to stop rotating. In addition, when the roll holder 11A is pulled out of the device 10, the presser portions 11G are released from the support member 72. As a result, the support member 72 is rotated counterclockwise, as viewed in FIG. 13, so that the free end of the peeler 12A is released from the roll 16. Under these conditions, the stencil 16*a* is smoothly entrained by the roll 16 to the outside of the device 10 without any resistance acting thereon.

Figure 14:
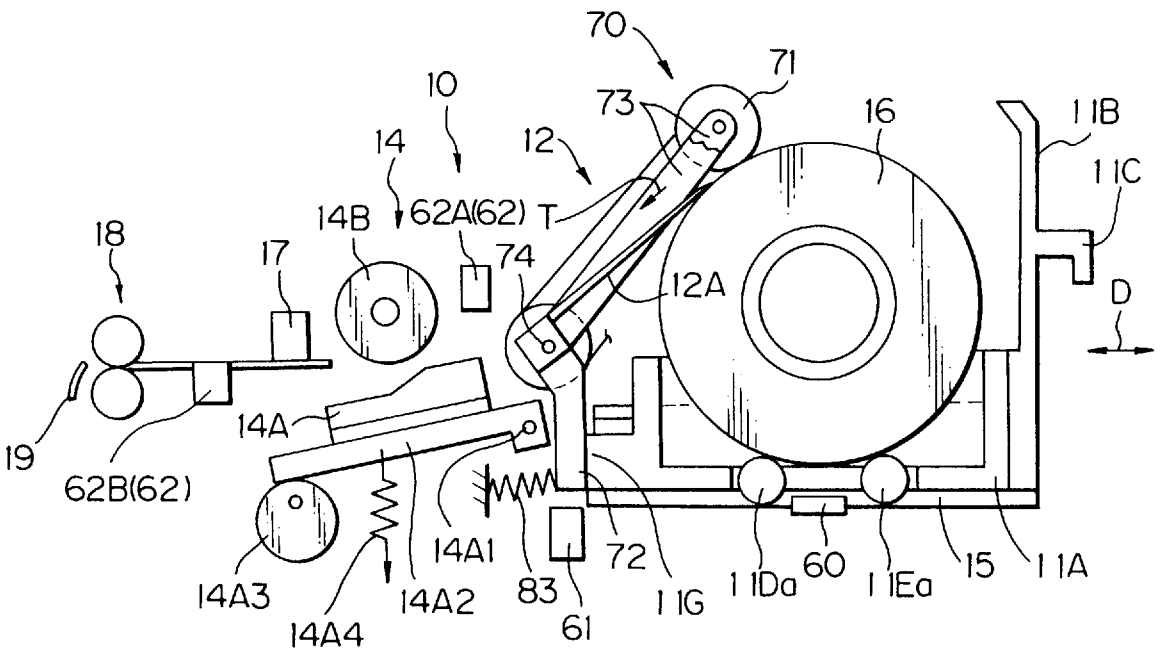
FIG. 14 shows the roll holding section brought to its operative position.

The operator pulls out the roll holder 11A loads it with a new roll 16 and again pushes the roll holder 11A into the device 10 as far as the operative position. As shown in FIG. 14, when the roll holder 11A reaches its operative position, the presser portions 11G cause the support member 72 to rotate clockwise, as viewed in FIG. 14, until the peeler 12A and pay-out roller 71 contact the preselected position of the roll 16. At the same time, the stencil sensing means 60 senses the new roll 16 while the stencil set sensing means 61 determines that the roll 16 has been set at the operative position.

When the operator presses the cut start switch, the controller 50 executes a procedure which will be described with reference to FIG. 19. First, the controller 50 determines whether or not it has received the output signals of the stencil sensing means 60 and stencil set sensing means 61 (steps ST1 and ST2). If the answers of the steps ST1 and ST2 are positive (Y), the controller 50 energizes the motors 13A and 76 for causing the stencil drive section 13 and peeling and guiding section 12 to operate (step ST3). Specifically, the motor 13A rotates the drive rollers 11Da–11Eb in the direction for paying out the leading edge of the stencil 16*a* from the roll 16. More specifically, the motor 13A rotates the drive rollers 11Da–11Eb in the direction (counterclockwise) opposite to the stencil pay-out direction T and then in the stencil pay-out direction T, as stated earlier and as shown in FIG. 15.

Figure 15:
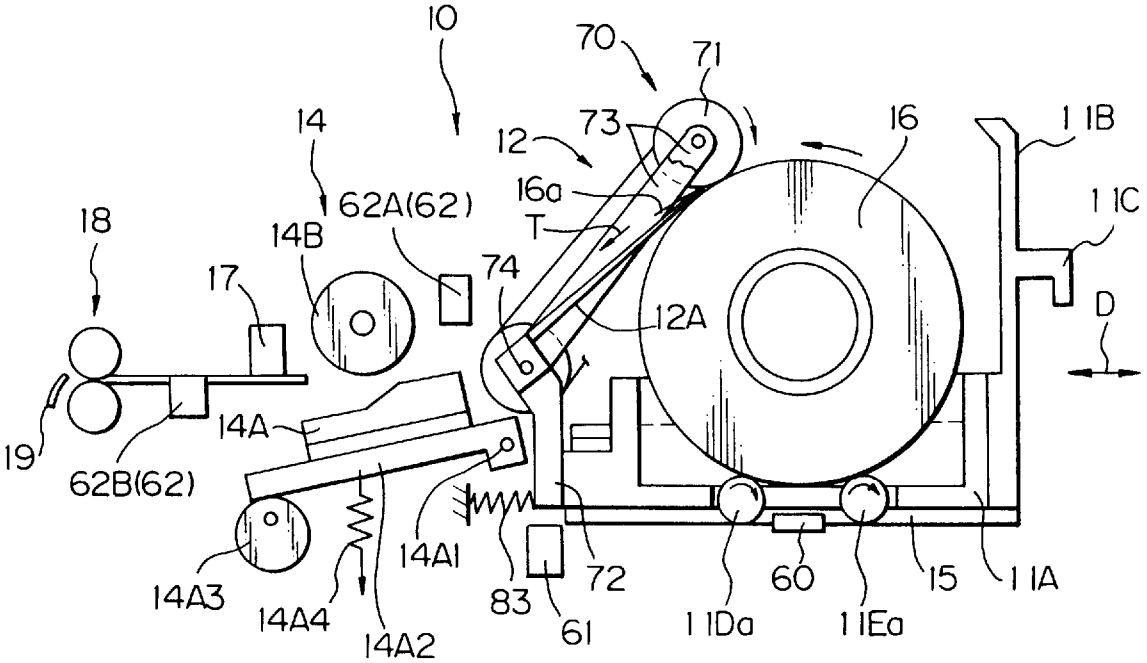
FIG. 15 shows the embodiment in a condition wherein the leading edge of the stencil has just been paid out from the roll.

In FIG. 15, while the roll 16 is caused to rotate in the clockwise direction, opposite to the direction indicated by an arrow, for a moment, the pay-out roller 71 slips on the roll 16 due to the previously mentioned one-way clutch mounted on the shaft 71*a*. Subsequently, when the roller 71 is rotated clockwise as viewed in FIG. 15, the peeler 12A surely peels the stencil 16*a* from the roll 16. As a result, the stencil 16*a* is conveyed by the roller 71 to the downstream side in the stencil pay-out direction T, while being guided by the upper surface of the peeler 12A.

Figure 16:
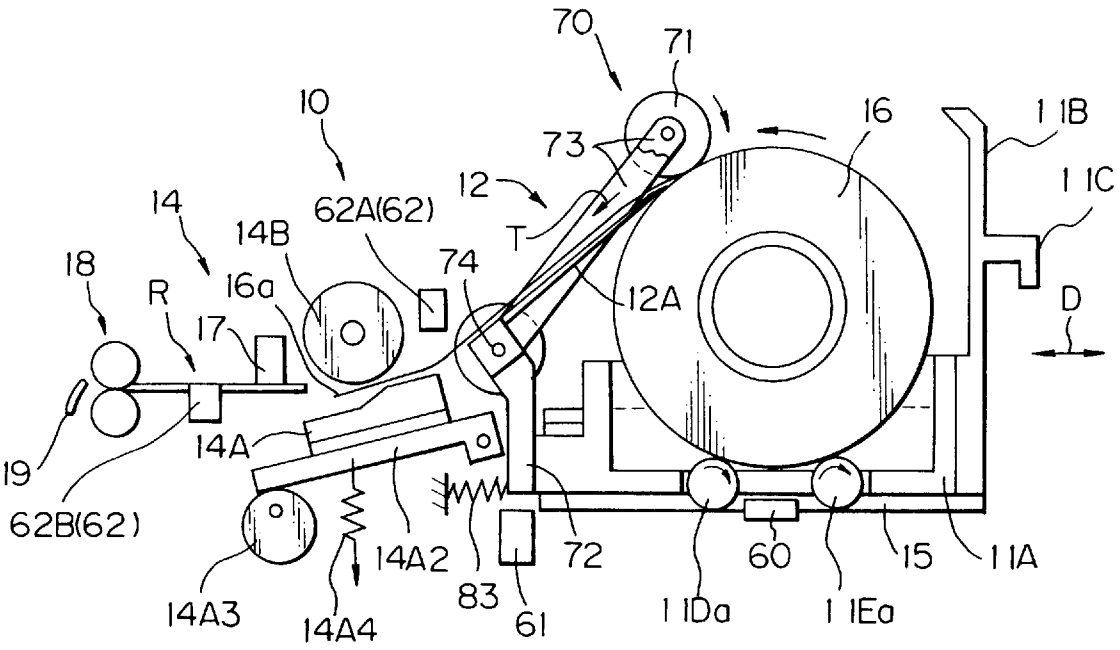
FIG. 16 shows the leading edge of the stencil paid out from the roll and reached a position where a thermal head and a platen roller face each other.

As soon as the stencil drive section 13 and peeling and guiding section 12 start operating, the controller 50 determines whether or not it has received the output signal of the first leading edge sensing means 62A (step ST4). If the answer of the step ST4 is Y, the controller 50 causes the stencil drive section 13 and peeling and guiding section 12 to continue their operations (step ST5). At this instant, the leading edge of the stencil 16*a* is allowed to reach the platen pressure control section 14. In the illustrative embodiment, when the rotation of the motor 13A is continued, the stencil 16*a* having its leading edge sensed by the sensing means 62A is conveyed by a distance of about 20 mm from the position where the leading edge is sensed by the sensing means 62A to the position it moves away from the nip between the platen roller 14B and the head 14A. The motors 13A and 76 are each rotated in a preselected amount necessary for the leading edge of the stencil 16*a* to be conveyed toward the downstream side, as stated above. This is illustrated in FIG. 16.

After the step ST5 using the output signal of the roll rotation sensing means 13F, the controller 50 causes the stencil drive section 13 and peeling and guiding section 12 to stop operating (step ST6). To determine the time for interrupting the rotation of the motors 13A and 76, the roll rotation sensing means 13F implemented by a rotary encoder or similar roll rotation sensing means senses the preselected amount of rotation of the motor 13A and sends its output to the controller 50.

Figure 17:
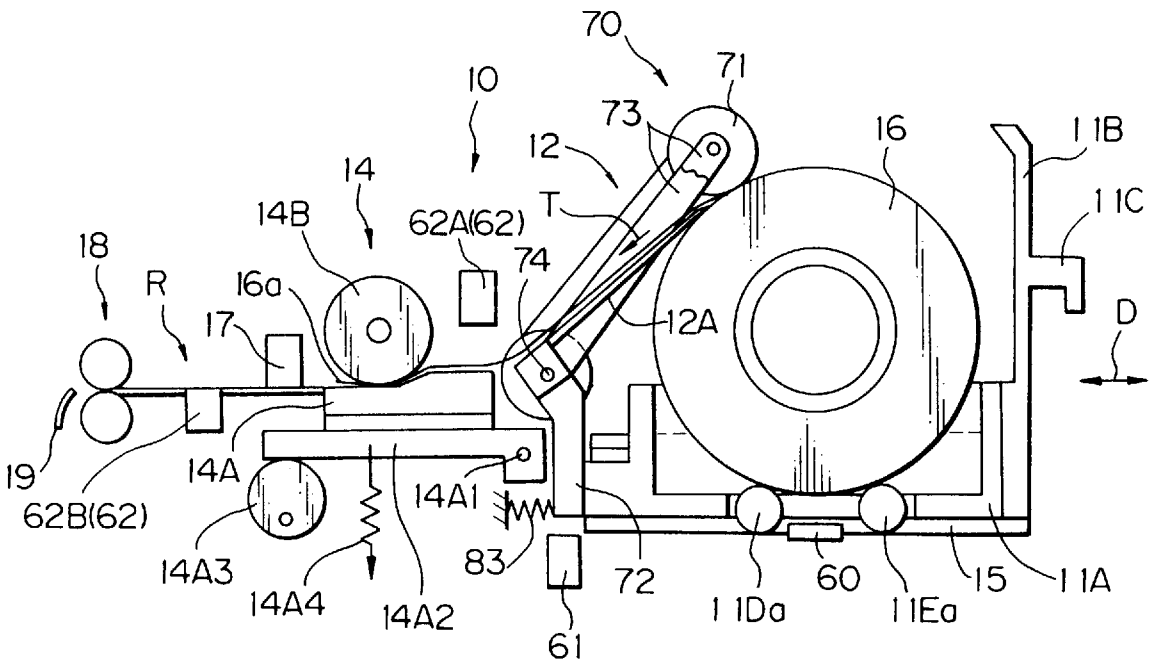
FIG. 17 shows the leading edge of the stencil nipped by the thermal head and platen roller.

Subsequently, the controller 50 controls the platen pressure control section 14 (step ST7). Specifically, in the step ST7, the controller 50 causes the head 14A to contact the platen roller 14B in order to nip the stencil 16*a*. For this purpose, as shown in FIG. 17, the controller 50 drives the cam motor 14A30 such that the larger diameter portion of the cam 14A3 contacts the rear of the head support arm 14A2. As a result, the arm 14A2 rotates the head 14A toward the platen roller 14B. In this condition, the head 14A and platen roller 14B are capable of conveying the stencil 16*a* while nipping it therebetween. At this instant, the cam 14A3 is continuously rotated for a short period of time so as to repeatedly move the head 14A into and out of contact with the platen roller 14B with the intermediary of the stencil 16*a*. At the same time, the platen roller 14B is rotated clockwise, as viewed in FIG. 17, in order to convey the stencil 16*a* toward the downstream side. Consequently, the stencil 16*a* is pulled by the platen roller 14B intermittently and freed from creases or similar deformation thereby.

During the operation following the step ST6, the stencil 16*a* is paid out from the roll 16 by the platen roller 14B, and the roll 16 is rotated while slipping on the rollers 11Da–11Eb. The stencil 16*a* peeled off from the roll 16 is conveyed while slipping on the pay-out roller 71.

Figure 18:
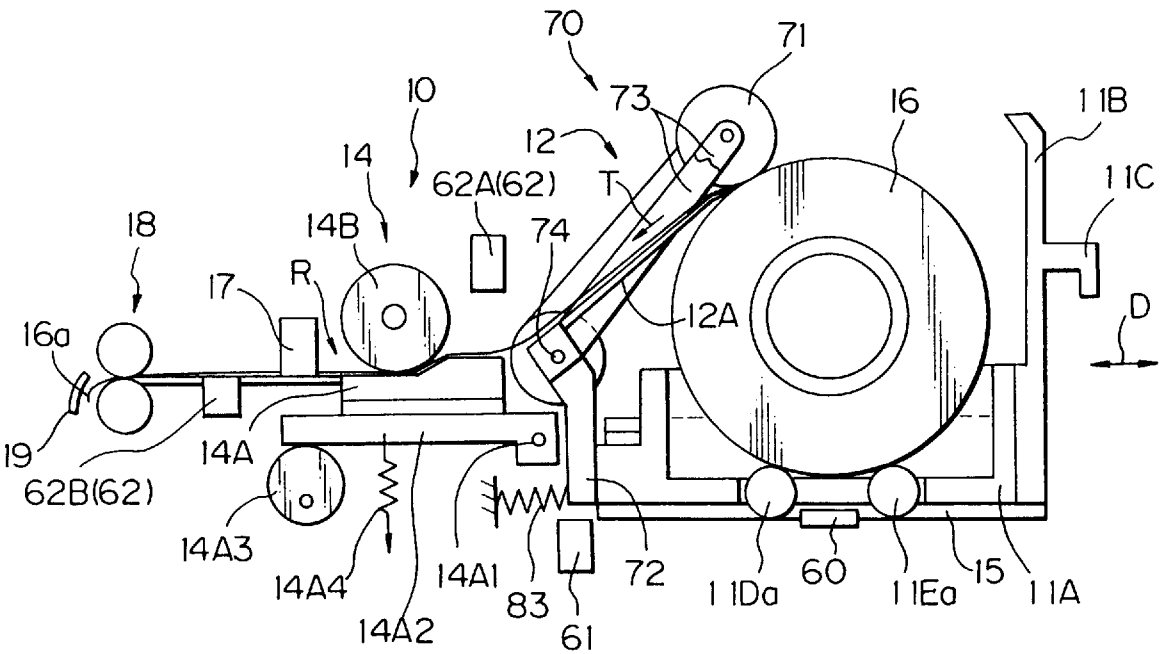
FIG. 18 shows the embodiment in a stand-by condition.

In the step ST7, every time the platen roller 14B is brought into contact with the head 14A, it pays out the stencil 16*a* from the roll 16. As soon as the leading edge of the stencil 16*a* is sensed by the second leading edge sensing means 62B (ST8), the sensing means 62B sends its output to the controller 50. In response, the controller 50 causes each of the platen motor 14B30 and motor 18A to rotate a predetermined amount in order to bring the leading edge of the stencil 16*a* to the position where it faces the clamper 2D (step ST9). This condition or stand-by condition is shown in FIG. 18. In this case, the stencil 16*a* moves 25 mm corresponding to the distance between the position of the platen pressure control section 14 and the position where the leading edge of the stencil 16*a* faces the clamper 2D. Again, a rotary encoder or similar signal generating means senses the rotation of the platen motor, so that the time for stopping rotating the platen motor 14B30 and motor 18A can be determined.

After the step ST9, the controller 50 causes the platen motor 14B30 and motor 18A to stop rotating after rotating a preselected amount (ST10).

Figure 20:
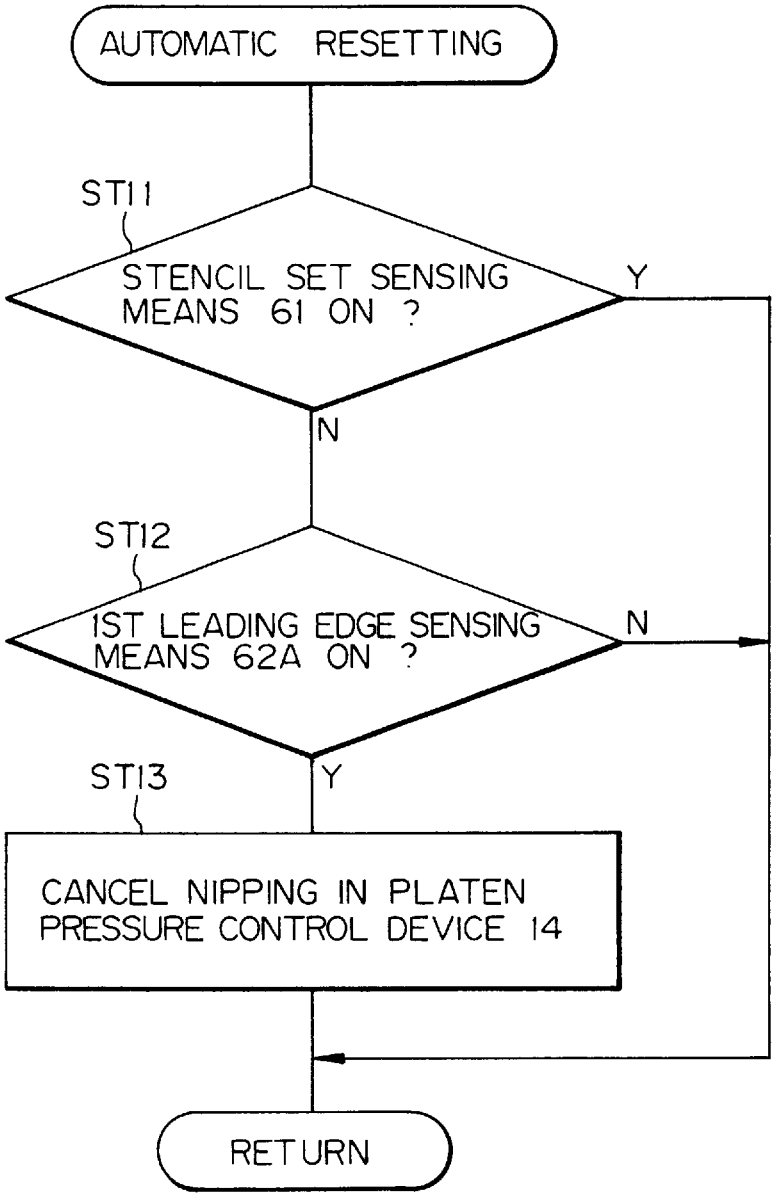

FIG. 20 shows a procedure for cancelling the pressure acting on the stencil 16*a* in the platen pressure control section 14 (labeled AUTOMATIC RESETTING). When the roll holder 11A is moved outward away from its operative position, the procedure to be described cancels the pressure and allows the roll holder 11A to be smoothly pulled out. As shown, the controller 50 determines whether or not it has received the output signals of the stencil set sensing means 61 and first leading edge sensing means 62A (steps ST11 and ST12). If the answer of the step ST11 is negative (N) and if the answer of the step S12 is Y, the controller 50 causes the platen pressure control section 14 to cancel the pressure acting on the stencil 16*a* (step ST13).

In the step ST13, the cam motor 14A30 rotates the eccentric cam 14A3 until its smaller diameter portion contacts the rear of the head support arm 14A2. As a result, the head 14A is released from the platen roller 14B, so that the pressure acting on the stencil 16*a* is cancelled. Even if the stencil 16*a* is nipped when the roll holder 11A starts moving toward the outside of the device 10, tension acts on the stencil 16*a* and causes the roll 16 to rotate in the cavity 11A4 while loosening itself. Therefore, despite the pressure acting on the stencil 16*a*, the stencil 16*a* is prevented from being cut away from the roll 16.

After the leading edge of the stencil 16*a* has been brought to the stand-by position facing the clamper 2D, it is nipped by the clamp member 2F and stage 2E. Then, the head 14A selectively cuts or perforates the stencil 16*a* by heat while conveying it in cooperation with the platen roller 14B. The perforated part of the stencil, i.e., the master 16*a* is sequentially wrapped around the drum 2 being rotated clockwise either continuously or intermittently.

Subsequently, during the course of printing, every time the used master 16*a* is discharged from the drum 2, the stencil 16*a* is paid out from the roll 16, cut, and then wrapped around the drum 2 in order to effect another printing operation.

The embodiment described above has the following advantages. When a new roll 16 is loaded in the roll holding section 11, it is only necessary for the operator to push the roll holder 11A into the device 10 as far as the operative position. Then, the leading edge of the stencil 16*a* is automatically paid out from the roll 16 and cut. Even when the leading edge of the stencil 16*a* has a noticeable curl, it can be surely peeled off from the roll 16 and conveyed while the free end of the peeler 12A is free from curling. The peeler or peeling means 12A is implemented by a thin elastic member. Hence, when the peeler 12A is caused to contact the roll 16, it elastically deforms so as not to exert an unusual pressure on the roll 16. This protects the surface of the stencil 16*a* from scratches and prevents the stencil 16*a* from being torn off.

Further, the peeler 12A is sequentially inclined from the intermediate portion in the widthwise direction of the stencil 16*a* toward the opposite side edges of the stencil 16*a* downstream in the stencil pay-out direction T, adjoins or contacts the leading edge of the stencil 16*a*. The peeler 12A therefore sequentially peels off the stencil 16*a* from its center toward its opposite side edges. This prevents the peeler 12A from catching the leading edge of the stencil 16*a* and thereby prevents the stencil 16*a* sequentially paid out from the roll 16 from jamming the transport path.

Moreover, the inclined portion 12A2 of the peeler 12A reduces the area over which the peeler 12A contacts the stencil 16*a* as far as possible. As a result, the peeler 12A is prevented from contacting the stencil 16*a* over an excessive area. This facilitates the guide for the stencil 16*a* being paid out from the roll 16 and thereby more surely separates the stencil 16*a* from the roll 16.

In addition, the peeler 12A is capable of contacting the roll 16 due to its own weight without resorting to special biasing means or the like.

Figure 21:
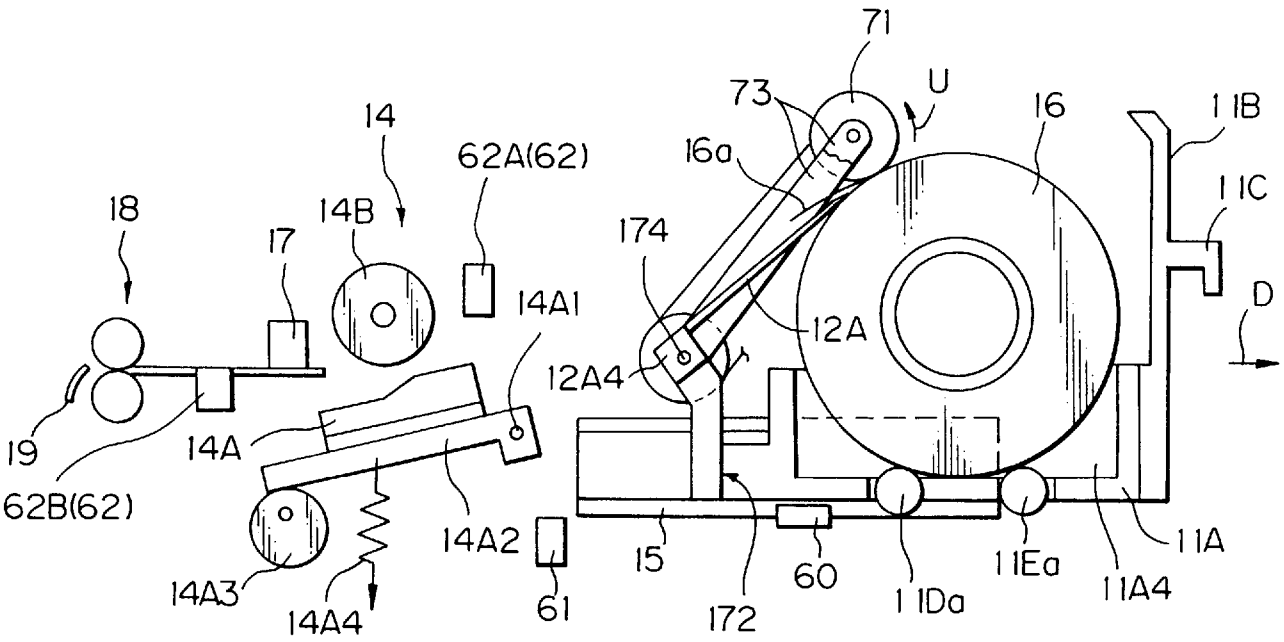
FIGS. 21, 22 and 23 are views respectively showing a first, a second and a third modification of the first embodiment.

Referring to FIG. 21, a first modification of the first embodiment will be described. In the first embodiment, after the roll 16 has been loaded in the cavity 11A4 of the roll holder 11A, the automatic stencil peeling device 70, i.e., the stencil drive section 13 and peeling and guiding section 12 are driven to automatically pay out the leading edge of the stencil 16*a* from the roll 16. If the automatic pay-out of the leading edge of the stencil 16*a* is not desired, the leading edge of the stencil 16*a* may be peeled off from the roll 16 and paid out by hand, as will be described with reference to FIG. 21.

In the first modification, the operator pulls out the roll holder 11A away from the operative position, lifts the pay-out roller 71, peels off the leading edge of the stencil 16*a* from the roll 16 by hand, pays it out toward the top of the peeler 12A, lowers the pay-out roller 71 onto the roll 16, and then pushes the roll holder 11A into the device 10. This is followed by a procedure substantially identical with the procedure shown in FIG. 19 in response to the output signal of the stencil sensing means 60.

Specifically, as shown in FIG. 21, the support member 72 is replaced with a support member 172. The support member 172 is affixed to the portions of the roll holder 11A corresponding to the presser portions 11G. The modification does not need the compression spring 83 and the stop 84. The support member 172 is slidable along the guide members 15 together with the roll holder 11A. A shaft 174 is affixed to the support member 172 while the bearing portions 12A4 of the peeler 12A are rotatably mounted on the shaft 174. After the operator has pulled the roll holder 11A out of the device 10 in the direction D, the operator can lift the pay-out roller 71 in a direction U, and pays out the leading edge of the stencil 16*a* from the roll 16 toward the top of the peeler 12A. Subsequently, the operator lowers the pay-out roller 71 onto the roll 16.

In the above construction, assume that the operator has paid out the leading edge of the stencil 16*a* over a predetermined length, put it on the top of the peeler 12A, and then pushed the roll holder 11A into the device 10. Then, although the step ST1 and successive steps shown in FIG. 19 are executed, the drive rollers 11Da–11Eb are not reversed in the step ST3 because the leading edge of the stencil 16*a* has been positioned on the top of the peeler 12A.

Figure 22:
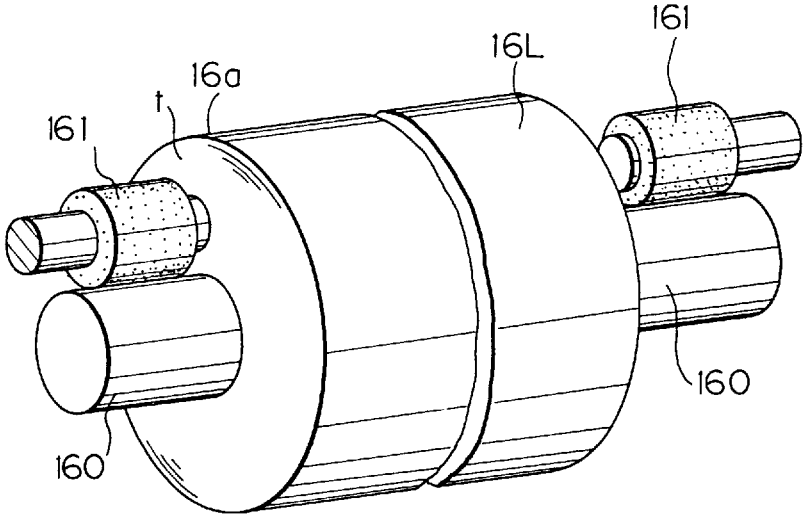

FIG. 22 shows a second modification of the first embodiment. As shown, the stencil drive section 13 and drive rollers 11Da–11Eb are absent. The roll holder 11A has a different configuration. The roll 16 whose core 16B protrudes from the opposite ends t of the roll 16 is replaced with a roll 16L having a core 160 which protrudes from the opposite ends t of the roll 16L more than the core 16B. Drive rollers or frictional drive means 161 respectively contact the circumferences of the core 160 at the opposite ends of the core 160. A roll holder, not shown, is formed with generally U-shaped notches for rotatably supporting the opposite ends of the core 160 of the roll 16L.

In FIG. 22, the core 160 is formed of synthetic resin having an ordinary mechanical strength and an adequate coefficient of friction. Friction members formed of, e.g., rubber and having a high coefficient of friction are wound round the circumference of the drive rollers 161. The drive rollers 161 respectively contact the opposite ends of the core 160 from the above via the friction members. A driven gear, not shown, similar to the driven gear 11D1 of the first embodiment is affixed to one end of the right drive roller 161. A drive gear (not shown) similar to the drive gear 13B of the first embodiment is mounted on the output shaft of a motor (not shown) similar to the motor 13A affixed to the right side wall of the body of the master making device 10, although not shown specifically. The rotation of the motor is transferred to the left drive roller 161 by a connecting shaft, not shown, extending below and across the guide members 15 in the widthwise direction of the stencil 16*a*.

When the above motor is driven at a constant speed, the speed at which the stencil 16*a* is conveyed away from the roll 16 changes with a change in the diameter of the roll 16. In light of this, this modification, like the first embodiment, variably controls the rotation speed of the motor in such a manner as to maintain the peripheral speed of the roll 16 constant without regard to the diameter of the roll 16, as follows.

Figure 25:
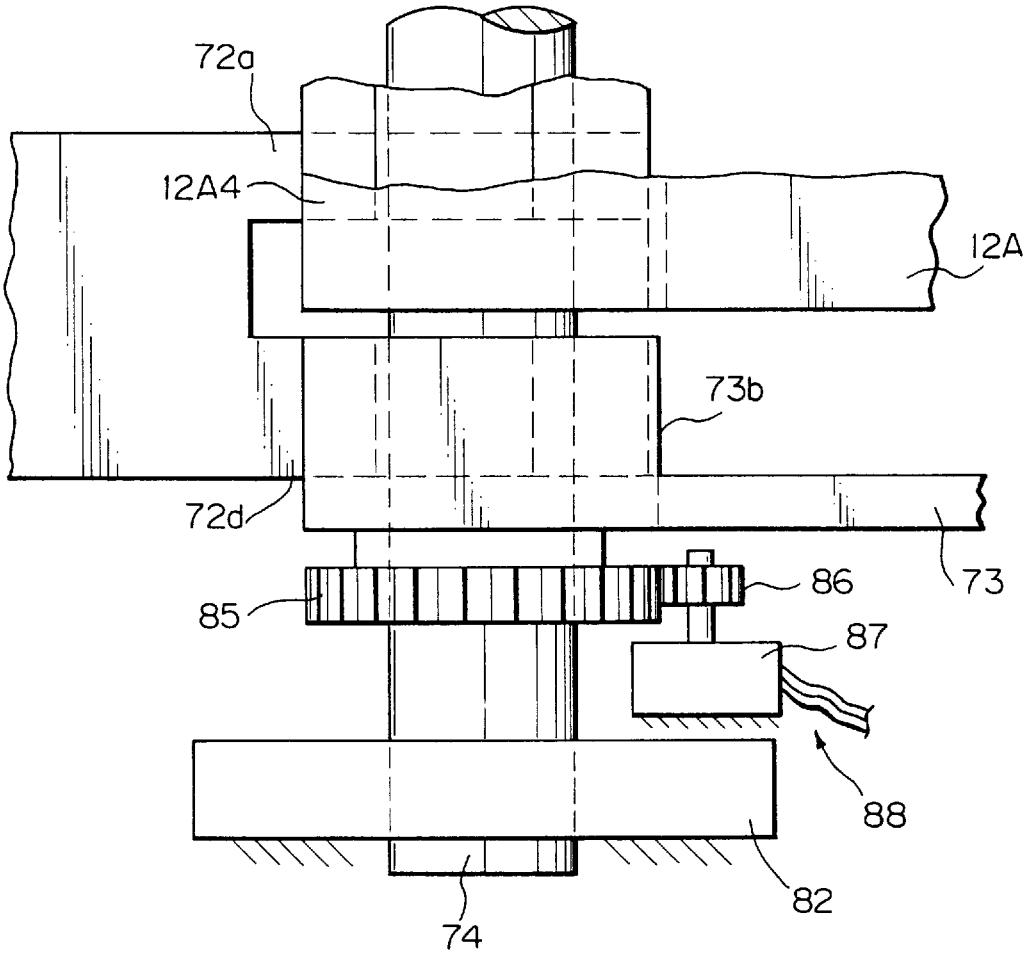
FIG. 25 is a fragmentary enlarged plan view of the second modification.

As shown in FIG. 25, the previously mentioned roll diameter sensing means 88 is arranged on the other end of the shaft 74. The sensing means 88 is made up of a gear 85 and a potentiometer 87 with a meter pinion 86. The gear 85 is mounted on the outer surface of the bearing portion 73*b* provided on the other end of the shaft 74 and is rotatable about the shaft 74. The meter pinion 86 is held in mesh with the gear 85. The potentiometer 87 mounted on the left side wall is connected to the controller 50 by an electric circuit, not shown, as indicated by a dashed line in FIG. 12.

The operation of the second modification is identical with the operation shown in FIG. 19 except for the previously mentioned step ST3'. When the roll holder 11A with the roll 16 is pushed into the device 10 as far as its operative position, the presser portions 11G push the support member 72. As a result, the pay-out roller 71 is angularly moved about the shaft 74 via the arms 73 until it rests on the roll 16. At the same time, the free end of the peeler 12A is brought into contact with the roll 16. The contact position of the pay-out roller 71 sequentially falls along a unique locus corresponding to the decreasing diameter of the roll 16. Such a displacement of the roller 71 is transferred to the gear 85 via the arms 73. The resulting displacement of the gear 85 is input to the potentiometer 87. Therefore, the potentiometer 87 transforms the displacement of the roller 71 to a potential difference indirectly representative of the diameter of the roll 16. The output of the potentiometer 87 is fed to the controller 50.

To maintain the peripheral speed of the roll 16 constant without regard to the varying diameter of the roll 16, data representative of the rotation speeds of the motor and corresponding to the diameters of the roll 16 are stored in the ROM 50B of the controller 50 beforehand. Specifically, when the roll 16 is new and has a great diameter, the controller 50 causes the motor for driving the drive roller 161 to rotate at a lower speed. When the diameter of the roll 16 decreases due to the consumption of the stencil 16*a*, the controller 50 causes the motor to rotate at a higher speed. This successfully maintains the peripheral speed of the roll 16 constant.

On the other hand, the rotation speed of the drive motor 76 is selected such that the pay-out roller 71 rotates at a peripheral speed slightly higher than the peripheral speed of of the roll 16, as stated earlier. In this condition, constant tension acts on the stencil 16*a* being paid out from the roll 16 by the roller 71 without regard to the diameter of the roll 16. Consequently, the portion of the stencil 16*a* between the upstream side of the roll 16 with respect to the counter-clockwise rotation and the contact position of the roller 71 is surely conveyed by the roller 71 without slackening in the stencil pay-out direction T.

The second modification may be modified as follows. The configuration of the roll holder 11A included in the first embodiment is changed. The roll 16 is replaced with the roll 16L. The drive rollers 11Da–11Eb of the first embodiment are replaced with rollers contacting the circumference of the roll 16L and driven thereby. The drive rollers or frictional drive means 161 contact the circumferences of the opposite ends of the core 160. In addition, a displacing mechanism, not shown, is provided for allowing the drive rollers 161 to move downward in accordance with the varying diameter of the roll 16L. A roll holding section, not shown, has a roll holder similar to the roll holder 11A except that it is formed with generally U-shaped notches for guiding the core 160.

The drive rollers 161 are rotated by a motor, not shown, via the above displacing mechanism such that the stencil 16*a* is paid out from the roll 16L. The displacing mechanism will be described in relation to the first embodiment.

In the second modification and its modified form, the drive rollers 161 frictionally contact the core 160 of the roll 16L and transfer the rotation of the motor to the roll 16L. Because the drive rollers 161 do not directly contact the surface of the stencil 16*a*, the surface of the stencil 16*a* is free from damage.

In the second modification and its modified form, the rotation of the motor may be transferred only to one of the drive rollers 161, in which case the other roller 161 will be supported in a freely rotatable manner.

Figure 23:
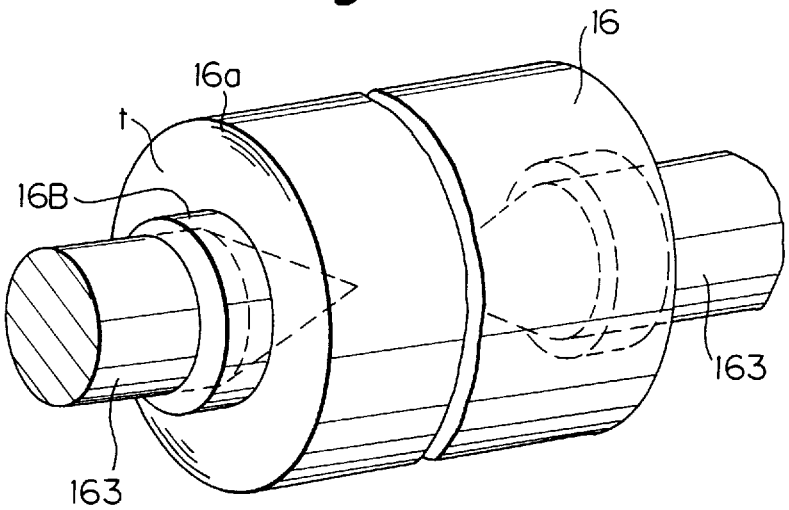
Figure 24:
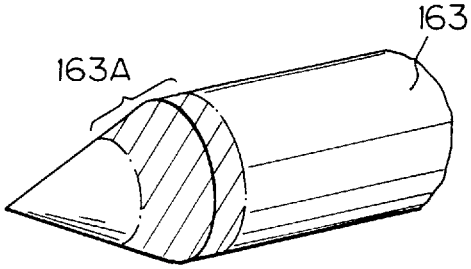
FIG. 24 is an enlarged perspective view showing a drive shaft included in the modification of FIG. 23.

FIGS. 23 and 24 show a third modification of the first embodiment. As shown, the stencil drive section 13 and drive rollers 11Da–11Eb are absent. The roll holder 11A has its configuration changed. Drive shafts or rotary drive means 163 are each slidable in the widthwise direction of the stencil 16*a*. The drive shafts 163 are capable of mating with the inner periphery of the core 16B at the opposite ends of the core 16B. When the drive shafts 163 mate with the inner periphery of the core 16B, they rotate the roll 16 in the direction for paying out the leading edge of the stencil 16*a* toward the master making means. A roll holder, not shown, is similar to the roll holder 11A except that it is formed with generally U-shaped notches for rotatably supporting the core 16B. The core 16B is rotatably received in the notches of the roll holder in the preselected position thereof.

As shown in FIG. 24, the drive shafts 163 each has a conical end in order to align the axis of the roll 16 with their axis when inserted into the core 16B. A friction member 163A having a high coefficient of friction is formed on the periphery of the conical end over the axial area indicated by hatching in FIG. 24. Specifically, a piece of rubber or similar material having a high coefficient of friction is adhered to the above area of the drive shaft 163 in order to form the friction member 163A. The friction member 163A is so positioned as to contact the inner periphery of the core 16B.

The drive shafts 163 may each be provided with a telescopic slidable structure so as to be held at a preselected extended position. A driven gear, not shown, similar to the driven gear 11D1 of the first embodiment is affixed to one end of one drive shaft 163. A drive gear, not shown, similar to the drive gear 13B is mounted on the output shaft of a motor, not shown, similar to the motor 13A mounted on the right side wall of the body of the device 10. When the roll holder is brought to its operative position, the drive gear meshes with the driven gear. The drive shafts 163 are driven by the motor, not shown, via the drive mechanism in the direction for paying out the stencil 16*a* from the roll 16.

The third modification may be further modified as follows. The roll holder 11A of the first embodiment has its configuration changed. The drive rollers 11Da–11Eb of the first embodiment are replaced with driven rollers contacting and driven by the circumference of the roll 16. The drive shafts 163 are slidable in the widthwise direction of the stencil 16*a* and serve as the rotary drive means. The drive shafts 163 mate with the inner periphery of the core 16B at the opposite ends of the core 16B and rotate the roll 16 in the direction for paying out the leading edge of the stencil 16*a* toward the master making means. A displacing mechanism, not shown, is provided for allowing the drive shafts 163 to move downward in accordance with the varying diameter of the roll 16. A slide mechanism, not shown, is provided for allowing the drive shafts 163 to slide in the widthwise direction of the stencil 16*a*.

A roll holder for the above modification is similar to the roll holder 11A except that it is formed with generally U-shaped notches for guiding the opposite ends of the core 16B and receiving the drive shafts 163. In this configuration, the roll holder rotatably supports the core 16B while the axially slidable drive shafts 163 are movable into the core 16B. A motor, not shown, rotates the drive shafts 163 in the direction for paying out the stencil 16*a* from the roll 16.

In the third modification and its modified form, when the roll holder accommodating the roll 16 therein is moved to the operative position in the device 10, the drive shafts 163 are inserted into the core 16B via the slide mechanism. As a result, the conical ends of the drive shafts 163 pressingly contact the inner periphery of the core 16B. When the motor drives the drive shafts 163, the shafts 163 cause the roll 16 to rotate and thereby pay out the stencil 16*a* from the roll 16.

In the third modification and its modified form, the drive shafts 163 inserted into the core 16B serve to align the axis of the roll 16 with their axis at the opposite ends of the roll 16. This reduces the oscillation of the axis of the roll 16 and thereby allows the peeler 12A to be accurately positioned relative to the circumference of the roll 16. Moreover, the decrease in the oscillation of the roll 16 allows the peeler 12A to surely peel off the leading edge of the stencil 16*a* and separate it from the roll 16. In addition, because the drive shafts 163 do not directly contact the surface of the stencil 16*a*, the stencil 16*a* is free from damage.

Again, the rotation of the motor may be transferred only to one of the drive shafts 163, in which case the other drive shaft 163 will be supported in a freely rotatable manner.

In the second and third modifications, the rotary drive means shown in FIGS. 22–24 and each for rotating the roll 16L or 16 in the direction for paying out the stencil 16*a* are, of course, applicable not only to the master making device 10 of the present invention but also to a conventional master making device including stencil drive members. In such a case, because the frictional drive means and mating drive means do not directly contact the surface of a stencil, the probability that the surface of the stencil is damaged is extremely low.

Figure 26:
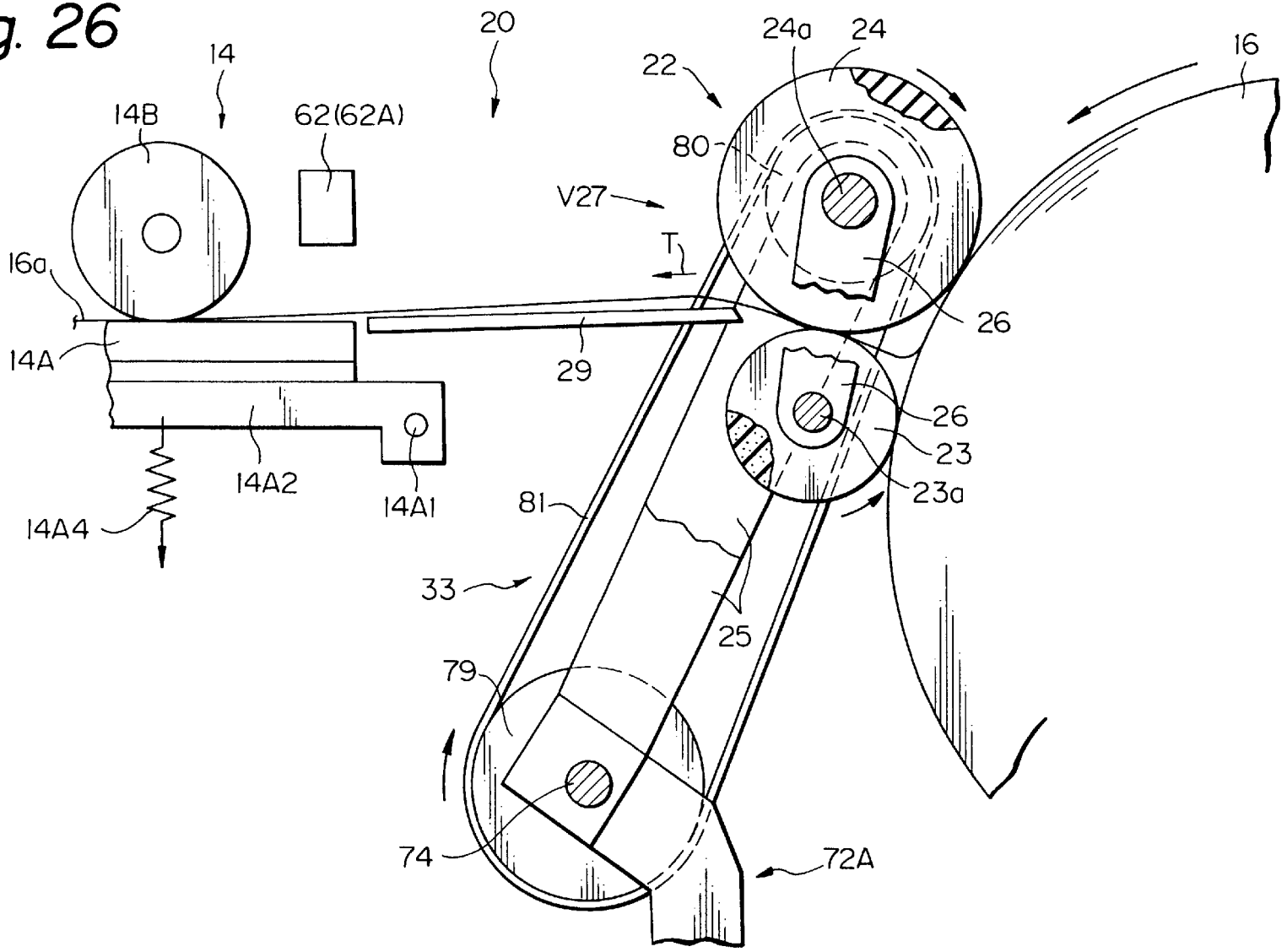
FIG. 26 is a fragmentary partly sectional front view showing a second embodiment of the present invention.
Figure 27:
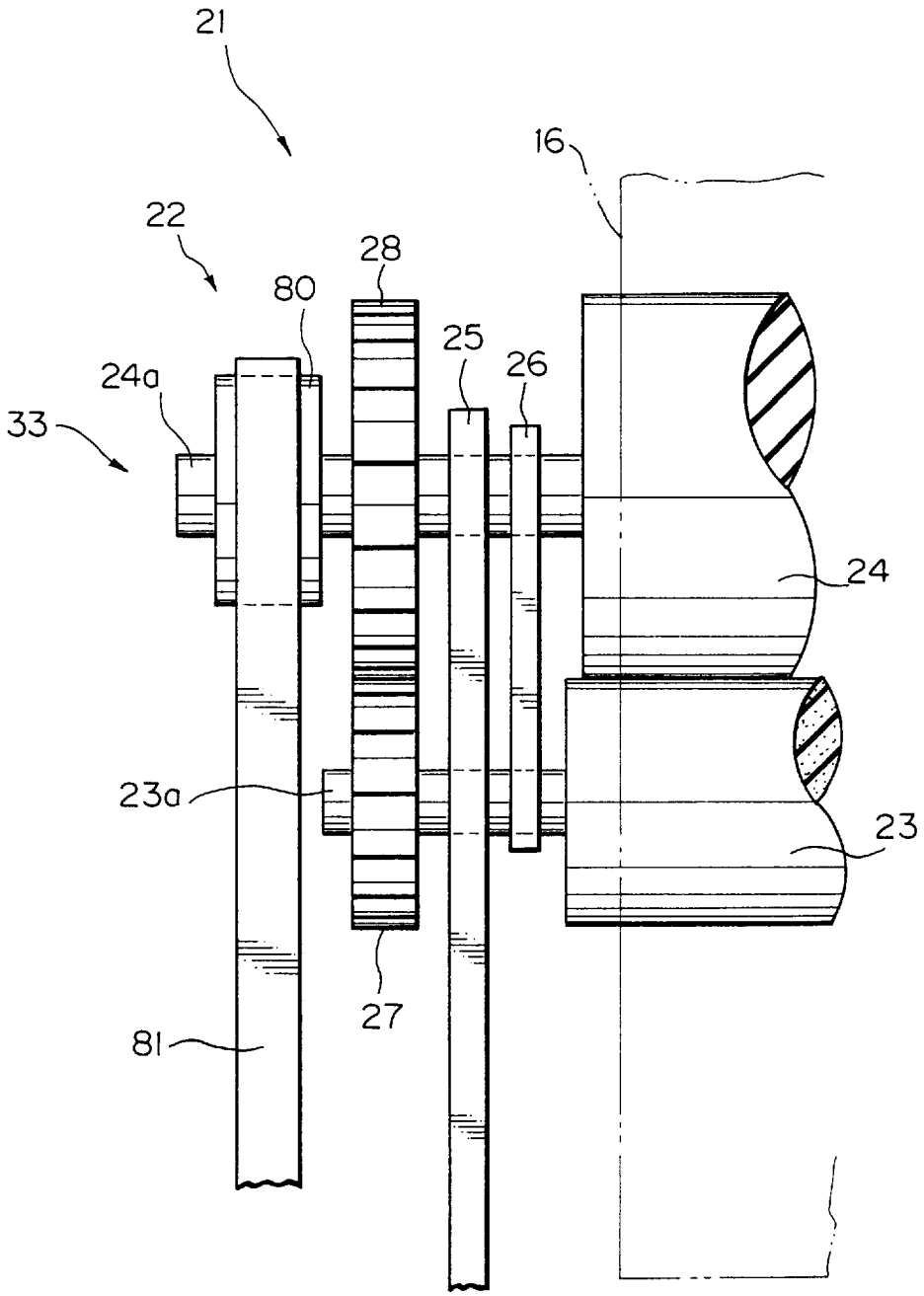
FIG. 27 is a fragmentary plan view of an automatic stencil peeling device of the second embodiment as seen in a direction V27 of FIG. 26.
Figure 28:
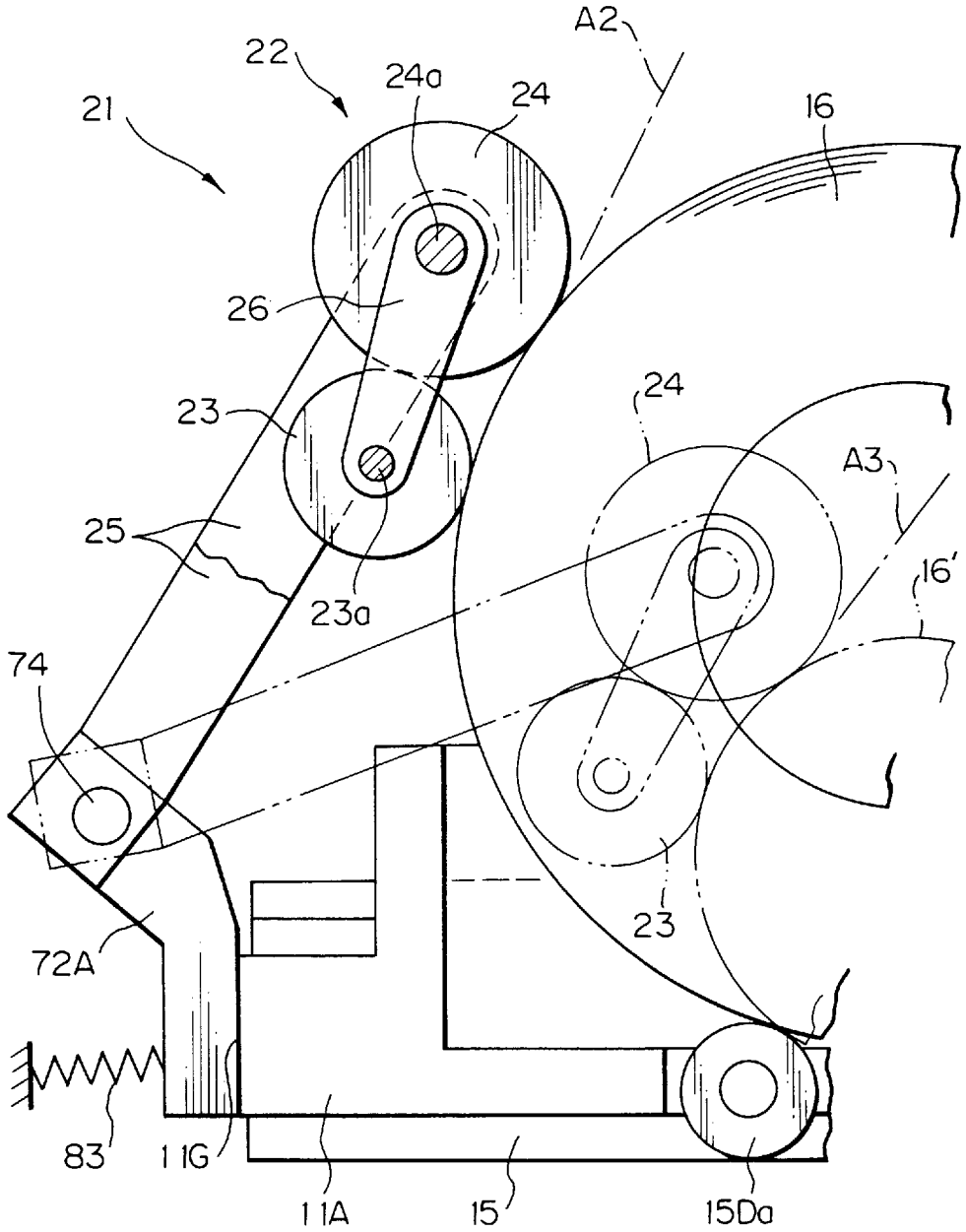
FIG. 28 shows the operation of a stencil peeling and guiding section included in the second embodiment.

Referring to FIGS. 26–28, a second embodiment of the present invention will be described. As shown, this embodiment has a master making device 20 in place of the device 10. The device 20 has an automatic stencil peeling device 21 in place of the device 70. The peeling device 21 includes a stencil peeling and guiding section 22.

The stencil peeing and guiding section 22 has a peel roller 23, and a high friction pay-out roller 24, and roller drive means 33. The peel roller or peeling means 23 contacts the circumference of the roll 16 and has a coefficient of friction great enough to peel off the leading edge of the stencil 16*a* from the roll 16. The pay-out roller or conveying means 24 has a greater coefficient of friction than the peel roller 23 and is pressed against the roller 23. The two rollers 23 and 24 are driven by the roller drive means 33. The peel roller 23 is formed of, e.g., sponge and affixed to a shaft 23*a*. The pay-out roller 24 is formed of, e.g., rubber and affixed to a shaft 24*a*.

As shown in FIGS. 26 and 28, the pay-out roller 24, like the roller 71 of the first embodiment, is freely movable between a contact position (A2, FIG. 28) where it contacts the roll 16 having the maximum diameter as indicated by a solid line, and a contact position (A3, FIG. 28) where it contacts the roll 16 having the minimum diameter as indicated by a dash-and-dots line, in accordance with the varying diameter of the roll 16. Further, the roller 24 is movable to a non-contact position where it is spaced upward and leftward from the roll 16, although not shown specifically. The pay-out roller 24 is supported by a support member 72A, the compression spring 83 and presser portions 11G via the shaft 74 in such a manner as to be freely movable between its contact position and non-contact position.

The pay-out roller 24 is supported by the free ends of a pair of arms 25 via the shaft 24*a*. A one-way clutch, not shown intervenes between the end of one of the arm 25 and the shaft 24*a*. The one-way clutch transfers the rotation of the roller drive means 33 to the pay-out roller 24 only in the direction in which the stencil 16*a* is paid out from the roll 16. Specifically, the roller 24 is rotatable clockwise for conveying the stencil 16*a*.

The support member 72A is identical with the support member 72 except for the bent upper portion. The base portions of the arms 25 are supported in substantially the same manner as described with reference to FIG. 8 except that a part of the peeler support portion 72*a* is omitted. Specifically, the support member 72A (parenthesized in FIG. 8) includes the arm support portion 72*d* formed with the continuous inclined surface 72*b* and horizontal surface 72*c*. Therefore, the arms 25 and support member 72A are rotatably supported at their base ends by the common shaft 74.

In operation, when the roll holder 11A is inserted into the device 20, the presser portions 11G push the ends of the support member 72A, as in the first embodiment. As a result, the support member 72A tilts against the action of the spring 83 such that the pay-out roller 24 approaches the circumference of the roll 16. On the other hand, when the roll holder 11A is pulled out of the device 20, the support member 72A angularly moved counterclockwise about the shaft 74 due to the action of the spring 83, moving the pay-out roller away from the roll 16.

When the roll holder 11A is set in the device 20, as stated above, the pay-out roller 24 is capable of resting on the roll 16 due to its own weight without regard to the varying diameter of the roll 16. Therefore, the roller 24 remains in contact with the roll 16 in accordance with the transition of the maximum diameter to the minimum diameter of the roll 16.

A pair of arms 26 are engaged with opposite ends of the shaft 23*a* of the peel roller 23 at one end thereof. The arms 26 are angularly movably supported by opposite ends of the shaft 24*a*. In this configuration, the peel roller 23 is angularly movable about the shaft 24*a* via the shaft 23*a* and arms 26 due to its own weight in accordance with the varying diameter of the roll 16. The roller 23 lightly contacts the roll 16. For the roller 23, use may be made of foam chloroprene rubber or foam polyurethane or similar sponge.

The peel roller 23 is constantly located at its contact position close to the contact position of the pay-out roller 24, but downstream of the same with respect to the counterclockwise rotation of the roll 16. A one-way clutch intervenes between the end of one of the arms 26 and the shaft 23*a*. The one-way clutch transfers the rotation of the roller drive means 33 to the peel roller 23 only in the direction for peeling off the stencil 16*a* from the roll 16. The peel roller 23 is therefore rotatable counterclockwise in order to peel off the stencil 16*a*.

The roller drive means 33 has roller gears 27 and 28 in addition to the motor 76, drive gear 77, gear 78, gear pulley 79, driven pulley 80 and belt 81 shown in FIGS. 1 to 3. As shown in FIG. 27, the roller gear 27 is mounted on one end of the shaft 23*a* while the roller gear 28 is held in mesh with a gear 27 mounted on one end of the shaft 24*a*. The driven pulley 80 is mounted on one end of the shaft 24*a*. The motor 76 is so controlled as to rotate the pay-out roller 24 and peel roller 23 at a slightly higher peripheral speed than the roll 16 driven by the drive rollers 11Da–11Eb.

The rotation of the motor 76 is transmitted to the driven pulley 80 via the drive gear 77, gear 78, gear pulley 79 and belt 81. Further, the rotation of the pulley 80 is transferred to the pay-out roller 24 and peel roller 23 via the roller gears 27 and 28. Consequently, the roller 24 is rotated in the opposite direction to the roll 16, i.e., clockwise as viewed in FIG. 26 while the roller 23 is rotated counterclockwise.

A guide plate 29 adjoins the nip between the pay-out roller 24 and the peel roller 23 at one end and the upstream end of the thermal head 14A in the stencil pay-out direction T at the other end. When the stencil 16*a* peeled off from the roll 16 by the peel roller 23 is conveyed by the pay-out roller 24, the guide plate 29 guides it to the downstream side in the stencil pay-out direction T, i.e., to the end of the head 14A. The guide plate 29 extends in the axial direction of the shaft 24*a* and is affixed to the right and left side walls.

The nip between the two rollers 23 and 24 sequentially shifts in accordance with the varying diameter of the roll 16. To surely guide the leading edge of the stencil 16*a* to the head 14A despite the shift of the above nip, use may be made of another guide plate, not shown, rotatably supported by the arms 25 in the vicinity of the nip at one end and slidable on the upstream end portion of the guide plate 29 at the other end.

As shown in FIG. 26, the platen pressure control device 14 is located downstream of the peeling and guiding section 22 in the stencil pay-out direction T. The control device 14 is identical with the control device 14 of the first embodiment except that it is located at a higher level than the position facing the roll holding section 11, thereby being aligned with the stencil pay-out direction T.

The operation of the illustrative embodiment will be described hereinafter, concentrating on the differences between it and the first embodiment. The pay-out of the stencil 16*a* from the roll 16 and the control routine of the controller 50 will not be shown because they are analogous to the procedures shown in FIGS. 13–18 and FIGS. 19 and 20. The control procedure of this embodiment is practicable only if the peeling and guiding section 12 in the steps 3, 5 and 6 of FIGS. 19 and 20 are replaced with the peeling and guiding section 22.

Referring again to FIG. 14, when the roll holder 11A is inserted into the device 20, the presser portions 11G of the roll holder 11A cause the support member 72A of the peeling and guiding section 22 to rotate clockwise as viewed in the figure. As a result, the pay-out roller 24 and peel roller 23 are each brought into contact with the particular portion of the roll 16, as shown in FIG. 26. When the roll holder 11A is inserted deeper into the device 20, the stencil sensing means 60 senses the roll 16 having a sufficient diameter while the stencil set sensing means 61 senses the roll holder 11A arrived at the operative position.

When the cut start switch on the operation panel 63 is pressed, the controller 50 executes the processing described with reference to FIG. 19. In FIG. 19, the controller 50 checks the output signals of the two sensors 60 and 61 (steps ST1 and ST2). If the answers the steps ST1 and ST2 are Y, the controller 50 energizes the motors 13A and 76 and thereby causes the drive section 13 and peeling and guiding section 22 to start operating (step ST3).

Specifically, the motor 13A rotates the drive rollers 11Da–11Eb in the direction for paying out the leading edge of the stencil 16*a* from the roll 16. More specifically, the motor 13A rotates the drive rollers 11Da–11Eb in the direction (counterclockwise) opposite to the stencil pay-out direction T and then in the stencil pay-out direction T, as stated earlier. While the roll 16 is caused to rotate in the clockwise direction, opposite to the direction indicated by an arrow, for a moment, the peel roller 23 slips on the roll 16 without rotating clockwise due to the previously mentioned one-way clutch. Likewise, the pay-out roller 24 slips on the roll 16 without rotating counterclockwise due to the one-way clutch.

As shown in FIG. 26, when the drive rollers 11Da–11Eb rotate the roll 16 counterclockwise for paying out the stencil 16*a*, the motor 76 of the peeling and guiding section 22 rotates the peel roller 23 counterclockwise. As a result, the peel roller 23 rotating in contact with the roll 16 peels off the leading edge of the stencil 16*a* from the roll 16. At the same time, the pay-out roller 24 rotating clockwise separates the stencil 16*a* from the roll 16. In this condition, the leading edge of the stencil 16*a* is sequentially conveyed via the nip between the rollers 23 and 24 while being guided by the guide plate 29. The controller 50 determines whether or not the output signal of the first leading edge sensing means 62A is present (step ST4). It is to be noted that the peel roller 23 has a sufficiently smaller coefficient of friction than the pay-out roller 24, and therefore does not brake the rotation of the roll 16. The operation to follow will be readily understood from the operation of the first embodiment.

The embodiment described above has the following advantages. When a new roll 16 is loaded in the roll holding section 11, it is only necessary for the operator to push the roll holder 11A into the device 20 as far as the operative position. Then, the leading edge of the stencil 16*a* is automatically paid out from the roll 16 and cut. Even when the leading edge of the stencil 16*a* has a noticeable curl, it can be surely peeled off from the roll 16 and conveyed. When the stencil 16*a* has a relatively high elasticity, the first embodiment is advantageously applicable due to its inherent structure. By contrast, the second embodiment is capable of surely peeling and conveying the stencil 16*a* even when it is as thin as, e.g., 3 $\mu$m to 30 $\mu$m and low in elasticity.

In the second embodiment, the peel roller 23 and pay-out roller 24 are formed of sponge and rubber, respectively. This is intended to clearly distinguish the rollers 23 and 24 and the stencil 16*a* in respect of the coefficient of friction, and to provide some positional margins between the roll 16 and the rollers 23 and 24 and between the rollers 23 and 24. Alternatively, the rollers 23 and 24 may be formed of the same kind of rubber or synthetic resin so long as they have a preselected difference in the coefficient of friction or so long as the roller 23 can lightly contact the roll 16.

The rollers 23 and 24 are caused to rotate in contact with each other by the roller gears 27 and 28. Alternatively, if the efficient transfer of the rotation of the motor 76 is not an important issue, the roller gears 27 and 28 may be omitted from the roller drive means 33, FIG. 27, in which case the roller 23 will be driven by the roller 24 in contact therewith.

A reference will be made to FIG. 29 for describing a third embodiment of the present invention. As shown, this embodiment is similar to the second embodiment except that it has a master making device 20A having an automatic stencil peeling device 30, and that the peeling device 30 includes a master peeling and guiding section 31. The peeling and guiding section 31 has a fin roller 32 in place of the peel roller 23. The fin roller 32 has a plurality of flexible projections or fins on its circumferential surface. For example, six fins 32*b* formed of rubber may be provided on the periphery of the roller 32 which is affixed to a shaft 32*a*, as illustrated. Each fin 32*b* has a length, as measured in the radial direction of the roller 32, preselected such that at least the radially outermost edge thereof contacts the pay-out roller 24. Of course, the fins 32*b* may be formed of flexible synthetic resin or elastomer by way of example. The roller 32 is rotatably supported by the arms 26 via the shaft 32*a*, as in the second embodiment. The roller 32 is therefore angularly movable about the shaft 24*a* due to its own weight via the shaft 32*a* and arms 26.

The fin roller 32 is constantly located at its contact position close to the contact position of the pay-out roller 24, but downstream of the same with respect to the counterclockwise rotation of the roll 16. A one-way clutch intervenes between the end of one of the arms 26 and the shaft 32*a*. The one-way clutch transfers the rotation of the roller drive means 33 to the fin roller 32 only in the direction for peeling off the stencil 16*a* from the roll 16. The roller 32 is therefore rotatable counterclockwise in order to peel off the stencil 16*a*.

The guide plate 29 adjoins the nip between the pay-out roller 24 and the fin roller 32 at one end and the upstream end of the thermal head 14A in the stencil pay-out direction T at the other end. When the stencil 16*a* peeled off from the roll 16 by the fin roller 32 is conveyed by the pay-out roller 24, the guide plate 29 guides it to the downstream side in the stencil pay-out direction T, i.e., to the end of the head 14A. The guide plate 29 extends in the axial direction of the shaft 24*a* and is affixed to the right and left side walls. Again, to surely guide the leading edge of the stencil 16*a* to the head 14A despite the shift of the above nip, use may be made of another guide plate, not shown, rotatably supported by the arms 25 in the vicinity of the nip at one end and slidable on the upstream end portion of the guide plate 29 at the other end.

Figure 29:
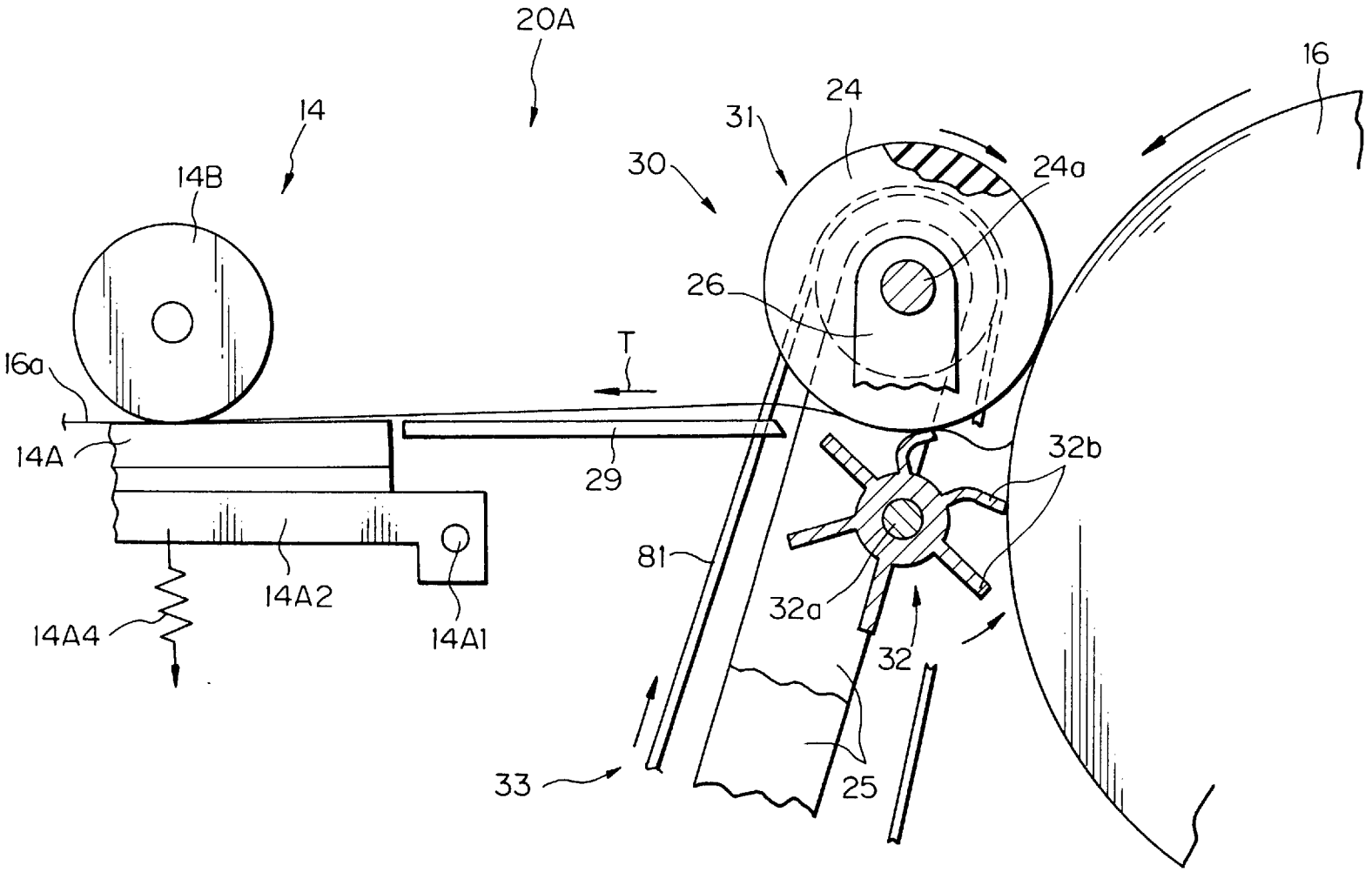
FIG. 29 is a fragmentary partly sectional front view showing a third embodiment of the present invention.

As shown in FIG. 29, the platen pressure control device 14 is located downstream of the peeling and guiding section 31 in the stencil pay-out direction T. The control device 14 is located at a higher level than the position facing the roll holding section 11, thereby being aligned with the stencil pay-out direction T, as in the second embodiment.

The operation of the illustrative embodiment will be described hereinafter, concentrating on the differences between it and the second embodiment. The pay-out of the stencil 16*a* from the roll 16 and the control routine of the controller 50 will not be shown because they are also analogous to the procedures shown in FIGS. 13–18 and FIGS. 19 and 20. The control procedure of this embodiment is practicable only if the peeling and guiding section 12 in the steps 3, 5 and 6 of FIGS. 19 and 20 are replaced with the peeling and guiding section 31.

Referring again to FIG. 14, when the roll holder 11A is inserted into the device 20A, the presser portions 11G of the roll holder 11A cause the support member 72A of the peeling and guiding section 31 to rotate clockwise as viewed in the figure. As a result, the pay-out roller 24 and fin roller 32 are each brought into contact with the particular portion of the roll 16, as shown in FIG. 29.

Assume that the motor 13A of the drive section 13 is rotated after the sequence of steps described previously. Then, the motor 13A rotates the drive rollers 11Da–11Eb in the direction for paying out the leading edge of the stencil 16*a* from the roll 16. More specifically, the motor 13A rotates the drive rollers 11Da–11Eb in the direction (counterclockwise) opposite to the stencil pay-out direction T and then in the stencil pay-out direction T, as stated earlier. While the roll 16 is caused to rotate in the clockwise direction, opposite to the direction indicated by an arrow, for a moment, the fin roller 32 slips on the roll 16 without rotating clockwise due to the previously mentioned one-way clutch. Likewise, the pay-out roller 24 slips on the roll 16 without rotating counterclockwise due to the one-way clutch.

As shown in FIG. 29, when the drive rollers 11Da–11Eb rotate the roll 16 counterclockwise for paying out the stencil 16*a*, the fin roller 32 rotating in contact with the roll 16 peels off the leading edge of the stencil 16*a* from the roll 16. At the same time, the pay-out roller 24 rotating clockwise separates the stencil 16*a* from the roll 16. In this condition, the leading edge of the stencil 16*a* is sequentially conveyed via the nip between the rollers 24 and 32 while being guided by the guide plate 29. The operation to follow will be readily understood from the operation of the second embodiment.

The embodiment described above also has the following advantages. When a new roll 16 is loaded in the roll holding section 11, it is only necessary for the operator to push the roll holder 11A into the device 20A as far as the operative position. Then, the leading edge of the stencil 16*a* is automatically paid out from the roll 16 and cut. Even when the leading edge of the stencil 16*a* has a noticeable curl, it can be surely peeled off from the roll 16 and conveyed. In addition, this embodiment is also capable of surely peeling and conveying the stencil 16*a* even when it is relatively thin and low in elasticity.

The fin roller or peeling means 32 has the flexible projections or fins 32*b* each having a coefficient of friction great enough to peel off the leading edge of the stencil 16*a* from the roll 32. Therefore, as shown in FIG. 29, the fins 32*b* are each bent to an adequate degree on contacting the circumference of the roll 16 and that of the pay-out roller 24. This allows some positional margins to be provided between the circumference of the roller 32 and the circumference of the roll 16 and that of the pay-out roller 24. It follows that the fin roller 32 can be positioned relative to the roll 16 and roller 24 with an even greater margin than the margin available between the rollers 23 and 24 of the second embodiment, enhancing design freedom.

In the first to third embodiments, each of the pay-out roller 71, peel roller 23, pay-out roller 24 and fin roller 32 may, of course, be implemented as a plurality of spaced roller elements mounted on a single shaft.

In the first to third embodiments, the configurations in which the shafts 74 and 174 are supported by the support members 72, 172 and 72A and support the peeler 12A, pay-out rollers 71 and 24 and fin roller 32 shown and described are only illustrative. Specifically, the rollers 71 and 24 are each caused to contact the roll 16 due to its own weight via the associated arms 73 and 25. Alternatively, a tension spring, compression spring or similar biasing means may be engaged with the arm 73 or 25 so as to urge the roller 71 or 24 into contact with the roll 16.

In FIG. 3, an arrangement may be made such that the shaft 74 or 174 is rotatable a predetermined angle relative to the bearing member 82, one of the peeler 12A and pay-out roller 71 is angularly movable relative to the above shaft via, e.g., arms 73, and the other of the peeler 12A and roller 71 is affixed to the above shaft via, e.g., the arms 73. If desired, the pay-out roller 24 or the fin roller 32 may be affixed to the above rotatable shaft via the arms 25.

Assume that the pay-out roller 71 is held in contact with the roll 16, as shown in FIG. 2. Then, a line connecting the center of the shaft 71*a* and that of the shaft 74 and a line connecting the center of the shaft 71*a* and that of the roll 16 should, of course, preferably be substantially perpendicular to each other at all times from the design standpoint. Likewise, as shown in FIGS. 26 and 29, assume that the pay-out roller 24 of the second or third embodiment is held in contact with the roll 16. Then, a line connecting the center of the shaft 24*a* and that of the shaft 74 and a line connecting the center of the shaft 24*a* and that of the roll 16 should preferably be substantially perpendicular to each other at all times. The above positional relations are somewhat roughly shown in the first to third embodiments.

Of course, any one of the first to third modifications may be applied to the second or third embodiment, depending on the object or the application.

A possible modified form of the automatic stencil peeling device 70, 21 or 30 is as follows. The motor 13A, drive gear 13B, driven gear 11D1, pulleys 13C and 13D and belt 13E constituting the stencil drive section 13 are omitted. The roll 16 is supported by the drive rollers 11Da–11Eb in such a manner as to be freely rotatable in the stencil pay-out direction T. The pay-out roller or conveying means 71 or 24 additionally serves to convey the leading edge of the stencil 16*a* peeled off by the peeler 12A, peel roller 23 or fin roller 32, i.e., to rotate the roll 16. In another possible modification, the drive rollers 11Da–11Eb are omitted, and the roll 16 is supported by a shaft or bearings, not shown, in such a manner as to be freely rotatable about the center of the core 16B in the stencil pay-out direction T.

To provide the pay-out roller 71 or 24 with the above function of rotating the roll 16, the weight including the roller 71 or 24 may be increased, or the coefficient of friction of the roller 71 or 24 may be further increased, so that the pressure to act on the roll 16 can be increased. When the roller 71 or 24 is provided with such an additional function, the driving force of the roller drive means 75 or 33 should only be increased.

Figure 30:
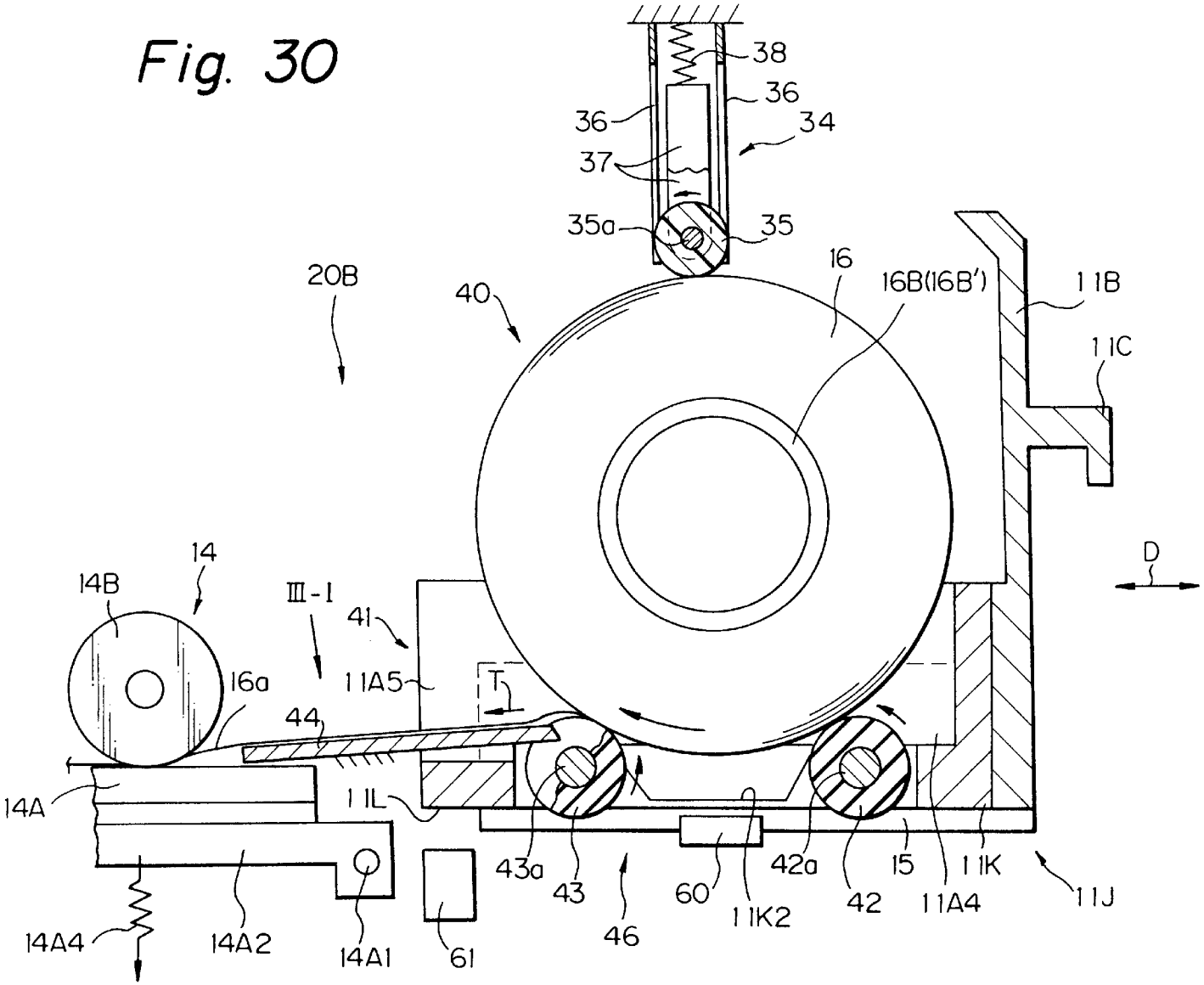
FIG. 30 is a fragmentary partly sectional front view showing a fourth embodiment of the present invention.
Figure 31:
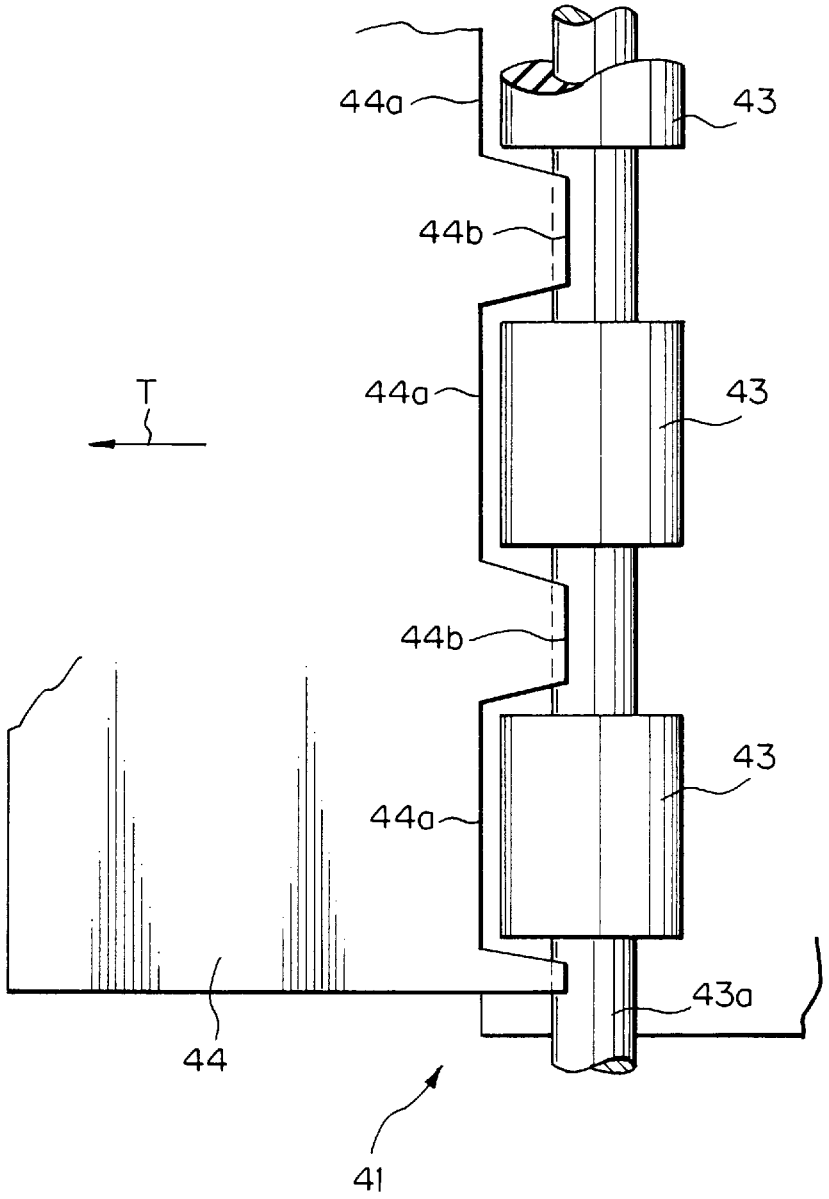
FIG. 31 is a fragmentary plan view of a stencil peeling and guiding section included in the fourth embodiment and as seen in a direction III—I of FIG. 30.

Referring to FIGS. 30 and 31, a fourth embodiment of the present invention is shown. As shown, this embodiment is similar to the first embodiment except that it has a master making device 20B including an automatic stencil peeling device 40. The peeling device 40 is similar to the peeling device 70 of the first embodiment except that it has a roll holding section 11J, a stencil peeling and guiding section 41, and a roller drive section 46. In the peeling device 40, a drive roller 42 contacts the roll 16 at the upstream side in the stencil pay-out direction T and causes it to rotate. An adhesive rubber roller 43 contacts the roll 16 at the downstream side in the direction T and peels off the leading edge of the stencil 16*a* from the roll 16 while conveying it. The drive roller 42 and adhesive roller 43 are each positioned at a preselected center angle with respect to the axis of rotation of the roll 16. A peel and guide plate or peeling and guiding means 44 peels off the leading edge of the stencil 16*a* from the adhesive roller 43 while guiding it to the downstream side in the direction T. The roller drive section or drive means 46 rotates the drive roller 42 and adhesive roller 43.

The roll holding section 11J differs from the roll holding section 11 of the first embodiment mainly in that a box-like roll holder 11K is substituted for the roll holder 11A. The roll holder 11K is void of the presser portions 11G and is formed with a stencil outlet 11A5 in its upper portion. A reflection surface 11L is provided on the underside of the roll holder 11K beneath the stencil outlet 11A5. The stencil set sensing means 61 is responsive to the reflection surface 11L. The rest of the construction of the roll holding section 11J is the same as shown in FIGS. 4 and 5. The roll holder 11K is formed with a recess 11K2 in its bottom wall. The recess 11K2 plays the same role as the recess 11A2 shown in FIG. 4.

The peeling and guiding section 41 comprises a drive roller 42, an adhesive roller 43 and a peel and guide plate 44.

In the peeling and guiding section 41, the drive roller 42 is mounted on a shaft 42*a* and rotatably supported by the bottom wall portion of the roll holder 11K. The drive roller 42 is formed of rubber or similar material having a preselected coefficient of friction which allows the roller 42 to rotate the roll 16 in contact therewith. The drive roller 42 is implemented as a plurality of spaced roller elements mounted on the single shaft 42*a*. The adhesive roller 43 is mounted on a shaft 43*a* and also rotatably supported by the bottom wall portion of the roll holder 11K. The adhesive roller 43 has an adequate degree of adhesion capable of playing the role stated above. It is to be noted that the word "adhesion" refers to attraction also. The adhesive roller 43 is also implemented as a plurality of spaced roller elements mounted on the single shaft 43*a*.

The drive roller 42 and adhesive roller 43 are each positioned at a preselected center angle with respect to the axis of rotation of the roll 16, as stated earlier. Therefore, even when the core 16B of the roll 16 shows itself due to the consumption of the stencil 16*a* and drops, as viewed in FIG. 30, due to its own weight, the two rollers 42 and 43 evenly support the circumference of the core 16B.

As shown in FIGS. 30 and 31, the peel and guide plate 44 extends toward the shaft 43*a* and has its opposite ends supported by the right and left side walls of the master making device 20B. The plate 44 has peeling portions 44*a* facing the roller elements of the adhesive roller 43. The peeling portions 44*a* are each spaced a preselected distance from the circumference of the roller elements 43. Further, the plate 44 has projections 44*b* alternating with the peeling portions 44*a* and positioned between the circumference of the roller elements 43 and the shaft 43*a*. The projections 44*b* overlap with the shaft 43*a*, as seen in a plan view. The plate 44 is implemented by sheet metal or resin by way of example and has its upper surface suitably coated with fluorine-contained resin or similar parting agent.

The major components of the roller drive section 46 are the drive roller 42, adhesive roller 43, motor 13A, drive gear 13B, driven gear 11D1, pulleys 13C and 13D, belt 13E, and roll rotation sensing means 13F. The rollers 42 and 43 are parenthesized in FIG. 5. The following description will concentrate on the differences between the roller drive section 46 and the stencil drive section 13 of the first embodiment.

The motor 13A is controlled in the same manner as in the second embodiment such that the drive roller 42 and adhesive roller 43 rotate the roll 16 at a preselected range of peripheral speeds. Alternatively, the motor 13A may be implemented as a DC motor, stepping motor or similar motor of the type rotating at substantially a constant speed. The pulleys 13D and 13C are respectively affixed to one end of the shaft 42*a* and one end of the shaft 43*a*. The belt 13E is passed over the pulleys 13C and 13D.

The driven gear 11D1 is mounted on the shaft 43*a* of the adhesive roller 43. When the roll holder 11K (parenthesized in FIG. 5) is inserted into the device 20B as far as its operative position, the driven gear 11D1 meshes with the drive gear 13B. The rotation of the motor 13A is transmitted to the pulley 13D via the drive gear 13B, driven gear 11D1, pulley 13C and belt 13E. As a result, the adhesive roller 43 an d drive roller 42 are rotated in the same direction as each other, i.e., counterclockwise as viewed in FIG. 30.

As shown in FIG. 30, an auxiliary roll support section 34 is positioned such that it overlies the roll 16 when the roll holder 11K is brought to its operative position. The auxiliary roll support section 34 reduces the oscillation of the roll 16 in the up-and-down direction. Specifically, a driven roller 35 contacts the roll 16 under a preselected pressure when the roll holder 11K is brought to the operative position. The driven roller 35 has a shaft 35*a* rotatably supported by the lower ends of a pair of roller arms 37. A compression spring 38 is loaded between the top of each roller arm 37 and a stationary member mounted on the right side wall so as to constantly bias the driven roller 35 against the roll 16. A pair of arm guides 36 has their upper ends affixed to the above stationary member and guide the movement of the roller arms 37 in the up-and-down direction.

The operation of this embodiment is as follows. The pay-out of the stencil 16*a* from the roll 16 and the operation of the controller 50 will be readily understood from the operation of the first embodiment described with reference to FIGS. 13–18 and FIGS. 19 and 20. This embodiment is practicable only if the roller drive section 46 and peeling and guiding section 41 are respectively substituted for the stencil drive section 13 and peeling and guiding section 12 in the steps 3, 5 and 6 of FIGS. 19 and 20.

Referring again to FIG. 14, when the roll holder 11K is inserted into the device 20B as far as its operative position, the stencil sensing means 60 senses the roll 16 having a sufficient diameter. At the same time, the stencil set sensing means 61 senses the reflection surface 11L of the roll holder 11K. The resulting outputs of the sensing means 60 and 61 are sent to the controller 50. When the cut start switch is pressed on the operation panel 63, the controller 50 executes the routine shown in FIG. 19. In FIG. 19, the controller 50 determines whether or not the output signals of the sensing means 60 and 61 are present (steps ST1 and ST2). If the answers of the steps ST1 and ST2 are Y, the controller 50 causes the roller drive section 46 to rotate the motor 13A and thereby causes the roller drive section 46 and peeling and guiding section 41 to start operating (step ST3).

Specifically, the motor 13A rotates the adhesive roller 43 and drive roller 42 positioned in the cavity 11A4 of the roller holder 11K to rotate in the direction for paying out the leading edge of the stencil 16*a*. The rollers 42 and 43 rotate the roll 16 in the direction for paying out the stencil 16*a*, i.e., clockwise. The adhesive roller 43 peels off the leading edge of the stencil stencil 16*a* from the roll 16 due to its adhesion. At the same time, the adhesive roller 43 and drive roller 42 cooperate to convey the leading edge of the stencil 16*a* adhered to the roller 43 in the stencil pay-out direction T. The projections 44*b* and peeling portions 44*a* of the peel and guide plate 44 cooperate to peel off the leading edge of the stencil 16*a* from the adhesive roller 43. As a result, the leading edge of the stencil 16*a* is guided onto the plate 44. The controller 50 determines whether or not the output signal of the first leading edge sensing means 62A is present (step ST4). This is followed by the same procedure as in the first embodiment.

As stated above, when the roll holder 11K is loaded with a fresh roll 16, the illustrative embodiment is capable of automatically paying out the leading edge of the stencil 16*a* from the roll 16 only if the roll holder 11K is inserted into the device 20B. Also, the embodiment is capable of surely peeling off and conveying the leading edge of the stencil 16*a* even when its leading edge has a noticeable curl.

The embodiment, like the second and third embodiments, can surely peel off and convey the stencil 16*a* even when it is relatively thin and low in elasticity. Further, because two drive means, e.g., the stencil drive section 13 and roller drive means 75 or the stencil drive section 13 and roller drive means 33 are not necessary, the embodiment is simple and light weight. In addition, because peeling means and conveying means are absent, the embodiment reduces the distance between the adhesive roller 43 and the master making means and is therefore miniature.

The roller drive section 46 may be so modified as to drive only one of the adhesive roller 43 and drive roller 42, in which case the other of the rollers 43 and 42 will be driven by the roll 16 on a friction basis. The auxiliary roll support section 34 is omissible, depending on the peripheral speed of the roll 16 and the degree of support available with the adhesive roller 43 and based on adhesion. Also, the auxiliary roll support section 34 is omissible if the protruding ends of the core 16B of the roll 16 and the notches 11A6 are engaged in an adequate configuration.

The driven roller 35 of the auxiliary roll support section 34 may be implemented as a drive roller rotated by a motor, not shown, via a belt or similar means, not shown, so as to rotate the roll 16. In such a case, the adhesive roller 43 and roller 42 will be driven by the roll 16 due to friction based on gravity. In this configuration, the drive roller 35 can directly rotate the roll 16 in the direction for paying out the stencil 16*a* in contact with the roll 6. This simplifies the drive transmission mechanism for paying out the stencil 16*a* and further reduces the size of the motor.

If desired, the stencil sensing means 60 and stencil set sensing means 61 may be replaced with a sensor mounted on the device 10 and responsive to the movement of the closure member 11B to its closing position. Then, the sensor will be used as the operation sensing means for determining the time when the stencil 16*a* should begin to be paid out.

In the first to fourth embodiments, the stencil set sensing means 61 plays the role of the operation sensing means for causing the stencil drive section 13 to start paying out the stencil 16*a*. Alternatively, the stencil sensing means 60 may play the above role. This is because the stencil sensing means 60 determines whether or not the roll 16 is present, and in addition determines whether or not the roll 16 loaded in the cavity 14A4 is set at a preselected position in the device 10, 20, 20A or 20B.

In the first to third embodiments, if the above advantages are not desired, the drive rollers 11Da–11Eb may be replaced with the drive rollers 11D and 11E simply elongate in the axial direction as shown in, e.g., FIG. 36.

The above sensing means serving as the operation sensing means is omissible if the operation set key 63*a*, FIG. 12, is provided on the operation panel 63 to allow the operator to set the time when the stencil drive means 13 starts operating.

In this case, the operator will press the key 63*a* after pushing the roll holding section 11 or 11J into the device 10, 20, 20A or 20B. Then, the controller 50 will cause the drive section 13 and the pay-out roller drive means 75 of the peeling and guiding section 12 or the drive section 13 and the roller drive means 33 of the peeling and guiding section 21 or 31, or the roller drive section 46 to start operating in response to a signal output from the key 63*a*.

In the first to fourth embodiments, the platen pressure control section 14 performs the operation for removing the creases of the stencil 16*a*. Specifically, when the first leading edge sensing means 62A senses the leading edge of the stencil 16*a*, the thermal head 14A and platen roller 14B are brought into and out of contact intermittently. However, this smoothing operation is not essential if, e.g., the leading edge of the stencil 16*a* is conveyed in parallel to the axial direction of the platen roller 14B, i.e., if the stencil 16*a* is free from creases. On the other hand, an arrangement may be made such that the head 14A and platen roller 14B remain in contact until the second leading edge sensing means 62B senses the leading edge of the stencil 16*a*, and the cam motor 14A30 is driven in response to the output signal of the sensing means 62B having sensed the leading edge, thereby causing the head 14A and platen roller 14B to contact intermittently for smoothing the stencil 16*a*. To smooth the stencil 16*a*, the contact of the head 14A and platen roller 14B should only be cancelled at least once.

As stated above, in each of the first to fourth embodiments, the leading edge of the stencil 16*a* is paid out from the roll 16, 16N or 16L loaded in the roll holding section 11 or 11J by the stencil drive section 13 and roller drive section 46. The leading edge of the stencil 16*a* is guided toward the thermal head 14A by the upper surface of the peeler 12A and the guide plate 29 or 44. This realizes the automatic feed of the stencil 16*a* from the roll 16. Therefore, to set a fresh roll 16 in the device 10, 20, 20A or 20B, the operator should only pull the roll older 11A or 11K out of the device 10, 20, 20A or 20B and then push it into the same device. As soon as the roll holder 11A or 11K reaches its operative position in the device 10, 20, 20A or 20B, the leading edge of the stencil 16*a* is automatically paid out from the roll 16 to a stand-by position. The printing operation is therefore simple and frees the operator from troublesome work. Further, the roll holder 11A or 11K can be pulled out and inserted into the device 10, 20, 20A or 20B without requiring the document reading device disposed above the device 10, 20, 20A or 20B to be slid or otherwise displaced. This simplifies the structure of a printer and reduces the weight and cost, compared to a printer using a conventional master making device.

In the first to third embodiments, the roll 16 is rotated in the direction opposite to the stencil pay-out direction T and then rotated in the direction T. Therefore, whatever the position of the leading edge of the stencil 16*a* on the roll 16 may be, the leading edge of the stencil 16*a* can be surely brought to a position where it faces the peeling means. This insures the sure peeling and separation of the leading edge of the stencil 16*a* from the roll 16.

In the first to fourth embodiments, the thermal head 14A and platen roller 14B contact each other when the leading edge of the stencil 16*a* arrives at the position where they are located. Therefore, the leading edge of the stencil 16*a* is not obstructed at all until it reaches the above position. That is, the stencil 16*a* is nipped on arriving the position where a platen pressure can be surely exerted. In addition, the stencil 16*a* can be smoothed before plate making.

In the each of the first to fourth embodiments, the friction members 11A1 or 11A1' position the roll 16 or 16N in contact with its ends t in the widthwise direction, while exerting resistance when the stencil 16*a* is paid out. This not only facilitates the loading of the roll 16 or 16N in the roll holder 11A or 11K, but also frees the stencil 16*a* from creases when it is paid out from the roll 16 or 16N, thereby obviating defective printing ascribable to creases. Further, the ends of the core 16B protruding from the ends t of the roll 16 are rotatably supported by the notches 11A6. Therefore, when the roll 16 is of the type having the core 16B with such protruding ends, it is possible to position the roll 16 in the roll holder 11A or 11K by guiding the core 16B.

Figure 32:
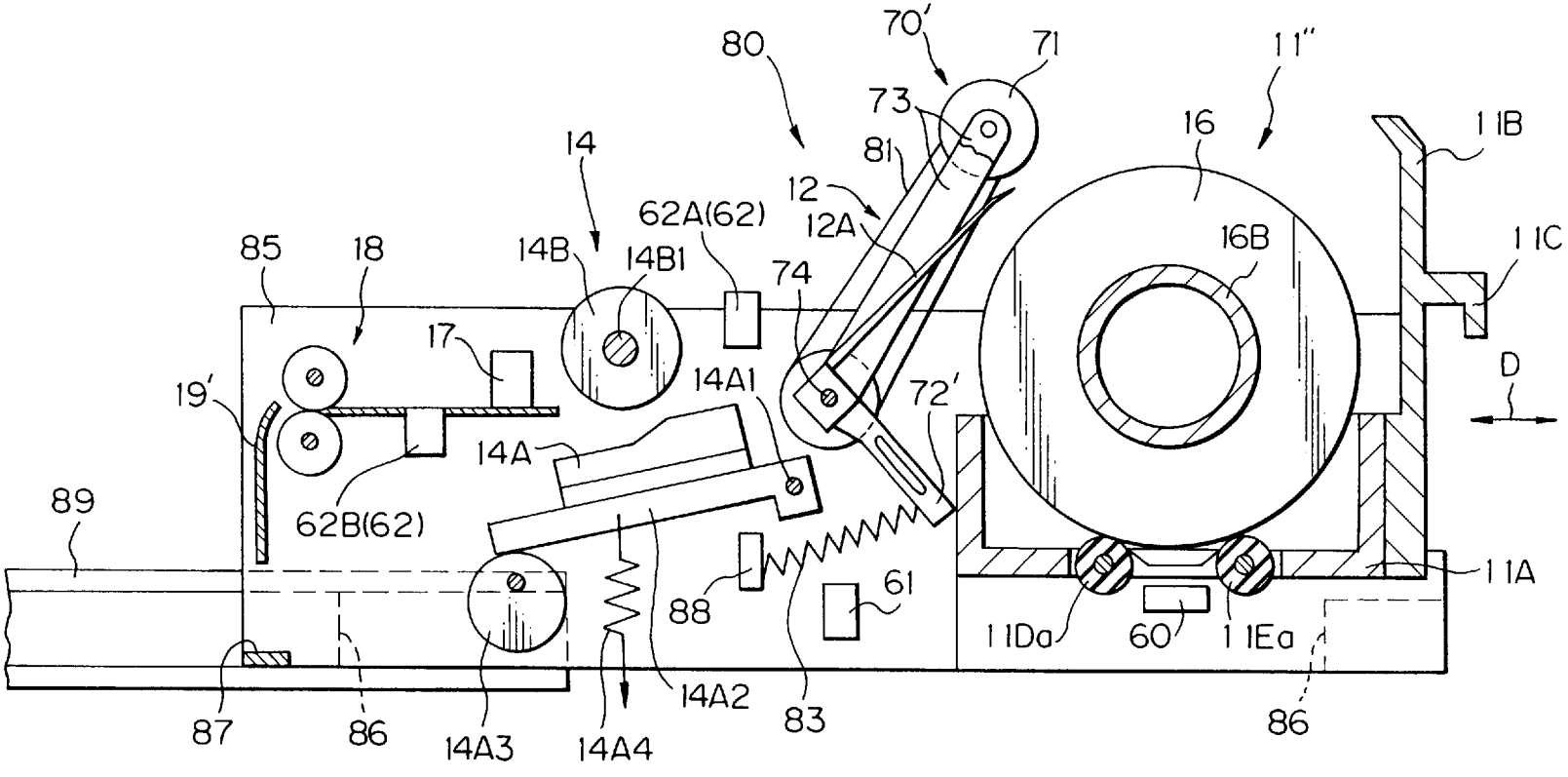
FIG. 32 is a sectional front view showing a fifth embodiment of the present invention.
Figure 33:
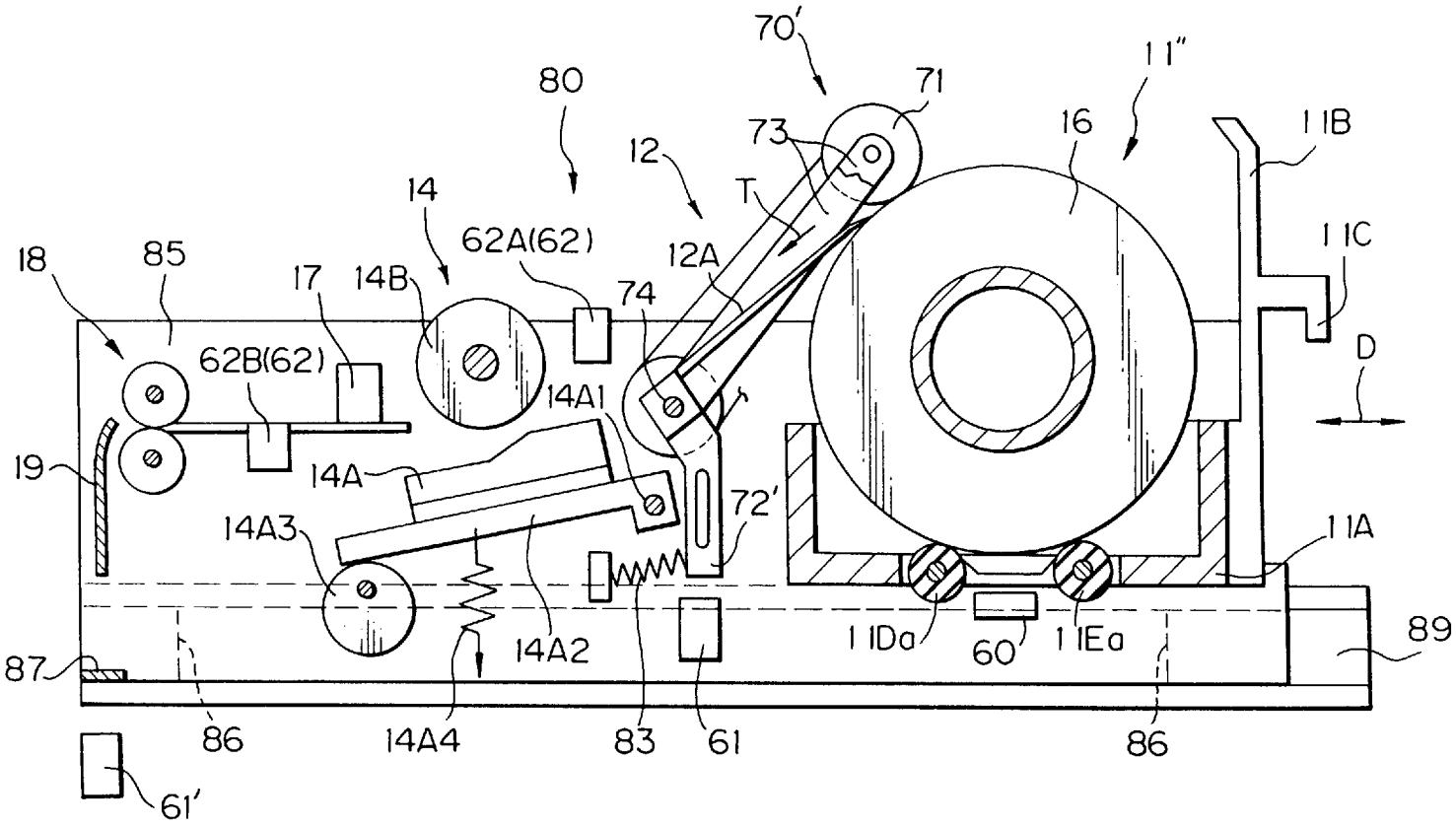
FIG. 33 is a sectional front view showing a master making unit included in the fifth embodiment and brought to its operative position.
Figure 34:
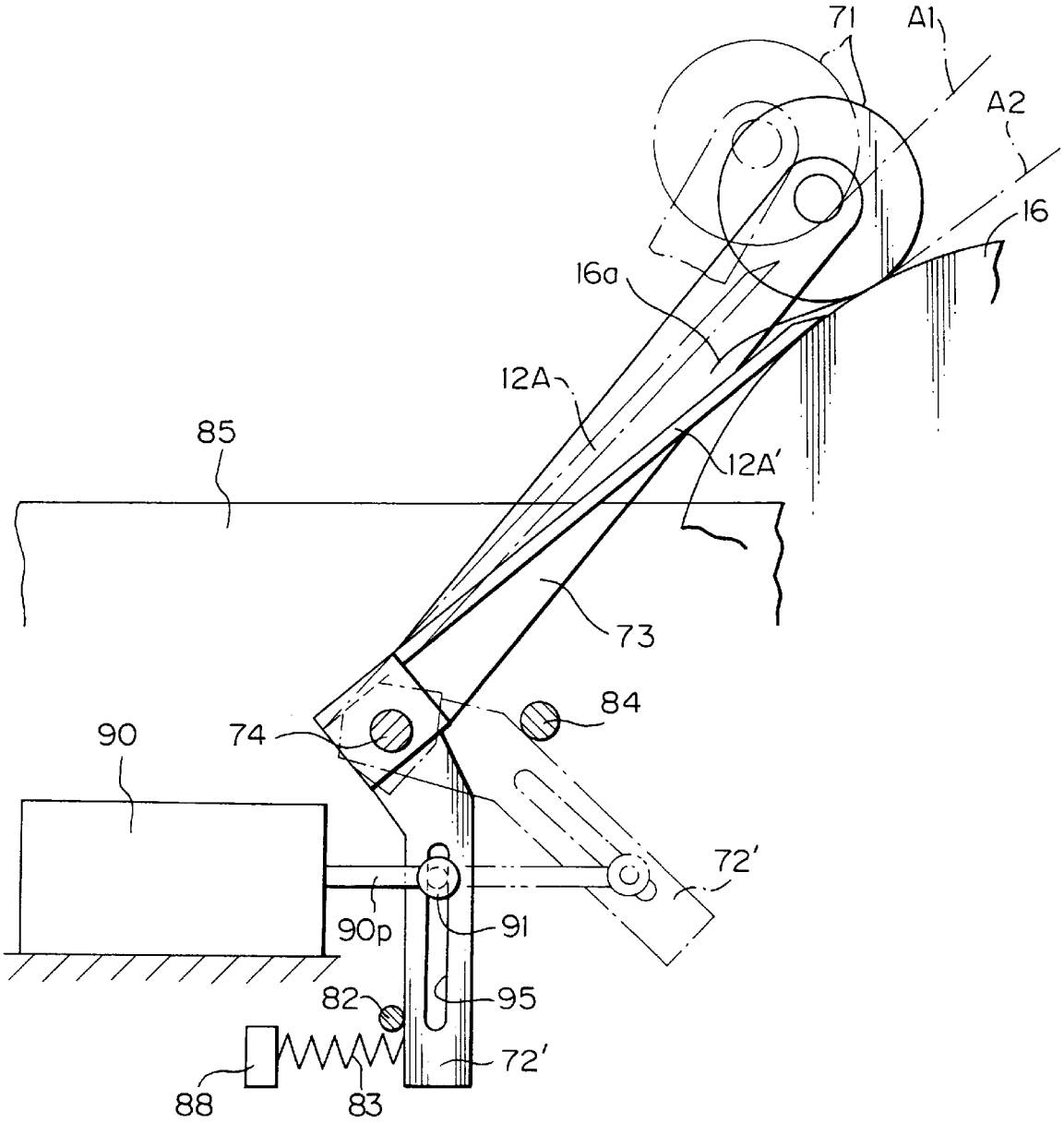
FIG. 34 is a fragmentary sectional front view showing an electrically interlocked moving mechanism included in the fifth embodiment.

Referring to FIGS. 32–34, a fifth embodiment of the present invention will be described. This embodiment differs from the first embodiment in that it has a master making unit 80, as distinguished from the master making device, removably mounted to the body of the stencil printer. As shown, the master making unit 80 has a roll holding section 11" and an automatic stencil peeling device 70' in addition to the previously stated master making means and cutting means. The peeling device 70' is substantially identical in configuration with the peeling device 70. The roll holding section 11" like the roll holding section 11, has stencil storing means and allows the roll 16 to be set therein, but the section 11" is not movable. In this embodiment, the so-to-speak mechanically interlocked mechanism for rotating the support member 72 is replaced with an electrically interlocked mechanism.

The construction and operation of the fifth embodiment will be described specifically, concentrating on the differences between the first embodiment and the fifth embodiment. The master making unit 80 has a right and a left side wall 85 supporting the right and left walls of the roll holder 11A of the roll holding section 11", shaft 74 rotatably supporting a support member 72', shaft 14A1 of the head support arm 14A2, shaft 14B1 of the platen roller 14B, shaft of the eccentric cam 14A3, shafts of the rollers 18, mechanism for driving the cutting means, etc. The unit 80 is bodily movable in the right-and-left direction, as indicated by an arrow D in FIG. 32. Four rectangular projections 86 similar to the projections 11A5 shown in, e.g., FIG. 4 protrude from the front and rear ends of the right and left side walls 85.

The roll holding section 11" differs from the roll holding section 11 in that its right and left side walls are respectively affixed to the right and left side walls 85 of the unit 80, and in that it does not have the presser portions 11G. The right side wall 85 is formed with holes, not shown, for allowing the shafts of the drive rollers 11Da–11Eb to protrude to the outside.

A solenoid 90 is mounted on the right side wall 85 for selectively rotating the support member 72', functioning in the same manner as the presser portions 11G. A stepped pin 91 is studded on the free end of a plunger 90*p* extending from the solenoid 90. The stepped pin 91 is loosely fitted in an elongate slot 95 formed in the support member 72' in the up-and-down direction. Stops 82 each protrudes inward from the respective side wall 85 in order to stop the support member 72' at its upright position indicated by a solid line. Spring seats 88 each protrudes inward from the respective side wall 85. Compression springs 83 are each anchored at one end to the respective spring seat 88 and at the other end to the support member 72'. If desired, the compression springs 83 may be replaced with a similar compression spring loaded between the plunger 90*p* of the solenoid 90 and the side wall of the support member 72'.

The right and left side walls, not shown, of the printer body are respectively provided with channel-like guide rails 89 facing each other at their open ends. The projections 86 of the right and left side walls 85 are respectively slidably received in the right and left guide rails 89. Second stencil set sensing means 61' similar to the stencil set sensing means 61 is positioned below and slightly inward of the front end of the right guide rail 89. A reflection surface 87 (indicated by hatching) similar to the reflection surface of the first embodiment is provided on the underside of the front end of the right side wall 85. A guide 19' is similar to the guide 19 except that it is elongate in order to surely feed the leading edge of the stencil 16*a* held in its stand-by condition to the clamper 2D.

With the above configuration, the master making unit 80 is selectively movable to its operative position defined in the printer body or to its inoperative position remote from the operative position. At the operative position, the unit 80 allows the stencil 16*a* to be paid out from the roll 16. At the inoperative position, the unit 80 allows the roll 16 to be loaded in its roll holding section 11". The motor 13A included in the stencil drive section 13 is mounted on the right side wall of the printer body together with the other parts in the same manner as in the first embodiment.

The operation of the controller 50 unique to this embodiment is as follows. When the master making unit 80 is brought to the operative position, the second stencil set sensing means 61' senses the reflection surface 87 of the right side wall 85 and sends its output to the controller 50. In response, the controller 50 outputs a command signal for turning on the solenoid 90. The solenoid 90 pulls its plunger 90*p* against the action of the compression springs 83. As a result, as shown in FIG. 34, the support member 72' is rotated from its position indicated by a dash-and-dot line to its upright position indicated by a solid line. This causes the peeler 12A and pay-out roller 71 to rotate clockwise and contact the roll 16. This is followed by the same procedure as described in the first embodiment. Specifically, the motor 13A is energized to rotate the drive rollers 11Da–11Eb in order to peel off the stencil 16*a* from the roll 16. The stencil 16*a* is continuously paid out until its leading edge has been sensed by the first leading edge sensing means 62A. When the second leading edge sensing means 62B senses the leading edge and sends its output to the controller 50, the controller 50 drives the platen pressure control section 14 in order to cause the master making means to nip the stencil 16*a*.

When the master making unit 80 is moved from the operative position to the inoperative position, the controller 50 drives the platen pressure control section 14 in order to cause the master making means to release the stencil 16*a*.

As stated above, in the illustrative embodiment, the master making unit 80 is slidable between the operative position and the inoperative position. Assume that a non-slidable document reading section is arranged on the top of the printer. Then, when the stencil 16*a* jams the transport path at, e.g., the platen roller 14B, cutting device 17 or rollers 18, the operator can move the unit 80 to the inoperative position and then deal with the jam surely and easily.

When the master making unit 80 is moved into the printer body as far as the operative position, the peeler 12A is caused to adjoin or contact the roll 16 and peels off the leading edge of the stencil 16*a*. The mechanism for so moving the peeler 12A may, of course, be implemented as a mechanically interlocked mechanism as in the first embodiment and as distinguished from the above electrically interlocked mechanism including the solenoid 90.

Figure 35:
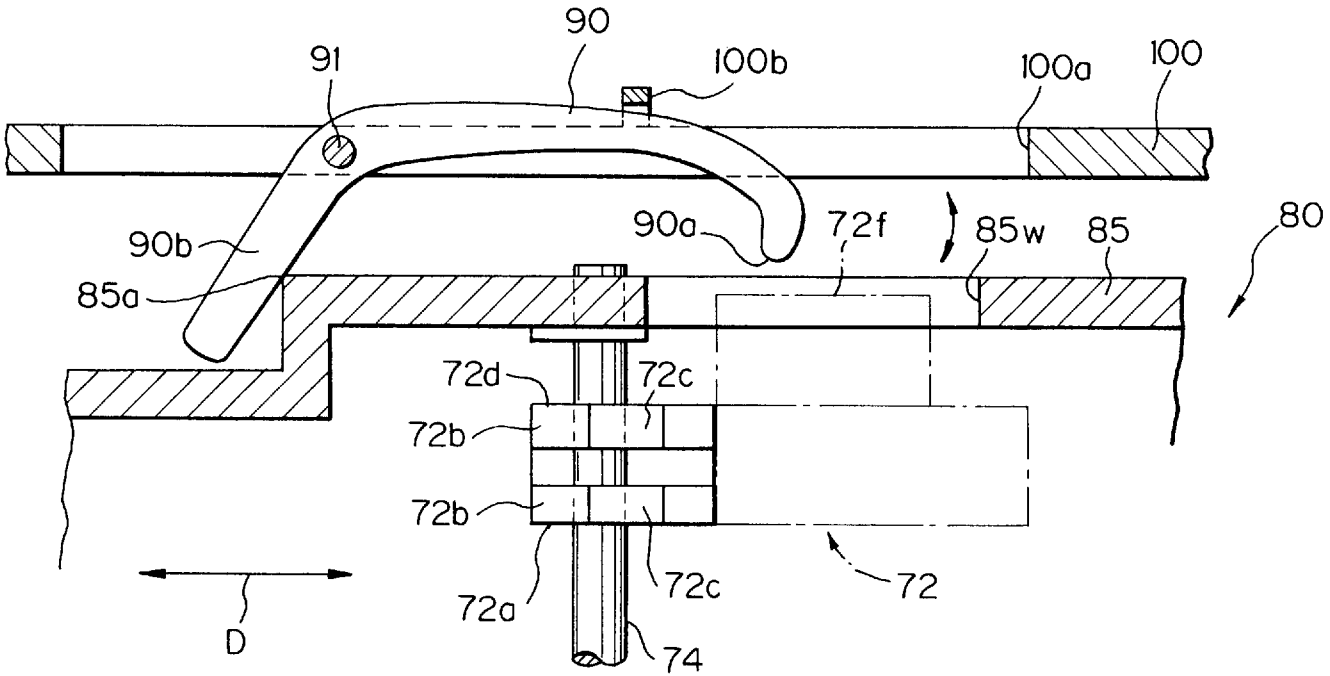
FIG. 35 is a fragmentary sectional front view showing a mechanically interlocked moving mechanism also included in the fifth embodiment.

FIG. 35 shows a specific configuration of the mechanically interlocked mechanism. In FIG. 35, the peeler 12A and its associated members are not shown for the sake of illustration. As shown, a lever 90 having an angled shape, a s seen in a plan view, is mounted on the right side wall 100 of the printer body and rotatable about a shaft 91. The lever 90 has a greater leverage at its rear portion than at its front portion so as to be displaceable over a broad range. The rear wall of the support member 72 identical with the member 72 of the first embodiment partly protrudes to the right in the form of an abutment 72*f*. The lever 90 has at its rear end a lug 90*a* protruding inward and allowing the lever 90 to easily contact the abutment 72*f*. The right side wall 85 of the master making unit 80 has a stepped portion 85*a* at its downstream side. The stepped portion 85*a* is engageable with the front end 90*b* of the lever 90. The lug 90*a* of the lever 90 selectively contacts the abutment 72*f* or the rear wall of the support member 72.

In operation, when the master making unit 80 is brought to its operative position, the stepped portion 85*a* of the unit 80 abuts against the front end 90*b* of the lever 90 and causes the lever 90 to rotate clockwise, as seen in a plan view. Then, the lug 90*a* of the lever 90 pushes the rear wall of the support member 72 held in the position shown in FIG. 32. As a result, the support member 72 is moved to the upright position shown in FIG. 33, causing the peeler 12A and pay-out roller 71 to contact the roll 16. A torsion coil spring, not shown, is anchored to the shaft 91 of the lever 90 and constantly biases the lever 90 counterclockwise, as seen in a plan view. Hence, when the unit 80 is moved away from the operative position, the lug 90*a* of the lever 90 is retracted and prevented from contacting the stepped portion 85*a* and other portions of the unit right wall 85. The right side wall 100 of the printer body is formed with an opening 100*a* for allowing the lever 90 to perform the above movement. The unit right side wall 85 is formed with a window 85*w* having the same function as the opening 110*a*. A stop 110*b* restricts the counterclockwise movement of the lever 90 ascribable to the torsion coil spring.

In the fifth embodiment and the specific arrangement shown in FIG. 35, the master making unit 80 consists of the automatic stencil peeling device 70', roll holding section 11', master making means, and cutting device 17 including the cutting means. Alternatively, the cutting device 17 and rollers 18 may be mounted on the printer body. The crux is that the unit 80 has at least the roll holding section 11" and master making means. In addition, the second to fourth embodiments and the modifications of the first embodiment may be suitably combined and constructed into a master making unit.

In the fifth embodiment and the arrangement of FIG. 35, the second stencil set sensing means 61' serves as one of the operation sensing means. If desired, the sensing means 61' may be replaced with a reflection type or transmission type photosensor or a microswitch mounted on the printer body and for sensing the upright position of the support member 72 when the master making unit 80 is brought to the operative position. Alternatively, a microswitch or similar operation sensing means may be located upstream of the sensing means 61' in the stencil transport direction in order to sense the unit 80 arrived at a position slightly short of the operative position.

In the first to fifth embodiments and the first to third modifications, the platen roller 14B is rotated via, e.g., the drive transmission mechanism. Alternatively, the platen roller 14B may be driven by the stencil 16*a* being conveyed. For example, the rollers 18 located downstream of the platen roller 14B may pull the stencil 16*a* from the roll 16 such that the platen roller 14B is driven by the stencil 16*a* while contacting the thermal head 14A.

In the first to fifth embodiments and the first to third modifications, the stencil 16*a* may be replaced with a stencil in the form of a roll and consisting substantially only of a thermoplastic resin film which is as thin as 1 micron to 3 microns. It is to be noted that the stencil consisting substantially only of a thermoplastic resin film refers not only to a stencil implemented only by such a film, but also to a stencil implemented by a thermoplastic resin film containing a trace of an antistatic agent or similar additive or by a thermoplastic resin film having at least one overcoat layer or similar thin layer on at least one of its opposite major surfaces.

The master making means using the thermal head 14A and platen roller 14B rotatable while pressing the stencil 16*a* against the head 14A may be replaced with, e.g., flash type or laser type master making means.

Moreover, the master making device of the present invention is applicable not only to the stencil printer shown and described, but also to a printer of the type feeding ink from the outside of a print drum and taught in, e.g., Japanese Patent Laid-Open Publication No. 7-17013.

In addition, any one of the devices 70, 21, 30 and 40 for automatically peeling off the leading edge of the stencil 16*a* may alternatively be implemented as a device for automatically peeling off the leading edge of any other sheet from a roll. For example, the sheet may be a film of polyvinylidene, polyethylene or similar synthetic resin or a sheet of thin paper.

In summary, it will be seen that the present invention provides an automatic stencil peeling device and a master making device implemented therewith which have the following unprecedented advantages.

(1) Conveying means rotates a stencil roll in accordance with the varying diameter of the roll while peeling means automatically peels off the leading edge of a stencil from the roll. The leading edge of the stencil peeled off by the peeling means is automatically conveyed by the conveying means. Therefore, even when the leading edge of the stencil has a noticeable curve, it can be automatically and surely peeled off and conveyed without slackening. Further, the peeling means is prevented from deteriorating and becoming unable to peel off the stencil. When the peeling means is implemented as a flat peeler, its peeling end is prevented from curling.

(2) The peeling end of the peeler contacts the roll due to the weight of the peeler, so that the stencil can be paid out without resorting to any special biasing means.

(3) The peeler includes a thin elastic portion. Hence, when the peeler contacts the roll, the thin portion elastically deforms and prevents an unexpected pressure from acting on the roll. The stencil is therefore free from scratches or breakage.

(4) As seen in a plan view, the peeler is sequentially flared from the upstream side to the downstream side in a stencil pay-out direction. With this configuration, the peeler first peels off the intermediate portion of the leading edge of the stencil in the widthwise direction of the stencil, and then sequentially peels off the other portion of the leading edge up to the opposite side edges while guiding the peeled portion. This prevents the peeler from catching the leading edge of the stencil and thereby obviates jams.

(5) The peeling end of the peeler includes an inclined portion inclined toward the roll. The inclined portion reduces the contact area of the peeler with the stencil as far as possible and thereby prevents the peeler from contacting the stencil more than necessary. At the same time, the inclined portion facilitates the guide of the leading edge of the stencil being peeled from the roll.

(6) Roller drive means rotates a peel roller and/or a high friction pay-out roller and thereby rotates the roll. The peel roller has a coefficient of friction which allows the roller to peel off the stencil from the roll in contact with the roll. The peel roller therefore automatically and surely peels off the leading edge of the stencil from the roll. The pay-out roller has a greater coefficient of friction than the peel roller and held in contact with the peel roller. In this condition, the pay-out roller automatically pays out the stencil peeled off from the roll. Hence, the leading edge of the stencil can be automatically and more surely peeled off and conveyed even when it has a noticeable curl. Further, because the flat peeler is not necessary, the leading edge of the stencil can be surely peeled off and conveyed even when the stencil is relatively thin and low in elasticity.

(7) The peel roller is implemented as a fin roller having a plurality of flexible fins protruding from its circumference. The fins each has a coefficient of friction necessary for peeling off the leading edge of the stencil from the roll. When the fin roller is rotated, the fins elastically deforms on contacting the roll. This easily allows the fins to lightly contact the roll without braking the rotation of the roll in the pay-out direction. Therefore, the leading edge of the stencil can be automatically and more surely peeled off and conveyed. In addition, the fin roller can be positioned relative to the pay-out roller and roll with margins, so that free layout in design is promoted.

(8) The peel roller is implemented as a sponge roller while the high friction pay-out roller is implemented as a rubber roller. It is therefore possible to easily set the coefficient of friction of the sponge roller and that of the rubber roller.

(9) Because rotary drive means rotates the roll, the load on the conveying means for rotating the roll is reduced, and the conveying means contributes more to the conveyance of the stencil. This allows the leading edge of the stencil to be automatically and more surely peeled off and conveyed without slackening even when it has a noticeable curl. In addition, the peeling means is free from deterioration.

(10) The roller drive means rotates a drive roller and/or an adhesive roller and thereby rotates the roll. While the leading edge of the stencil is conveyed by the drive roller and/or the adhesive roller in rotation, it is adhered to the adhesive roller and pealed off from the roll thereby. The leading edge of the stencil conveyed by the adhesive roller is peeled off from the roll by peeling and guiding means. Further, because a single roller drive means is capable of rotating the drive roller and/or the adhesive roller, the device is simple and light weight. In addition, because peeling means and conveying means are not necessary, the distance between the adhesive roller and the master making means is reduced with the result that the device is miniaturized.

(11) To set a fresh stencil roll in the roll holding section, the operator should only pull the holding section out of the master making device. After the operator has set the roll in the roll holding section and pushed the holding section into the device, the rotary drive means rotates the roll in the direction for paying out the stencil toward the master making means. At the same time, the peeling means approaches or contacts the roll in accordance with the varying diameter of the roll in order to automatically peel off the leading edge of the stencil while the conveying means contacts the roll. As a result, the leading edge of the stencil peeled off by the peeling means is paid out toward the master making means. Consequently, the stencil is surely paid out to its stand-by position. The printing operation is therefore simple and frees the operator from troublesome work.

Further, the roll holding section can be pulled out and inserted into the device without requiring a document reading device disposed above the device to be slid or otherwise displaced. This simplifies the structure of a printer and reduces the weight and cost, compared to a printer using a conventional master making device. In addition, in a printer of the type having a n unmovable image reading section, a stencil jam occurred on the stencil transport path can be surely and easily removed by moving the roll holding section away from its operative position.

(12) When the roll holding section with a fresh roll is inserted into the master making device or when the master making unit with such a roll holding section is inserted into the printer, the rotary drive means rotates the roll in the direction opposite to the stencil pay-out direction and then in the stencil pay-out direction. Therefore, whatever the position of the leading edge of the stencil on the roll may be, the leading edge can be surely brought to a position where it faces the peeling means. This insures the peeling and separation of the leading edge of the stencil from the roll. The stencil can be smoothed before plate making.

(13) The peeling means and conveying means each adjoins or contacts the roll in interlocked relation to the movement of the roll holding section to its operative position and peels off the leading edge of the stencil from the roll. The peeling end of the peeling means and the end of the conveying means are therefore prevented from abutting against the roll when the roll has its maximum diameter. This would otherwise obstruct the insertion of the roll into the roll holding section and damage the surface of the roll.

(14) Assume that the roll holding section loaded with a fresh roll is inserted into the device as far as its operative position. Then, the roller drive means causes the drive roller and/or the adhesive roller to rotate the roll in the stencil pay-out direction. At the same time, the peeling means approaches or contacts the roll in accordance with the varying diameter of the roll in order to automatically peel off the leading edge of the stencil. As a result, the leading edge of the stencil peeled off by the peeling and guiding means is paid out toward the master making means. Consequently, the stencil is surely paid out to its stand-by position. The printing operation is therefore simple and frees the operator from troublesome work. Further, the roll holding section can be pulled out and inserted into the device without requiring a document reading device disposed above the device to be slid or otherwise displaced. This simplifies the structure of a printer and reduces the weight and cost, compared to a printer using a conventional master making device.

(15) The thermal head and platen roller contact each other when the leading edge of the stencil arrives at the position where they are located. Therefore, the leading edge of the stencil is not obstructed at all until it reaches the above position. That is, the stencil is nipped on arriving the position where a platen pressure can be surely exerted. In addition, the stencil can be smoothed before plate making.

Various modifications will become possible for those skilled in the art after receiving the teachings of the present disclosure without departing from the scope thereof.

What is claimed is:

1. A device for automatically peeling off a leading edge of a sheet from a sheet roll and conveying the leading edge, comprising:

peeling means for contacting or adjoining a circumference of the sheet roll in accordance with a varying diameter of the sheet roll, thereby peeling off the leading edge of the sheet; and conveying means located in close proximity to said peeling means for contacting the circumference of the sheet roll in accordance with the varying diameter of the sheet roll, thereby conveying the leading edge of the sheet peeled off by said peeling means;

said conveying means being angularly movable into contact with the circumference of the sheet roll only due to a weight thereof.

2. A device as claimed in claim 1, wherein said peeling means comprises a flat peeler, and wherein said conveying means comprises a pay-out roller having a coefficient of friction necessary for conveying the leading edge of the sheet, and pay-out roller drive means for driving said pay-out roller.

3. A device as claimed in claim 2, wherein said peeler includes a free end angularly movable into contact with the circumference of the sheet roll due to a weight thereof.

4. A device as claimed in claim 3, wherein said peeler further includes a thin elastic portion.

5. A device as claimed in claim 4, wherein as seen in a plan view, said peeler is sequentially flared from an upstream side to a downstream side in an intended sheet pay-out direction, so that said peeler first peels off an intermediate portion of the leading edge of the sheet in a widthwise direction of the sheet, and then sequentially peels off the other portion of the leading edge up to opposite side edges.

6. A device as claimed in claim 5, wherein said peeler further includes an inclined portion inclined toward the circumference of the sheet roll.

7. A device as claimed in claim 6, further comprising rotary drive means for causing the sheet roll to rotate.

8. A device as claimed in claim 5, further comprising rotary drive means for causing the sheet roll to rotate.

9. A device as claimed in claim 4, wherein said free end of said peeler comprises an inclined portion inclined toward the circumference of the sheet roll.

10. A device as claimed in claim 9, further comprising rotary drive means for causing the sheet roll to rotate.

11. A device as claimed in claim 4, further comprising rotary drive means for causing the sheet roll to rotate.

12. A device as claimed in claim 3, wherein as seen in a plan view, said peeler is sequentially flared from an upstream side to a downstream side in an intended sheet pay-out direction, so that said peeler first peels off an intermediate portion of the leading edge of the sheet in a widthwise direction of the sheet, and then sequentially peels off the other portion of the leading edge up to opposite side edges.

13. A device as claimed in claim 12, further comprising rotary drive means for causing the sheet roll to rotate.

14. A device as claimed in claim 3, wherein said free end of said peeler comprises an inclined portion inclined toward the circumference of the sheet roll.

15. A device as claimed in claim 14, further comprising rotary drive means for causing the sheet roll to rotate.

16. A device as claimed in claim 3, further comprising rotary drive means for causing the sheet roll to rotate.

17. A device as claimed in claim 2, wherein said peeler includes a thin elastic portion.

18. A device as claimed in claim 17, further comprising rotary drive means for causing the sheet roll to rotate.

19. A device as claimed in claim 1, wherein said peeling means comprises a peel roller having a coefficient of friction necessary for peeling off the leading edge of the sheet in contact with the circumference of the sheet roll and wherein said conveying means comprises a pay-out roller having a coefficient of friction necessary for conveying the leading edge of the sheet.

20. A device as claimed in claim 19, further comprising roller drive means for causing at least one of said peel roller and said pay-out roller to rotate.

21. A device as claimed in claim 20, wherein said peel roller comprises a fin roller having on a circumference thereof a plurality of fin-like elastic projections having a coefficient of friction necessary for peeling off the leading edge of the sheet.

22. A device as claimed in claim 21, further comprising rotary drive means for causing the sheet roll to rotate.

23. A device as claimed in claim 20, wherein said peel roller and said pay-out roller are formed of sponge and rubber, respectively.

24. A device as claimed in claim 23, further comprising rotary drive means for causing the sheet roll to rotate.

25. A device as claimed in claim 1, further comprising rotary drive means for causing the sheet roll to rotate.

26. A device for making a master out of a stencil paid out from a stencil roll, comprising:

a body;

stencil storing means for storing the stencil such that the stencil can be paid out from the stencil roll, master making means for selectively perforating the stencil paid out from the stencil roll, thereby making the master;

cutting means for cutting off the master from the stencil;

a roll holding section movable into and out of said body and for holding the stencil roll; and automatic peeling means for automatically peeling off the leading edge of the stencil from the stencil roll while conveying the leading edge;

said automatic peeling means comprising:

peeling means for contacting or adjoining a circumference of the stencil roll in accordance with a varying diameter of the stencil roll, thereby peeling off the leading edge of the stencil;

conveying means located in close proximity to said peeling means for contacting the circumference of the stencil roll in accordance with the varying diameter of the stencil roll, thereby conveying the leading edge of the stencil peeled off by said peeling means.

27. A device for making a master out of a stencil paid out from a stencil roll, comprising:

a body;

stencil storing means for storing the stencil such that the stencil can be paid out from the stencil roll;

master making means for selectively perforating the stencil paid out from the stencil roll, thereby making a master;

cutting means for cutting off the master from the stencil;

a roll holding section movable into and out of said body and for holding the stencil roll; and automatic peeling means for automatically peeling off the leading edge of the stencil from the stencil roll while conveying the leading edge;

said automatic peeling means comprising:

peeling means for contacting or adjoining a circumference of the stencil roll in accordance with a varying diameter of the stencil roll, thereby peeling off the leading edge of the stencil;

conveying means located in close proximity to said peeling means for contacting the circumference of the stencil roll in accordance with the varying diameter of the stencil roll, thereby conveying the leading edge of the stencil peeled off by said peeling means; and rotary drive means for rotating the stencil roll wherein said rotary drive means is rotated in such a direction that the leading edge of the stencil is paid out from the stencil roll toward said master making means;

said conveying means being angularly movable into contact with the circumference of the stencil roll due to a weight thereof.

28. A device as claimed in claim 27, wherein said rotary drive means rotates in a direction opposite to an intended stencil pay-out direction, and then rotates in the intended stencil pay-out direction.

29. A device as claimed in claim 27, wherein when said roll holding section loaded with the stencil roll is moved into said body by hand, said rotary drive means rotates in a direction opposite to an intended stencil pay-out direction, and then rotates in the intended stencil pay-out direction.

30. A device as claimed in claim 29, wherein said peeling means adjoins or contacts the circumference of the stencil roll in interlocked relation to a movement of said roll holding section toward an operative position defined in said body.

31. A device as claimed in claim 30, wherein said conveying means contacts the circumference of the stencil roll in interlocked relation to a movement of said roll holding section toward said operative position.

32. A device as claimed in claim 29, wherein said conveying means contacts the circumference of the stencil roll in interlocked relation to a movement of said roll holding section toward an operative position.

33. A device as claimed in claim 27, wherein said peeling means adjoins or contacts the circumference of the stencil roll in interlocked relation to a movement of said roll holding section toward an operative position defined in said body.

34. A device as claimed in claim 33, wherein said conveying means contacts the circumference of the stencil roll in interlocked relation to a movement of said roll holding section toward said operative position.

35. A device as claimed in claim 27, wherein said conveying means contacts the circumference of the stencil roll in interlocked relation to a movement of said roll holding section toward an operative position.

36. A device for a stencil printer and for making a master out of a stencil paid out from a stencil roll, comprising:

stencil storing means for storing the stencil such that the stencil can be paid out from the stencil roll;

master making means for selectively perforating the stencil paid out from the stencil roll, thereby making a master;

cutting means for cutting off the master from the stencil;

a roll holding section for holding the stencil roll; and automatic peeling means for automatically peeling off the leading edge of the stencil from the stencil roll while conveying the leading edge;

said automatic peeling means comprising:

peeling means for contacting or adjoining a circumference of the stencil roll in accordance with a varying diameter of the stencil roll, thereby peeling off the leading edge of the stencil;

conveying means located in close proximity to said peeling means for contacting the circumference of the stencil roll in accordance with the varying diameter of the stencil roll, thereby conveying the leading edge of the stencil peeled off by said peeling means; and rotary drive means for rotating the stencil roll, wherein said rotary drive means is rotated in such a direction that the leading edge of the stencil is paid out from the stencil roll toward said master making means;

said roll holding means and said master making means being constructed into a master making unit movable into and out of a body of said stencil printer;

said conveying means being angularly movable into contact with the circumference of the stencil roll due to a weight thereof.

37. A device as claimed in claim 36, wherein said rotary drive means rotates in a direction opposite to an intended stencil pay-out direction, and then rotates in the intended stencil pay-out direction.

38. A device as claimed in claim 36, wherein when said master making unit is moved into said body of said stencil printer by hand after said roll holding section has been loaded with the stencil roll, said rotary drive means rotates in a direction opposite to an intended stencil pay-out direction, and then rotates in the intended stencil pay-out direction.

39. A device as claimed in claim 38, wherein said peeling means adjoins or contacts the circumference of the stencil roll in interlocked relation to a movement of said master making unit toward an operative position defined in said body of said stencil printer.

40. A device as claimed in claim 39, wherein said conveying means contacts the circumference of the stencil roll in interlocked relation to a movement of said master making unit toward said operative position.

41. A device as claimed in claim 38, wherein said conveying means contacts the circumference of the stencil roll in interlocked relation to a movement of said master making unit toward an operative position.

42. A device as claimed in claim 36, wherein said peeling means adjoins or contacts the circumference of the stencil roll in interlocked relation to a movement of said master making unit toward an operative position defined in said body.

43. A device as claimed in claim 42, wherein said conveying means contacts the circumference of the stencil roll in interlocked relation to a movement of said master making unit toward said operative position.

44. A device as claimed in claim 36, wherein said conveying means contacts the circumference of the stencil roll in interlocked relation to a movement of said master making unit toward an operative position.

45. A device for a stencil printer and for making a master out of a stencil paid out from a stencil roll, comprising:

stencil storing means for storing the stencil such that the stencil can be paid out from the stencil roll;

master making means for selectively perforating the stencil paid out from the stencil roll, thereby making a master;

cutting means for cutting off the master from the stencil;

a roll holding section for holding the stencil roll; and automatic peeling means for automatically peeling off the leading edge of the stencil from the stencil roll while conveying the leading edge;

said automatic peeling means comprising:

peeling means for contacting or adjoining a circumference of the stencil roll in accordance with a varying diameter of the stencil roll, thereby peeling off the leading edge of the stencil; and conveying means located in close proximity to said peeling means for contacting the circumference of the stencil roll in accordance with the varying diameter of the stencil roll, thereby conveying the leading edge of the stencil peeled off by said peeling means;

said roll holding section and said master making means being constructed into a master making unit movable into and out of a body of said stencil printer.

* * * * *

UNITED STATES PATENT AND TRADEMARK OFFICE

CERTIFICATE OF CORRECTION

PATENT NO. : 5,816,149

DATED : October 6, 1998

INVENTOR(S) : HIDEYUKI KAGAWA ET AL

It is certified that error appears in the above-identified patent and that said Letters Patent is hereby corrected as shown below:

Column 1, lines 29-30, change "6-35178134" to --63-178134--.

Column 6, line 62, change "b e" to --be--.

Column 8, line 29, change "SA" to --5A--.

Column 16, line 41, change "dat" to --dot--.

Column 21, lines 66-67, change "o n" to --on--.

Column 39, line 36, change "older" to --holder--.

Column 42, lines 2-3, change "a s" to --as--.

line 34, change "110a" to --100a--;

same line, change "110b" to --100b--.

Column 45, line 7, change "a n" to --an--.

UNITED STATES PATENT AND TRADEMARK OFFICE

CERTIFICATE OF CORRECTION

PATENT NO. : 5,816,149

DATED : October 6, 1998

INVENTOR(S) : HIDEYUKI KAGAWA ET AL

It is certified that error appears in the above-identified patent and that said Letters Patent is hereby corrected as shown below:

Column 47, line 44, after "means" add --; and rotary drive means for rotating the stencil roll, wherein said rotary drive means is rotated in such a direction that the leading edge of the stencil is paid out from the stencil roll toward said master making means;

said conveying means being angularly movable into contact with the circumference of the stencil roll due to a weight thereof--.

Column 48, line 5, change "is rotated" to --rotates--.

Signed and Sealed this

Second Day of January, 2001

*Attest:*

*Attesting Officer*

Q. TODD DICKINSON

*Commissioner of Patents and Trademarks*